US008934813B2

(12) United States Patent
Hosokawa et al.

(10) Patent No.: US 8,934,813 B2
(45) Date of Patent: Jan. 13, 2015

(54) IMAGE-FORMING APPARATUS AND POWDER CONTAINER

(75) Inventors: Hiroshi Hosokawa, Kanagawa (JP); Tsukuru Kai, Kanagawa (JP); Junichi Matsumoto, Kanagawa (JP); Makoto Komatsu, Kanagawa (JP); Tadashi Hayakawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 113 days.

(21) Appl. No.: 13/413,733

(22) Filed: Mar. 7, 2012

(65) Prior Publication Data

US 2012/0230736 A1 Sep. 13, 2012

(30) Foreign Application Priority Data

Mar. 8, 2011 (JP) ..... 2011-050073

(51) Int. Cl.
*G03G 15/08* (2006.01)

(52) U.S. Cl.
CPC ..... *G03G 15/0886* (2013.01); *G03G 15/0872* (2013.01)
USPC ..... 399/119; 399/262

(58) Field of Classification Search
USPC ..... 399/119, 120, 106, 258, 262
See application file for complete search history.

(56) References Cited

U.S. PATENT DOCUMENTS 5,402,212 A 3/1995 Ito et al.
5,598,254 A 1/1997 Ikesue et al.
5,722,020 A * 2/1998 Matsuoka et al. ..... 399/262
5,828,935 A * 10/1998 Tatsumi et al. ..... 399/260
6,097,903 A * 8/2000 Yahata et al. ..... 399/27
6,118,962 A 9/2000 Casper et al.
7,116,928 B2 10/2006 Muramatsu et al.
7,321,744 B2 1/2008 Hosokawa et al.
2002/0043951 A1* 4/2002 Moberg ..... 318/685

(Continued)

FOREIGN PATENT DOCUMENTS

JP 03256081 A 11/1991
JP 04336566 A 11/1992
JP 05173379 A 7/1993

(Continued)

OTHER PUBLICATIONS

Abstract of JP 04-336566 published Nov. 24, 1992.

(Continued)

*Primary Examiner* — Clayton E Laballe
*Assistant Examiner* — Victor Verbitsky
(74) *Attorney, Agent, or Firm* — Harness, Dickey & Pierce P.L.C.

(57) ABSTRACT

An image-forming apparatus includes a development device configured to form a visualized image with a developer, a powder supplier configured to supply the developer from a powder container to the development device and a housing in which the powder supplier and the development device are housed, a loading preparation position which allows the powder container to be placed from an outside of the housing and a loading position which enables the developer to be supplied to the development device from the powder container are set in the powder supplier, and the powder supplier includes a loading drive mechanism configured to move the powder container in a central axis line direction between the loading preparation position and the loading position while rotating the powder container about the central axis line of the powder container.

18 Claims, 30 Drawing Sheets

(56) References Cited

U.S. PATENT DOCUMENTS

| | | | |
|---|---|---|---|
| 2008/0124133 | A1 | 5/2008 | Yoshizawa et al. |
| 2011/0064478 | A1 | 3/2011 | Yamaguchi et al. |

FOREIGN PATENT DOCUMENTS

| | | | |
|---|---|---|---|
| JP | 08-179610 | A | 7/1996 |
| JP | 4317313 | B2 | 12/2000 |

OTHER PUBLICATIONS

Abstract of JP 03-256081 published Nov. 14, 1991.
Abstract of JP 2000-338840 published Dec. 8, 2000.
Abstract of JP 05-173379 published Jul. 13, 1993.
Japanese Office Action dated Nov. 11, 2014 for corresponding Japanese Application No. 2011-050073.

* cited by examiner

IMAGE-FORMING APPARATUS AND POWDER CONTAINER

PRIORITY CLAIM

The present application is based on and claims priority from Japanese Patent Application No. 2011-050073, filed on Mar. 8, 2011, the disclosure of which is hereby incorporated by reference in its entirety.

BACKGROUND

1. Technical Field

The present invention relates to an image-forming apparatus such as a printer, facsimile or copier, to which a developer from a powder container is supplied, and to a powder container to be used therein.

2. Description of the Related Art

A known image-forming apparatus is configured to visualize an electrostatic latent image formed on a latent image carrier by a development device using a toner. In such an image-forming apparatus, the toner in the development device is consumed in order to form an image. For this reason, such an image-forming apparatus includes a toner supplier which supplies a toner to the development device from a toner container.

Such an image-forming apparatus includes the development device and the toner supplier integrally formed as a process cartridge module which moves in a predetermined direction in response to the opening and closing of a cover (door) provided in a portion housing the process cartridge module (refer to Japanese Patent Publication No. 4317313). Therefore, the predetermined direction is set to a direction which moves the process cartridge module on the side of the cover opening direction while separating a magnetic roller of the development device from a photoconductive drum. In this way, the components including the toner container in the process cartridge module can be easily replaced while preventing damage to the photoconductive drum.

However, in this image-forming apparatus, it is necessary to remove the toner container from the process cartridge module or to load therein the toner container by moving the process cartridge module while opening and closing the cover so as to replace the toner container. This may require a large force to be applied for the removing and loading operations of the toner container including the opening and closing operations of the cover, and also may cause spreading of the toner while removing and loading the toner container. These factors could contribute to a decrease in operability, specifically when a large toner container is used.

SUMMARY

The present invention has been made in view of the above circumstances, and an object of the present invention is to provide an image-forming apparatus in which a toner container cab be more easily replaced.

One embodiment of the present invention relates to an image-forming apparatus, including: a development device configured to form a visualized image with a developer; a powder supplier configured to supply the developer from a powder container to the development device; and a housing in which the powder supplier and the development device are housed, wherein a loading preparation position which allows the powder container to be placed from an outside of the housing and a loading position which enables the developer to be supplied to the development device from the powder container are set in the powder supplier, and the powder supplier includes a loading drive mechanism configured to move the powder container in a central axis line direction between the loading preparation position and the loading position while rotating the powder container about the central axis line of the powder container.

BRIEF DESCRIPTION OF THE DRAWINGS

The accompanying drawings are included to provide further understanding of the invention, and are incorporated in and constitute a part of this specification. The drawings illustrate an embodiment of the invention and, together with the specification, serve to explain the principle of the invention.

FIG. 23A illustrates a closed housing cover 31*a*; FIG. 23B illustrates an opened housing cover 31*a*; FIG. 23C illustrates a placed toner container 32YC; FIG. 23D illustrates the toner container 32YC being pushed toward a loading preparation position Sp.

DETAILED DESCRIPTION OF THE PREFERRED EMBODIMENTS

Hereinafter, each embodiment of an image-forming apparatus according to the present invention will be described with reference to the drawings.

Embodiment 1

Figure 1:
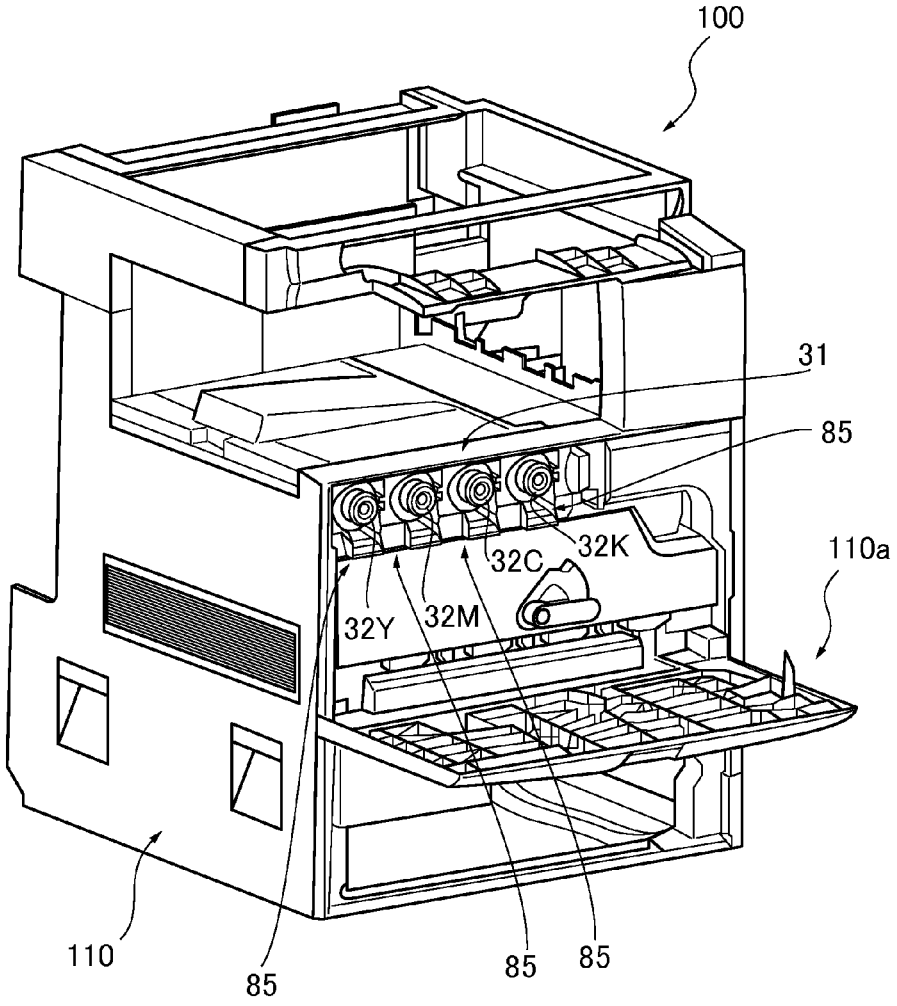
FIG. 1 is a perspective view schematically illustrating an image-forming apparatus 100 as one example of the present invention.
Figure 2:
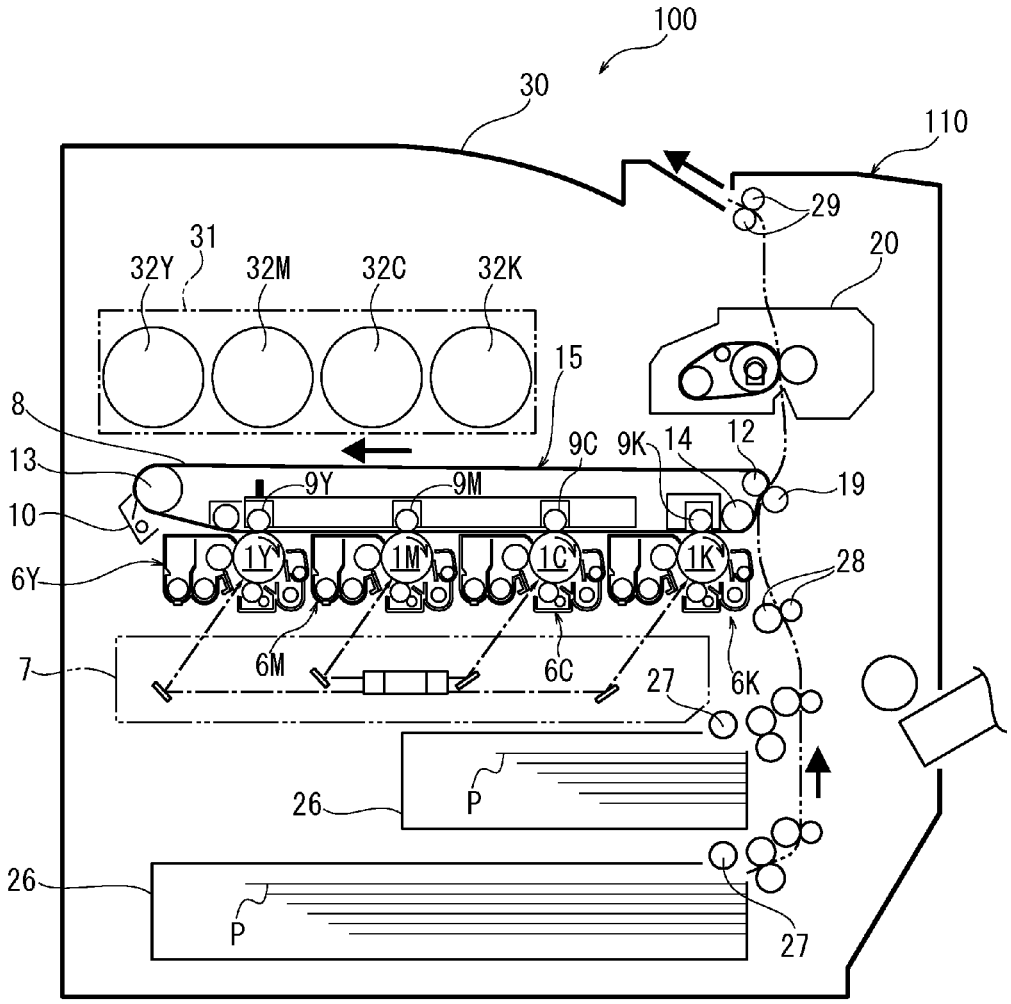
FIG. 2 is a view schematically illustrating the entire configuration of the image-forming apparatus 100.
Figure 3:
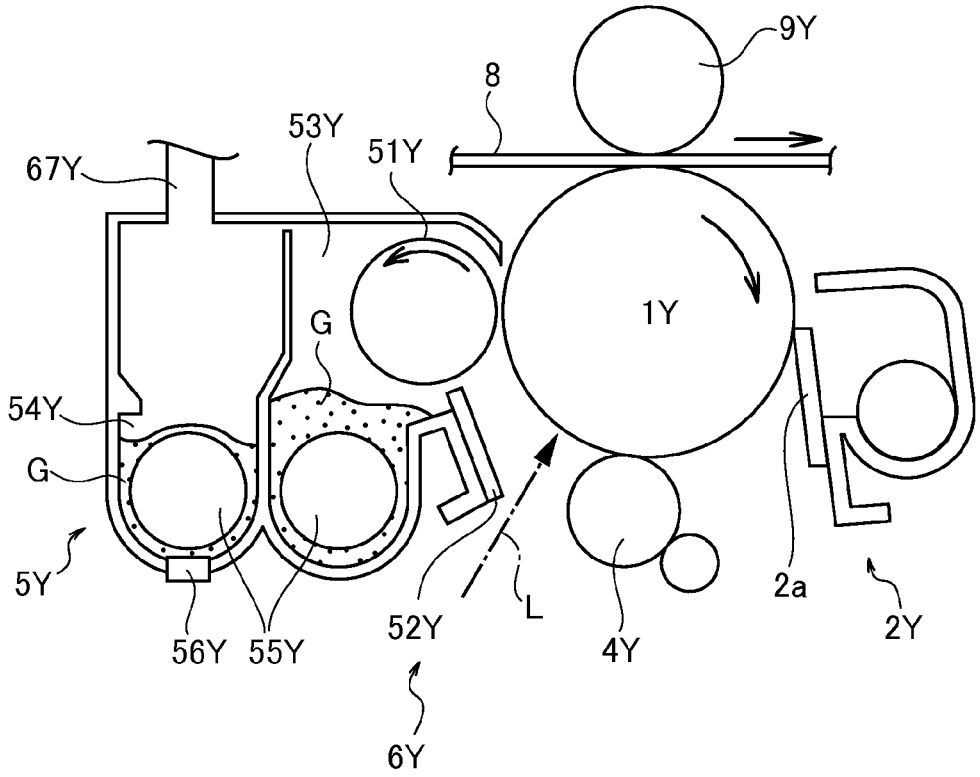
FIG. 3 is a sectional view schematically illustrating the configuration of a development device 5Y and an image-forming unit 6Y.
Figure 4:
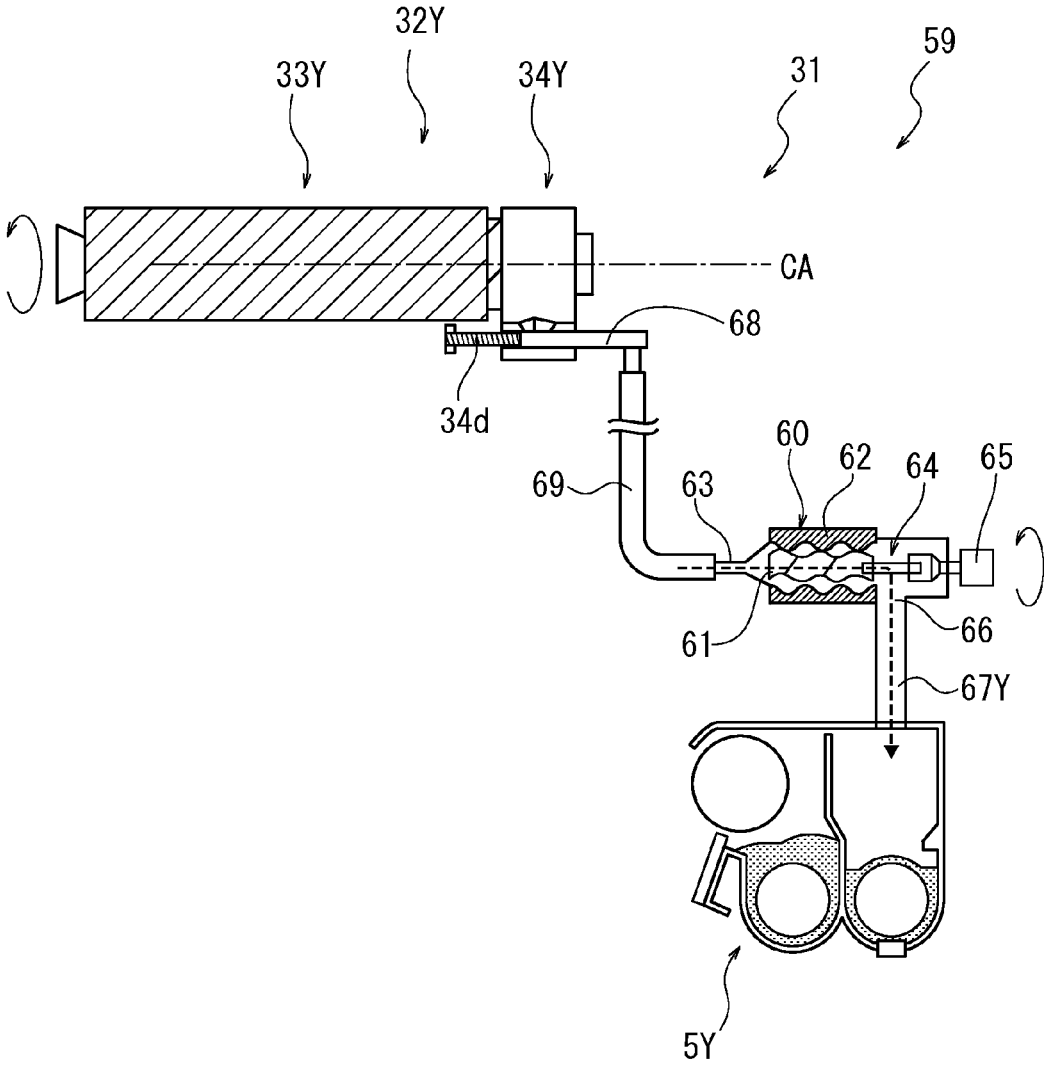
FIG. 4 is a view illustrating a path for supplying a toner in a toner supplier 59.

A configuration of an image-forming apparatus 100 as one example of the image-forming apparatus according to the present invention will be described with reference to FIGS. 1-4. FIG. 1 is a perspective view schematically illustrating the image-forming apparatus 100. FIG. 2 is a view schematically illustrating the entire configuration of the image-forming apparatus 100. FIG. 3 is a sectional view schematically illustrating the configuration of a development device 5Y and an image-forming unit 6Y. FIG. 4 is a view illustrating a path for supplying a toner in a toner supplier 59.

The image-forming apparatus 100 of Embodiment 1 is a color printer, and is housed in a boxing housing 110 as illustrated in FIGS. 1, 2. The image-forming apparatus includes in the upper portion thereof a toner container housing 31. Four toner containers (powder containers) 32Y, 32M, 32C, 32K corresponding to respective colors (yellow, magenta, cyan, black) are detachably (replaceably) disposed in the toner container housing 31. The four toner containers are exposed in the housing 110 (image-forming apparatus 100) by opening a main body cover 110*a* (refer to FIG. 1) provided in the front face of the housing 110. The toner container housing 31 appropriately supplies a toner from the respective toner containers 32Y, 32M, 32C, 32K in accordance with the toner consumption in development devices for respective colors. This configuration will be described later. In the toner container housing 31, the respective toner containers 32Y, 32M, 32C, 32K are replaced by new containers when most of the toners are consumed, and the new toners are loaded. This configuration will be also described later. In addition, the four toner containers, the after-described four image-forming units (6) and the like are provided in the image-forming apparatus 100 in accordance with the respective colors (yellow, magenta, cyan, black); however, those are basically the same in their configurations, so only one configuration corresponding to any one of colors will be hereinbelow described, and the description about the configuration corresponding to the other colors will be omitted.

The image-forming apparatus 100 (housing 110) includes an intermediate transfer unit 15. The intermediate transfer unit 15 is provided below the toner container housing 31. The intermediate transfer unit 15 includes an intermediate transfer belt 8, four primary transfer bias rollers 9Y, 9M, 9C, 9K, an intermediate transfer cleaner 10, a secondary transfer backup roller 12, a cleaning backup roller 13 and a tension roller 14. The intermediate transfer belt 8 of the intermediate transfer unit 15 is stretched by three rollers 12-14 to be supported, and endlessly moves in the arrow direction by the rotation of the secondary transfer backup roller 12. Image-forming units 6Y, 6M, 6C, 6K corresponding to respective colors (yellow, magenta, cyan, black) are disposed in parallel to face the intermediate transfer belt 8.

The image-forming unit 6Y corresponding to yellow will be described below. This image-forming unit includes a photoconductor drum 1Y, a charging section 4Y disposed around the photoconductor drum 1Y, a development device 5Y (development section), a cleaner 2Y and a not shown neutralization section as illustrated in FIG. 3. In this image-forming unit 6Y, an image-forming process (charging, exposing, development, transfer and cleaning steps) is performed on the photoreceptor drum 1 to form a yellow image.

The photoconductor drum 1Y rotates in the clockwise direction in a front view of FIG. 3 by a not shown driving motor. The surface of the photoconductor drum 1Y is uniformly charged in a position facing the charging section 4Y (charging step). After that, the surface of the photoconductor drum 1Y reaches a position illuminated by laser light L emitted from an exposure unit 7 (refer to FIG. 2), and an electrostatic latent image corresponding to yellow is formed by the exposure scanning in that position (exposing step).

Then, the surface of the photoconductor drum 1Y reaches a position facing the development device 5Y, and the electrostatic latent image is developed (visualized) in that position to form a yellow toner image (development step). After the development step, the surface of the photoconductor drum 1Y reaches a position facing the intermediate transfer belt 8 and the primary transfer bias roller 9Y, and the toner image on the photoconductor drum 1Y is transferred to the intermediate transfer belt 8 (primary transfer step). Herein, untransferred toner slightly remains on the surface of the photoconductor drum 1Y.

Thereafter, the surface of the photoconductor drum 1Y reaches a position facing the cleaner 2Y, and an untransferred toner remaining in that position is mechanically collected by a cleaning blade 2*a* (cleaning step). Finally, the surface of the photoconductor drum 1Y reaches a position facing a not shown neutralization section, and a residual potential is eliminated in that position. In this way, the image-forming process on the photoconductor drum 1Y (surface) is completed.

This image-forming process is similarly performed in the other three image-forming units 6M, 6C, 6K as illustrated in FIG. 2. For this image-forming process in each image-forming unit, a laser light is emitted from a light source in the exposure unit 7 based on image information, and is irradiated on each of the photoconductor drums 1Y, 1M, 1C, 1K through a plurality of optical elements while scanning the laser light L with a rotating polygon mirror. With this process, the image-forming unit 6M forms a magenta toner image, the image-forming unit 6C forms a cyan toner image and the image-forming unit 6K forms a black toner image.

In the intermediate transfer unit 25, the four primary transfer bias rollers 9Y, 9M, 9C, 9K and the photoreceptor drums 1Y, 1M, 1C, 1K sandwich the intermediate transfer belt 8 to form primary transfer nips. A transfer bias having a polarity opposite to that of a toner is applied to each of the primary transfer bias rollers 9Y, 9M, 9C, 9K. Because of this, the toner images of the respective colors on the photoconductor drums 1Y, 1M, 1C, 1K are primary transferred on the intermediate transfer belt 8 to be overlapped on each other while the intermediate transfer belt 8 runs in the arrow direction to sequentially pass through the primary transfer nips between the respective primary transfer bias rollers 9Y, 9M, 9C, 9K and photoconductor drums 1Y, 1M, 1C, 1K. A color image is thereby formed on the intermediate transfer belt 8.

After that, a portion of the intermediate transfer belt 8 on which the toner images of respective colors are overlapped and transferred (on which the color image is formed) reaches a position facing the secondary transfer roller 19. In this position, the intermediate transfer belt 8 is sandwiched between the secondary transfer backup roller 12 and the secondary transfer roller 19 to form a secondary transfer nip. Therefore, the four color toner images (color image) formed on the intermediate transfer belt 8 are transferred onto a transfer member P such as transfer paper which is carried to the position of the secondary transfer nip. In this case, an untransferred toner remains on the intermediate transfer belt 8.

Thereafter, a part of the intermediate transfer belt 8 on which the untransferred toner remains reaches a position in which the intermediate transfer cleaner 10 is disposed. The untransferred toner on the intermediate transfer belt 8 is collected by the intermediate transfer cleaner 10 in this position. In this way, the transfer process on the intermediate transfer belt 8 is completed.

The transfer member P which is carried to the secondary transfer nip is carried from a paper-feeding unit 26 provided in the lower portion of the housing 110 (image forming apparatus 100) through a paper feeding roller 27, a pair of registration rollers 28 and the like. A plurality of overlapped transfer members P such as transfer paper is housed in the paper-feeding unit 26. In the paper-feeding unit 26, a paper-feeding roller 27 rotates in the counterclockwise direction in the front view of FIG. 2, so that the top transfer member P is fed between the registration rollers 28. The registration rollers 28 stop rotating to once stop the fed transfer member P in the position of the roller nip. After that, the registration rollers 28 rotate in accordance with the passing of the color image formed portion on the endlessly moving intermediate transfer belt 8, and feed the transfer member P toward the secondary transfer nip. Therefore, a desired color image is transferred on the transfer paper P.

Thereafter, the transfer member P on which the color image is transferred in the position of the secondary transfer nip is fed to a fusing unit 20. The color image transferred on the surface of the transfer member P is fused on the transferred paper P by the heat and pressure from a fusing roller and a pressure roller. The transfer member P is then discharged outside the apparatus (outside the housing 110) through a pair of discharge rollers 29. The transfer member P discharged by the paper discharge rollers 29 is sequentially stacked on a stacking portion 30 as an output image. In this way, the image-forming process in the image-forming apparatus 100 is completed.

Next, the configuration and operation of the image-forming unit 6Y and the development device 5Y will be described with reference to FIG. 3. The development device 5Y includes a development roller 51Y facing the photoconductor drum 1Y, a doctor blade 52Y facing the development roller 51Y, developer containers 53Y, 54Y, two carrying screws 55Y provided in the developer containers, respectively, and a sensor 56Y which detects a concentration of a toner in a developer. The development roller 51Y includes inside thereof a not shown fastened magnet and a not shown sleeve rotating around the magnet. Each of the developer containers 53Y, 54Y houses a two-component developer G made of a carrier and a toner. In the image-forming apparatus 100 of Embodiment 1, an image is formed by using the two-component developer G. The developer housing 54Y includes in the upper portion thereof an opening, and is connected with a toner-carrying pipe 67 through the opening. The toner carrying pipe 67Y constitutes a part of the after-described toner supplier 59 (refer to FIG. 4), and is configured to appropriately supply a toner such that a ratio of the toner (toner concentration) in the developer G in the development device 5Y becomes within a predetermined range. That is, the toner housed in the toner container 32Y is supplied to the developer container 54Y via the toner carrying pipe 67Y from the toner supplier 59Y (refer to FIG. 4) in accordance with the toner consumption in the development device 5Y. In addition, the configuration and the operation of the toner supplier 59 and the toner container 32Y will be described later.

The development device 5Y operates as follows. The toner supplied into the developer housing 54Y is mixed and agitated with the carrier by the two carrying screws 55Y, and moves in one and the other in the vertical direction of FIG. 3 in the two developer housings 53Y, 54Y to be circulated with each other. The toner is absorbed to the carrier by the frictional charging with the carrier, so that the developer G is carried on the development roller 51Y by a magnetic field formed by a magnet inside the development roller 51Y. In this development roller 51Y, the carried developer G moves due to the rotation of a not shown sleeve in the arrow direction of FIG. 3, and reaches the position of the doctor blade 52Y. After that, the amount of the developer G on the development roller 51Y is appropriately controlled by the doctor blade 53Y in that position. Then, the developer G is carried to a position facing the photoconductor drum 1Y (development area). Thereafter, the toner is absorbed onto the latent image formed on the photoconductor drum 1Y by an electric field formed in the development area. The developer G remaining on the developer roller 51Y reaches the upper portion of the developer housing 53Y along the rotation of the sleeve, and is removed from the development roller 51Y in this position.

Next, the toner supplier (powder supplier) 59 which guides the toner housed in the toner container 32Y to the development device 5Y will be described with reference to FIG. 4. In FIG. 4, the arrangement directions of the toner container 32Y, toner carrying pipe 67Y, screw pump 60, nozzle 68, tube 69 and development device 5Y are different from the actual configuration for simplifying the description. The supplier 59 includes a toner container housing 31, and is configured to appropriately supply a toner from each of the toner containers 32Y, 32M, 32C, 32K mounted on the toner container housing 31. The configuration of the toner container housing 31 will be described later.

In the toner supplier 59, the nozzle 68 provided in the toner container housing 31 is connected with the held portion 34Y of the toner container 32Y in the after-described holder 84 (refer to FIG. 8) when the toner container 32Y is set in the after-described loading preparation position Sp in the toner container housing 31. Herein, a stopper 34*d* (opening and closing member) of the toner container 32Y opens the toner outlet B (refer to FIG. 6) of the held portion 43Y as described below. The toner housed in the container main body 33Y of the toner container 32Y can be thereby carried in the nozzle 68 through the toner outlet B to be appropriately loaded (set).

The nozzle 68 extends in the extending direction of the after-described housing section 81 in the after-described holder 84 (refer to FIG. 8) (the moving direction (central axis line CA direction) of the toner container 32Y housed in the housing section 81). The nozzle 68 includes a positional relationship which corresponds to a through-hole (refer to FIG. 6) of the after-described holder main section 34*c*1 of the toner container 32Y housed in the housing section 81 as seen in the direction along the face orthogonal to the extending direction. The other end of the nozzle 68 is connected with one end of a tube 69 as a carrying tube. The tube 69 is made of a flexible member having a good anti-toner property. The other end of the tube 69 is connected with a screw pump 60 (Moineau pump) of the toner supplier 59.

The screw pump 60 is a suction type uniaxial eccentric screw pump, and includes a rotor 61, stator 62, suction port 63, universal joint 64 and motor 65. The rotor 61, stator 62, and universal joint 64 are housed in a not shown case. The stator 62 is a female screw member made of an elastic member such as rubber and includes in the inner wall face thereof a spiral groove with a double pitch. The rotor 61 is a male screw member in which a shaft made of a rigid member such as metal is formed in a spiral shape, and is rotatably inserted into the stator 62. One end of the rotor 61 is rotatably connected with the motor 65 via the universal joint 64.

The screw pump 60 rotates the rotor 61 in the stator 62 by the motor 65 in a predetermined direction (the counterclockwise direction as seen from the upstream side in the toner carrying direction in Embodiment 1) so as to generate negative pressure in the tube 69 by discharging air in the tube 69 and to generate a suction force in the suction port 63. With this configuration, the toner (yellow) in the toner container 32Y is sucked in the suction port 63 via the tube 69 with air. The toner sucked in the suction port 63 enters in a space between the stator 62 and the rotor 61, and is sent on the other end side (the side opposite to the suction port 63) of the stator 62 along the rotation of the rotor 61. The sent toner is discharged from the sending port 66 of the screw pump 60, and is supplied in the development device 5Y via the toner carrying pipe 67Y (refer to the dashed line arrow in FIG. 4).

Figure 5:
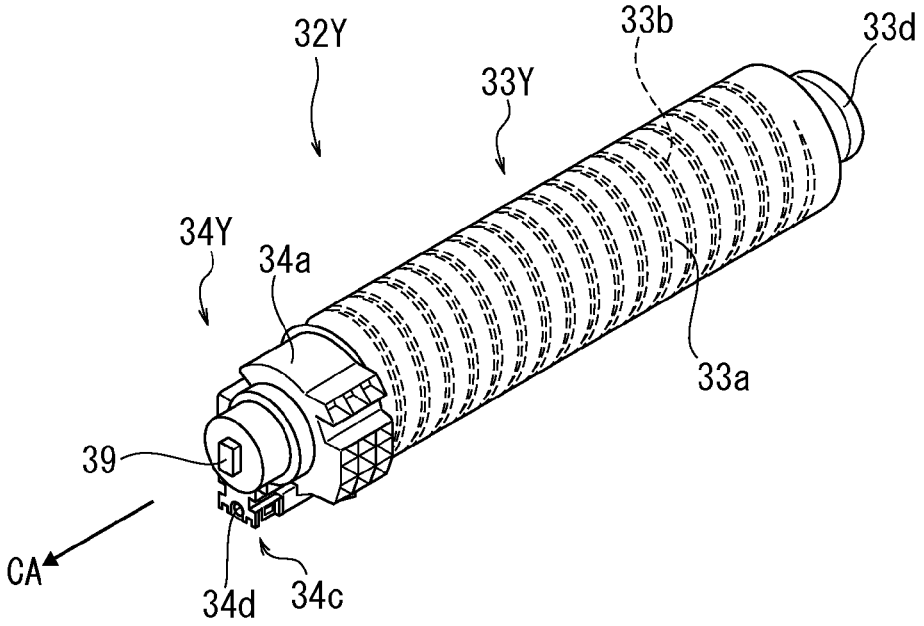
FIG. 5 is a perspective view schematically illustrating a toner container 32Y.
Figure 6:
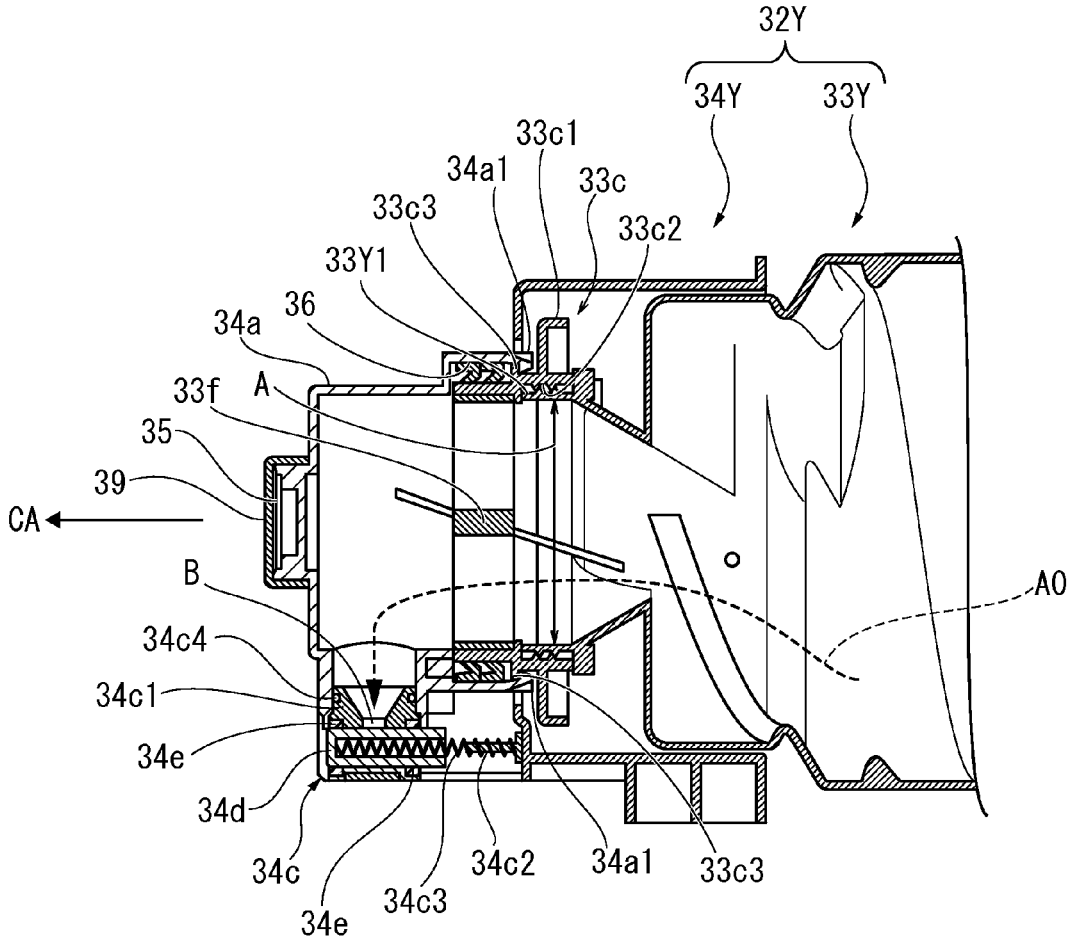
FIG. 6 is a sectional view illustrating a configuration of a held portion 34Y of the toner container 32Y.
Figure 7:
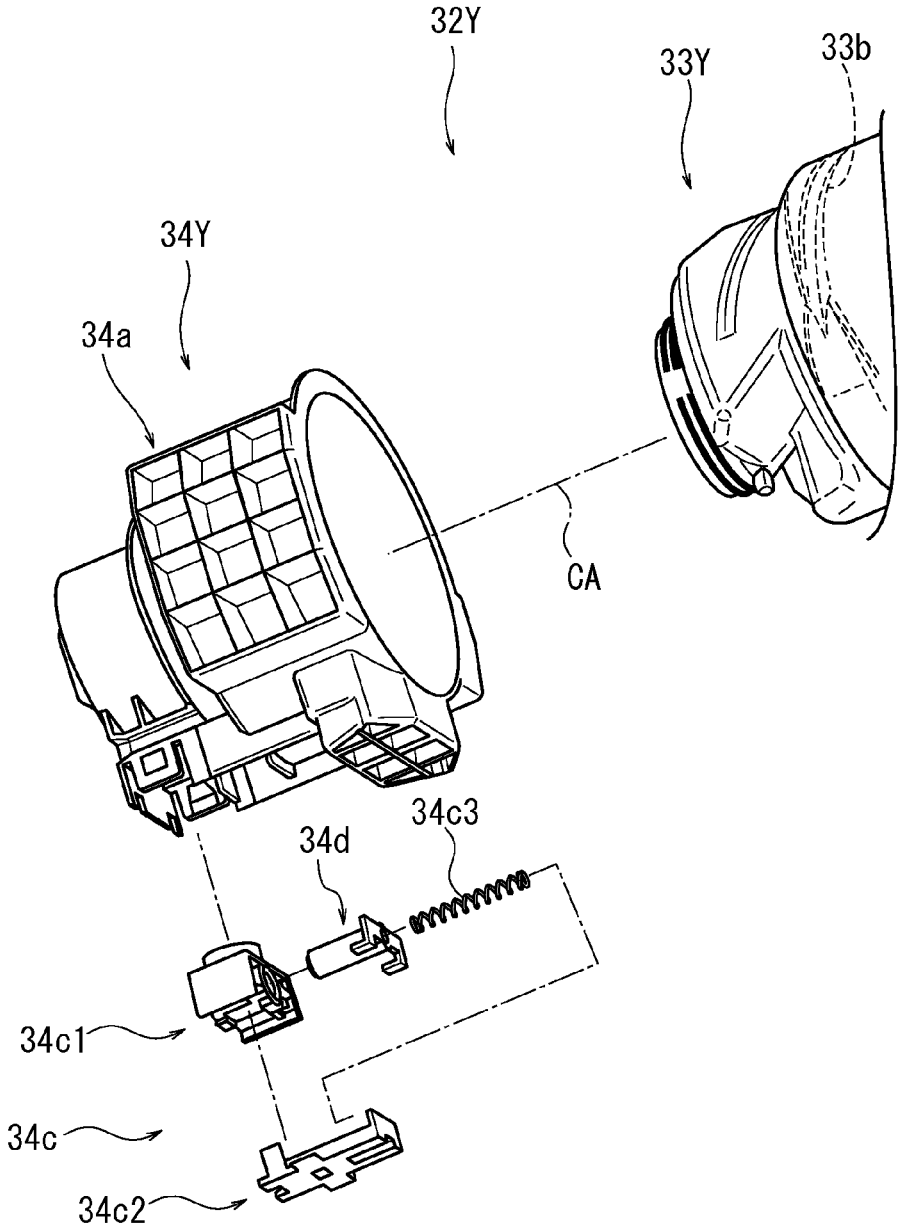
FIG. 7 is a view illustrating a disassembled held portion 34Y of the toner container 32Y.

Next, the toner container 32Y will be described with reference to FIGS. 5-7. FIG. 5 is a perspective view schematically illustrating the toner container 32Y. FIG. 6 is a sectional view illustrating the head portion side of the toner container 32Y (around the held portion 34Y). FIG. 7 is an exploded perspective view illustrating the head portion side of the toner container 32Y.

The toner container 32Y includes a substantial hollow cylindrical shape, and houses a yellow toner. The toner container 32Y includes the container main body 33Y and the held portion 43Y (bottle cap) provided in the head portion of the container main body 33Y. The head portion of the container main body 33Y includes a gear 33*c*1 (gear member 33*c*) rotating with the main body 33Y and an opening A (refer to FIG. 6). The opening A is provided in the head portion (the side to be placed in mounting) of the container main body 33Y, and is disposed to discharge the toner (yellow) housed in the container main body 33Y toward the space in the held portion 34Y.

The back end portion (bottom portion) of the toner container 33Y includes a grip 33*d* to be gripped by a user in the operation for replacing (attaching and detaching) the toner container 32Y. The container main body 33Y includes in the inner circumferential face thereof a spiral projection 33*b* (refer to FIG. 10). This spiral projection 33*b* pushes the toner on the opening A side while the toner container 33Y rotates in the predetermined direction (refer to arrow A in FIG. 10).

In Embodiment 1, the container main body 33Y of the toner container 32Y rotates in the counterclockwise direction as seen from the upstream side in the toner carrying direction when loaded and used. The spiral direction (winding direction) of the projection 33*b* in the container main body 33Y is set in the right direction. Because of this, right-hand spiral airflow is formed in the toner container 32Y due to the rotation of the container main body 33Y (the same direction as the rotation direction of the spiral airflow formed in the screw pump 60 (refer to FIG. 4)).

The holding portion 34Y provided in the head portion of the container main body 33Y includes a cap 34*a*, holder 34*c* (refer to FIGS. 6, 7), stopper 34*d* (shutter) as an opening and closing member, packing 34*e* (refer to FIG. 6) and IC chip 35 (refer to FIG. 6) as an electronic component.

The cap 34*a* forms an external form of the held portion 34Y and an internal space of the held portion 34Y. The back end (the end portion on the container main body 33Y side) of the cap 34*a* includes a click 34*a*1. The click 34*a*1 engages with an engagement portion 33*c*3 (refer to FIG. 6) formed in the after-described gear member 33*c* provided in the head portion of the container main body 33Y with an appropriate clearance. With this configuration, the container main body 33Y is rotatably held to the cap 34*a*, namely, the held portion 43Y. The holder 34*c* is attached to the cap 34*a*.

The holder 34*c* includes a holder main portion 34*c*1, holder cover 34*c*2 and compressed spring 34*c*3 as an energizing member as illustrated in FIG. 7. The holder main portion 34*c*1 includes the toner outlet B which opens in the direction orthogonal to the central axis line CA and a through-hole which is connected with the toner outlet B to be orthogonal thereto and into which the nozzle 68 is insertable. The stopper 34*d* is inserted into the through-hole of the holder main portion 34*c*1 from the back side thereof (container main body 33Y side). The stopper 34*d* includes a blind hole into which a part of the compressed spring 34*c*3 is inserted. The holder 34*c* is configured such that the holder main portion 34*c*1 having the through-hole into which the stopper 34*d* and the compressed spring 34*c*3 are inserted is mounted on the cap 34*a* (holder 34Y) via an O-ring 34*c*4 (refer to FIG. 6) by the holder cover 34*c*2. With this configuration, it is possible to prevent the toner from scattering from the outer circumferential face of the holder main portion 34*c*1 in the holder 34*c*. Herein, the stopper 34*d* energized by the compressed spring 34*c*3 is movable in the direction along the central axis line CA in the through-hole of the holder main portion 34*c*1. This stopper 34*d* is able to open and close the toner outlet B formed in the holder main portion 34*c*1 due to the movement in the central axis line C direction. The holder main portion 34*c*1 includes the 34*e* (refer to FIG. 6) in both ends of the through-hole cutting across the toner outlet B. Each packing 34*e* is made of a G seal, for example, to control the leakage of the toner from the peripheral portion of the stopper 34*d*.

In the toner supplier 59, the leading end of the nozzle fastened in the after-described holder 84 is inserted into the through-hole of the holder main portion 34*c*1 (refer to FIG. 10) due to the approach of the toner container 32Y to the after-described loading position Lp (refer to FIG. 10) in the toner container housing 31. Then, the stopper 34*d* is pressed on the back side (container main body 33Y side) of the through-hole of the holder main portion 34*c*1 in the direction along the central axis line CA to open the toner outlet B. The nozzle 68 includes a nozzle supply port 68*a* (refer to FIG. 10) on the toner outlet B side. After that, the toner outlet B completely opens by the pressure of the nozzle 68 whereas the toner outlet B communicates with the nozzle supply port 68*a* (refer to FIG. 10) when the holder 34*c* is located in a position (hitting standard position) which hits a not shown engagement wall provided in the holder 84. Consequently, upon the setting of the toner container 32Y in the loading position Lp in the toner container housing 31, the nozzle 68 (opening (nozzle supply port 68*a*)) of the toner container housing 31 is connected with the holder 34Y (toner outlet B) of the toner container 32Y to be appropriately loaded (set) in the holder 84. The toner container 32Y is able to effectively control the scattering of the toner even in an individual which is not disposed in the toner container housing 31 because the toner outlet B is effectively closed by the stopper 34*d* energized in the closing direction by the compressed spring 34*c*3 provided in the holder 34*c*.

In the toner container 32Y two packings 36 are arranged in parallel between the head portion of the container main body 33Y and the cap 34*a* of the held portion 34Y as illustrated in FIG. 6. In Embodiment 1, each of the packings 36 is made of a G seal. Each of the packings 36 includes a lip portion, and the leading end of the lip portion inclines to reduce the inner diameter of the lip portion as the leading end of the lip portion comes close to the opening A side (left side in FIG. 6 as seen from the front) in the container main body 33Y.

A gear member 33*c* formed separately from the container main body 33Y is provided in the toner container 32Y by screwing. The gear member 33*c* includes a circular shape. The gear member 33*c* also includes in the outer circumferential face thereof a gear 33*c*1 and on the back end side (container main body 33Y side) of the inner circumferential face thereof a screw groove 33*c*2. The gear member 33 also includes an engagement portion 33*c*3 before the gear 33*c*1 of the outer circumferential face. The screw groove 33*c*2 is threadably mounted on the screw groove 33Y1 formed in the outer circumferential face of the opening of the container main body 33Y in a state in which the agitation member 33*f* is fitted on the entire end side of the inner circumferential face of the gear member 33*c*, so that the gear 33*c* is fastened to the container main body 33Y. This gear member 33*c* includes in the inner circumferential face thereof a not shown convex portion. The gear member 33*c* is prevented from being removed from the container main body 33Y by the engagement between the convex portion formed in the inner circumferential face of the gear member 33*c* after moving beyond the convex portion formed in the container main body 33Y and the convex portion formed in the container main body 33Y.

The gear 33*c*1 of the gear member 33*c* meshes with a not shown driving gear of a driver provided in the after-described holder 84 (toner container housing 31) of the housing 110 (image-forming apparatus 100), and rotates the container main body 33Y about the central axis line CA (refer to FIG. 5). The gear 33*c*1 is exposed from a not shown cutout formed in the held portion 34Y, and meshes with a not shown driving gear of the toner container housing 31 with the toner container 32Y being placed in the after-described loading position Lp (refer to FIG. 10) in the toner container housing 31.

The agitation member 33*f* fitted to the inner circumferential face of the gear 33*c* is located in the opening A of the toner container 32Y. The agitation member 33*f* is a bar-like member which is disposed at angle to the central axis line CA and extends in the container main body 33Y from the space in the held portion 34Y. The agitation member 33*f* rotates with the container main body 33Y to improve the toner discharge performance from the opening A. In Embodiment 1, the gear 33*c*1 is constituted by the gear member 33*c* formed separately from the container main body 33Y, but the gear 33*c*1 is not limited to that in Embodiment 1, and can be integrated with the container main body 33Y.

The space inside the held portion 34Y (cap 34*a*) communicates with the container main body 33Y through the opening A. The toner (yellow) discharged from the opening A is discharged from the toner outlet B (refer to the arrow A0 in FIG. 6). In Embodiment 1, the space inside the held portion 34Y (34*a*) is formed in a substantially cylinder shape, and the tone discharge path (vertical path) from the space inside the held portion to the toner outlet B is formed in a mortar shape. With this configuration, the spiral airflow formed in the container main body 33Y due to the rotation of the container main body 33Y is maintained without disappearing, and effectively sent to the toner outlet B. Therefore, the carrying performance of the toner which is discharged from the toner outlet B to move in the tube 69 (refer to FIG. 4) is improved.

The held portion 34Y includes a not shown engagement groove which slidably engages with a rotation stopper engagement portion provided in a space from the after-described loading preparation position Sp (refer to FIG. 8) to loading position Lp (refer to FIG. 10) in the housing section 81. The rotation stopper engagement portion is provided in the housing section 81 (refer to FIG. 8), and is configured to enable the held portion 34Y to move in the central axis line CA direction while preventing the rotation of the held portion 34Y and also the rotation of the container main body 33Y in the housing section 81 as described later. The held portion 34Y includes in the end face thereof a not shown concave portion to which a convex portion provided in the holder 84 is fitted. The convex and concave portions are provided for preventing an undesired color image due to miss-attachment of a toner container (for example, a yellow toner container housing is attached to a cyan toner container housing).

The cap 34*a* (held portion 34Y) includes in the leading end face thereof an IC chip 35. The IC chip 35 (electronic component) faces a communication circuit 37 of the toner container housing 31 at a predetermined distance with the toner container 32Y being set in the loading position in the toner container housing 31 (holder 84) so as to enable noncontact communication (wireless communication) with the communication circuit 37. Various types of information about the toner container 32Y and the toner housed therein is previously stored in the IC chip 35. The IC chip 35 outputs the previously stored information to a controller 38 of the image-forming apparatus via the communication circuit 37 and receives the information of the image-forming apparatus 100 obtained by the controller 38. This previously stored information is, for example, information about toners such as a color, manufacturing number (manufacturing rod), manufacturing date and the like and information about recycling of the toner container 32Y such as number of times, date, maker and the like. In the image-forming apparatus 100, the best suited control is performed, for example, the operation of the toner supplier 59 is stopped based on the information from the IC chip 35 when a toner color is different from a toner color which should be provided in the toner container housing, for example, and the imagine forming condition is changed according to a manufacturing number or recycling maker. The IC chip 35 is covered by a protection cap 39.

Next, the toner container housing 31 in which the respective toner containers 32Y, 32M, 32C, 32K are loaded will be described. The toner container housing 31 constitutes the housing section 81 in which the respective toner containers 32Y, 32M, 32C, 32K are loaded in the toner supplier 59 as described above. In the image-forming apparatus 100, upon the placement of each toner container 32Y, 32M, 32C, 32K in the loading preparation position Sp (refer to FIG. 8) in the housing section 81 (placed condition), the respective toner containers 32Y, 32M, 32C, 32K move to the loading position Lp (refer to FIG. 10) of an appropriate loaded position by a drive mechanism for loading 70 (hereinafter, referred to as a loading driver mechanism 70). The toner container housing 31 includes the four housing sections 81 and loading drive mechanisms 70 corresponding to the respective colors (yellow, magenta, cyan, black), but these are basically the same, so the yellow configuration will be only described hereinbelow, and the other configurations will be omitted.

Figure 8:
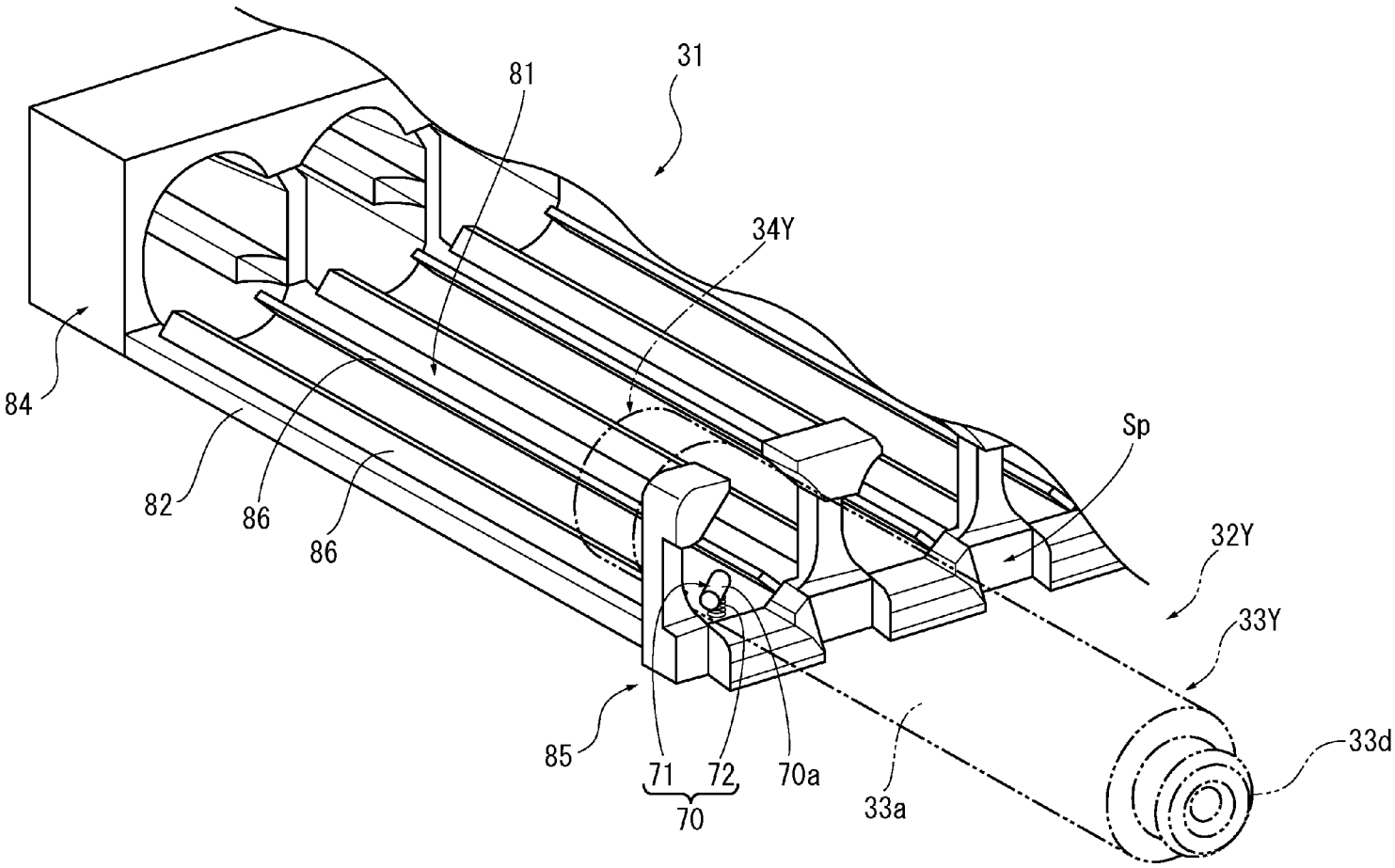
FIG. 8 is a view illustrating a configuration of a housing section 81 of a toner container housing 31.
Figure 9:
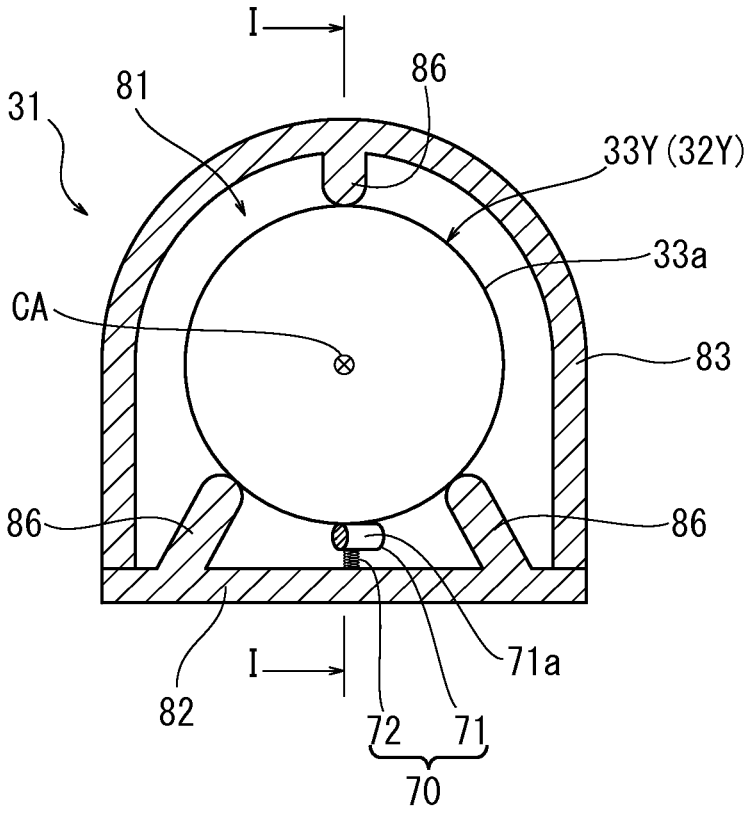
FIG. 9 is a sectional view schematically illustrating the configuration of the housing section 81.
Figure 10:
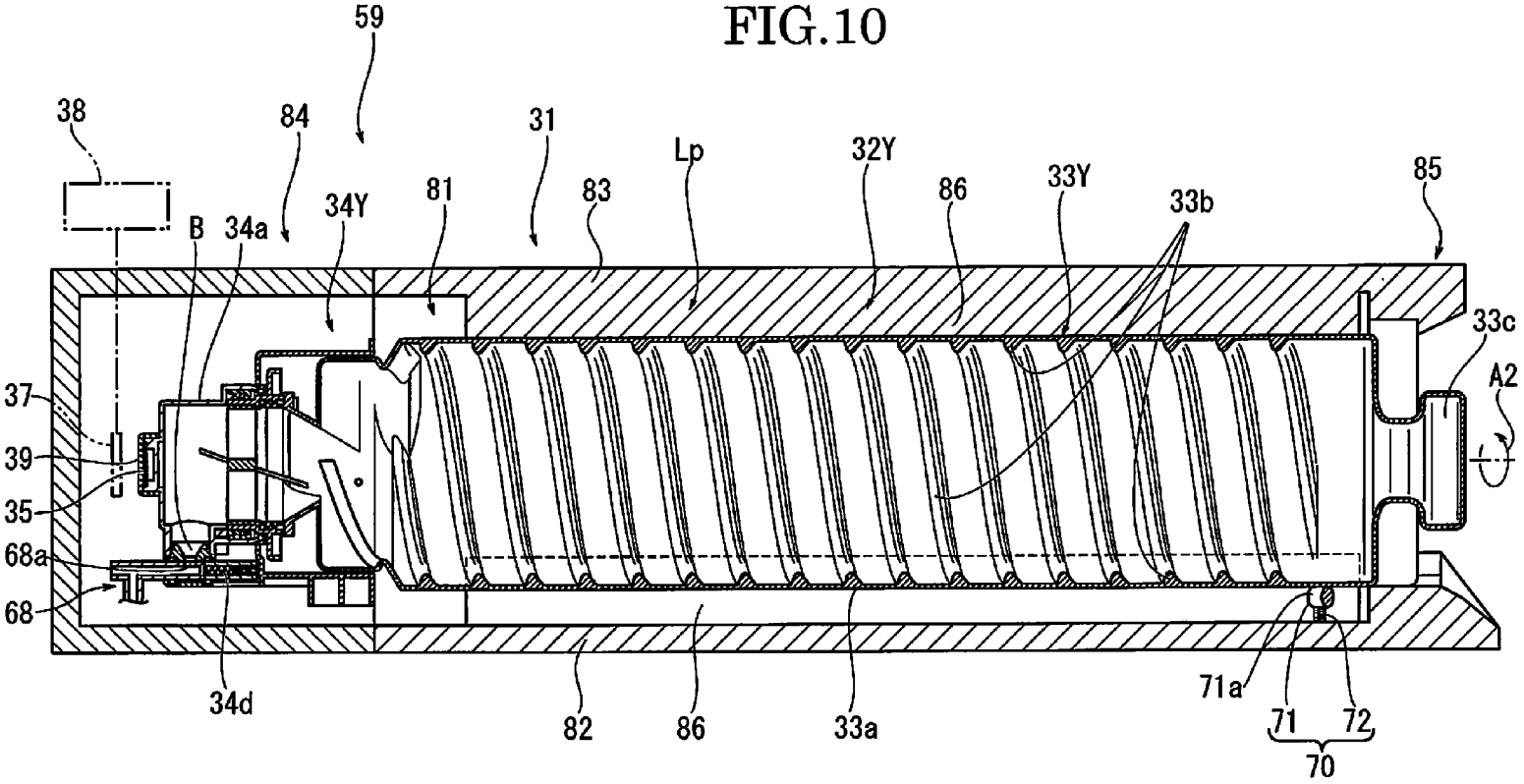
FIG. 10 is a sectional view along I-I line in FIG. 9.

A part of the toner container housing 31 (housing section 81) is exposed with the opened main body cover 110 provided in the front face of the housing 110. FIGS. 8-10 provide schematic configurations corresponding to the toner container 32Y of the housing section 81. In FIGS. 8-10, the after-described rotation driver 71 and coil spring 72 as the loading drive mechanism 70 are only described for simplifying the description.

The housing section 81 is formed such that a long platform 82 corresponding to the toner container 32Y is covered by a circumferential wall portion 83 (refer to FIGS. 9, 10) provided in the housing 110 (refer to FIG. 1). The housing section 81 includes one end (bask side in the housing 110) provided with a holder 84 to which the held portion 34Y (cap 34*a*) of the toner container 32Y is mounted and the other end provided with a mounting opening 85 which is an entrance to the housing section 81. The holder 84 is used for connecting the held portion 34Y of the toner container 32Y and the nozzle 68 (refer to FIG. 10). The attachment opening 85 is a portion which is exposed outside in the toner container housing 31 (housing section 81) with the opened main body cover 110*a* (refer to FIG. 1), and forms an opening into which the toner container 32Y is inserted.

The housing section 81 includes three projections 86 and the loading drive mechanism 70. The projection 86 projects inwardly to slidably support the container main body 33Y of the toner container 32Y in the housing section 81, and extends in the mounting direction in the housing section 81. In Embodiment 1, two projections 86 are provided in the platform 82 while one projection is provided in the outer circumferential wall portion 83 (refer to FIGS. 9, 10). The circular container main body 33Y is able to be supported by the three points (refer to FIG. 9) as seen in the cross sectional surface orthogonal to the central axis line CA. Because of this, the three projections 86 operate as holders which slidably hold the container main body 33Y of the toner container 32Y in the housing section 81.

The loading drive mechanism 70 is configured to move the toner container 32Y (container main body 33Y) slidably held in the housing section 81 in the central axis line CA direction while rotating the toner container 32Y (container main body 33Y) about the central axis line CA. In Embodiment 1, the loading drive mechanism 70 includes a rotatable cylindrical rotation driver 71 and a coil spring 72 as an energizing member. The loading drive mechanism 70 is configured such that the rotation driver 71 is energized to be pressed against the toner container 32Y (container main body 33Y) toward the center of the three projections 86 in the housing section 81, namely, the central axis line CA of the toner container 32Y (container main body 33Y) held by the projections 86. The rotation driver 71 is provided at an angle relative to the central axis line CA of the toner container 32Y (container main body 33Y) held in the housing section 81.

The rotation driver 71 includes a circumferential wall face 71*a* to generate appropriate friction to the outer circumferential face 33*a* of the container main body 33. Herein, the appropriate friction is to enable the rotation and the driving of the container main body 33Y through the contact portion of the circumferential wall face 71*a* and the outer circumferential face 33*a* during the rotation of the rotation driver 71, namely, to be able to transfer the rotation driving force of the rotation driver 71 to the container main body 33Y as a rotation energizing force. The appropriate friction is obtained by, for example, each other's materials, a fine asperity or groove.

Figure 12:
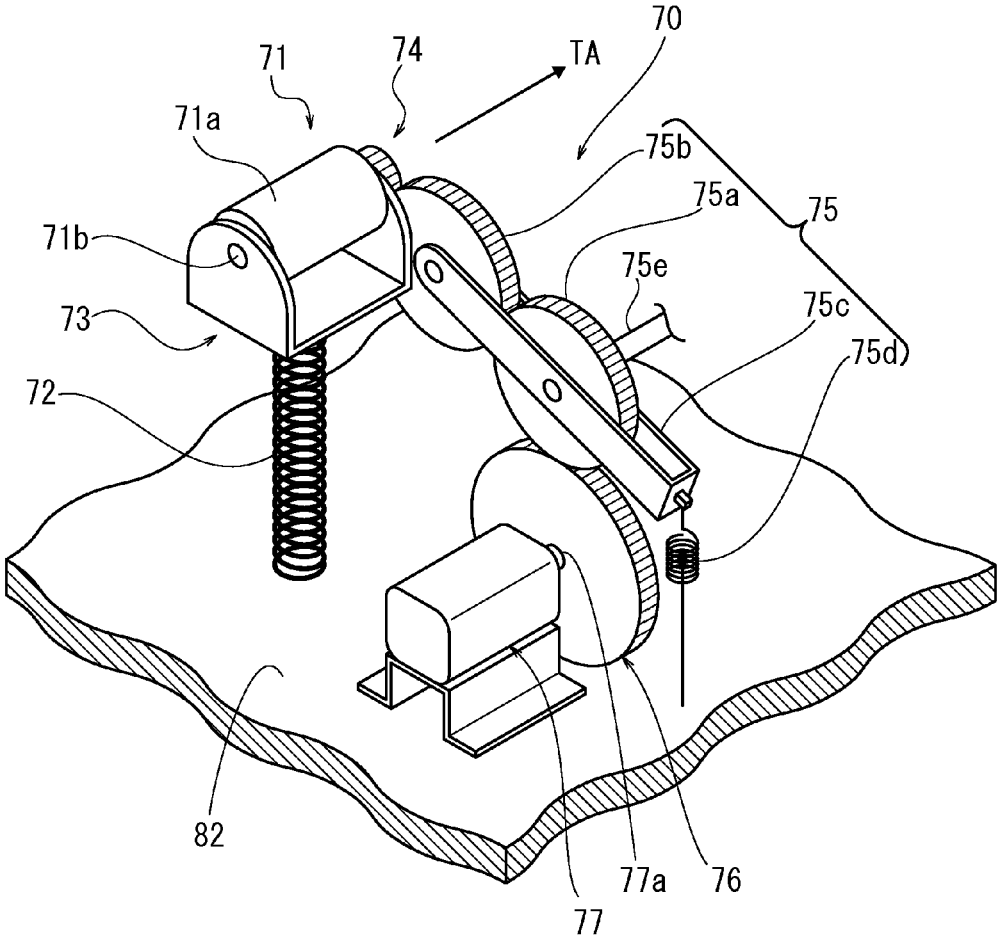
FIG. 12 is a view schematically illustrating the configuration of the drive mechanism for loading 70.

FIG. 12 illustrates one specific example of the loading drive mechanism 70. In Embodiment 1, as illustrated in FIG. 12, the loading drive mechanism 70 includes a driver holding case 73, input gear 74, transmission mechanism 75, output gear 76 and motor 77 in addition to the rotation driver 71 and coil spring 72. The driver holding case 73 rotatably supports both ends of a rotation shaft 71*b* extended from both ends of the rotation driver 71. The coil spring 72 is provided between the driver holding case 73 and the platform 82. The input gear 74 is fastened to one rotation shaft 71*b* of the rotation driver 71. The input gear 74 is connected with the transmission mechanism 75.

The transmission mechanism 75 is disposed to transmit the rotation driving force from the motor 77 (output gear 76). The transmission mechanism 75 includes an oscillating central gear 75*a*, transmission gear 75*b*, connection frame 75*c* and tension spring 75*d*. The oscillating central gear 75*a* meshes with the transmission gear 75*b* while being integrally held in the connection frame 75*c*. The connection frame 75*c* rotatably holds the rotation central shaft 75*e* of the oscillating central gear 75*a* while one end side thereof rotatably holds the transmission gear 75*b*, and is able to oscillate about the rotation central shaft 75*e*. The rotation central shaft 75*e* is fastened to the circumferential wall portion 83 (refer to FIG. 9) constituting the housing section 81. The tension spring 75*d* is fastened to the other end of the connection frame 75*c*. This tension spring 75*d* is provided between the connection frame 75*c* and the platform 82. In the transmission mechanism 75, the oscillating central gear 75*a* meshes with the output gear 76, and the rotation driving force input to the oscillating central gear 75*a* is transmitted to the input gear 74 through the transmission gear 75*b*.

The output gear 76 meshes with the oscillating central gear 75*a*. This output gear 76 is fastened to the output shaft 77*a* of the motor 77. This motor 77 is fastened on the platform 82, and is appropriately controlled under the control of the controller 38 (refer to FIG. 10) provided in the image-forming apparatus 100.

Next, the attaching and removing operation of the toner container 32Y in the toner container housing 31 will be described. At first, the toner container housing 31 is exposed by opening the main body cover 110*a* provided in the front face of the image-forming apparatus body 100 (refer to FIG. 1) when mounting the toner container 32Y on the toner container housing 31.

After that, the toner container 32Y is inserted into the mounting opening 85 of the toner container housing 31 from the held portion 43Y side to be pushed to the loading preparation position Sp (refer to FIG. 8) in the housing section 81. As illustrated in FIG. 8, the loading preparation position Sp is a position where the held portion 34Y side end portion (refer to FIG. 5) of the outer circumferential face 33*a* of the container main body 33Y of the toner container 32Y faces the circumferential wall face 71*a* (refer to FIG. 12) of the rotation driver 71 of the loading drive mechanism 70 as seen in the direction orthogonal to the central axis line CA. Because of this, upon the placement of the toner container 32Y in the loading preparation position Sp, the circumferential wall face 71*a* of the rotation driver 71 is pressed against the outer circumferential face 33*a* of the container main body 33Y because the rotation driver 71 is provided in the platform 82 (housing section 81) through the coil spring 72. Then, the rotation driver 71 is rotated by the driving of the motor 77 in the toner container housing 31 (housing section 81). The rotation direction of the rotation driver 71 includes a direction in which the container main body 33Y moves on the holder 84 side in the housing section 81 as seen in the contact position between the circumferential wall face 71*a* and the outer circumferential face 33*a* of the container main body 33Y (refer to arrow A1 in FIG. 11). The rotation of the rotation driver 71 in the loading drive mechanism 70 may be performed according to the signal from a not shown positional sensor provided in the housing section 81 or performed based on the operation in the operation section provided in the housing 110.

Figure 11:
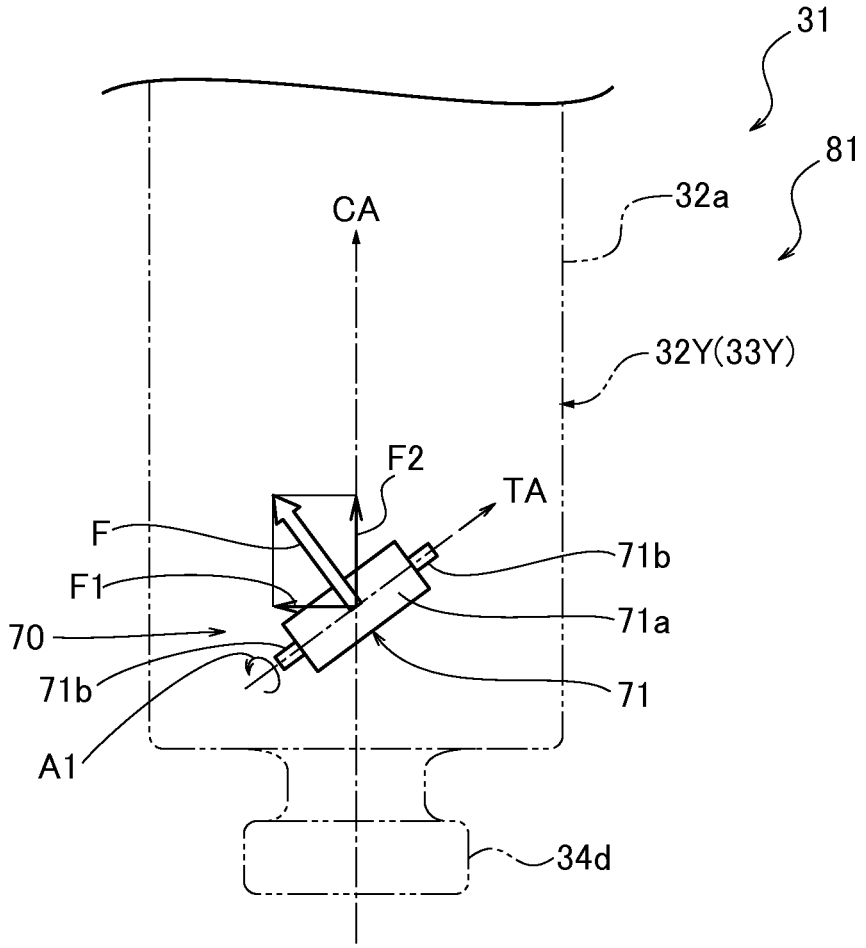
FIG. 11 is a view describing a positional relationship between a rotation driver 71 of a drive mechanism for loading 70 and the toner container 32Y (container main body 33Y).

With this configuration, the energizing force F due to the rotation of the rotation driver 71 is applied as illustrated in FIG. 11 because the circumferential wall face 71*a* of the rotation driver 70 has contact with the outer circumferential face 33*a* in the container main body 33Y of the toner container 32Y pushed in the housing section 81. This energizing force F applies to the outer circumferential face 33*a* of the container main body 33Y an energizing force F (rotation energizing force F1) in the direction orthogonal to the central axis line CA and an energizing force (straight energizing force F) in the central axis line CA direction on the holder 84 side. Accordingly, in the loading drive mechanism 70 of Embodiment 1, the driver holding case 73 operates as a driver holder which rotatably holds the rotation driver 71 to incline the rotation axis line TA relative to the central axis line CA and as an energizing force changer which changes a part of the rotation energizing force F of the rotation driver 71 into the straight energizing force F2 in the central axis line CA. Herein, in the housing section 81, the toner container 32Y is able to be moved in the central axis line direction CA while the rotation of the held portion 34Y of the toner container 32Y is prevented. The container main body 33Y is rotatable relative to the held portion 34Y in the toner container 32Y. For this reason, the container main body 33Y rotates about the central axis line CA due to the rotation energizing force F1 (refer to arrow A2 in FIG. 10) while the toner container 32Y moves on the holder 84 side in the central axis line CA direction due to the straight energizing force F2.

Thereafter, the held portion 34Y of the toner container 32Y reaches the holder 84 (refer to FIG. 10) by the movement of the toner container 32Y in the central axis line CA direction during the rotation of the container main body 33Y about the central axis line CA. Then, the nozzle 68 is inserted into the through hole of the holder main portion 34*c*1 (refer to FIG. 7), as illustrated in FIG. 10, the toner outlet B opens due to the pressure of the stopper 34*d* by the nozzle 68, and the nozzle supply port 68*a* is connected with the toner outlet B of the held portion 34Y of the toner container 32Y in the holder 84. The condition in which the nozzle 68 is connected with the held portion 34Y is a condition in which the toner container 32Y is appropriately loaded (set) in the toner container housing 31 and also is the loading position Lp in the housing section 81. A not shown driving gear provided in the holder 84 meshes with the gear 33*c*1 of the gear member 33*c* of the toner container 32Y, and the IC chip 35 as an electronic component faces the communication circuit 37 in a position which enables wireless communication. Then, the mounting operation of the toner container 32Y is completed.

The toner container 32Y is removed in the toner container housing 31 by the reverse operation to mounting the toner container 32Y. Namely, the rotation driver 71 rotates in the direction opposite to mounting under the driving control of the motor 77. Then, the container main body 33Y rotates about the central axis line CA (in the direction opposite to the arrow A2 in FIG. 10) while the toner container 32Y (container main body 33Y and held portion 34Y) moves on the mounting opening 85 side (back side) in the central axis line CA in the housing 81. Thereafter, the held portion 34Y moves on the back side in the central axis line CA direction, and the position of the stopper 34*d* pressed by the nozzle 68 inserted into the through-hole of the holder main portion 34*c*1 moves back to close the toner outlet B, so that the nozzle supply port 68*a* of the nozzle 68 is disconnected with the toner outlet B of the held portion 34Y of the toner container 32Y. Then, the toner container 32Y moves on the mounting opening 85 side in the central axis line CA direction while rotating about the central axis line CA, and reaches the loading preparation position Sp (refer to FIG. 8). Thus, a user is able to easily remove the toner container 32Y by lifting the toner container 32Y having a part (back portion) of the container main body 33Y projected from the mounting opening 85 in the loading preparation position Sp.

As described above, in the image-forming apparatus 100, the toner container (32Y, 32M, 32C, 32K) placed in the loading preparation position Sp is moved in the loading position Lp by the loading drive mechanism 70. With this configuration, a user is able to easily place the toner container in an appropriate loading position Lp with a simple operation which places the toner container in the loading preparation position Sp. For this reason, the operation for pushing the toner container in the loading position Lp is not required, so the loading operation is able to be facilitated. This is specifically effective when a large toner container is used.

In the image-forming apparatus 100, the toner container (32Y, 32M, 32C, 32K) in the loading position Lp is moved in the loading preparation position Sp by the loading drive mechanism 70. In this way, a user is able to easily remove the toner container from toner container housing with a simple operation which lifts the toner container from the loading preparation position Sp. For this reason, the operation for pulling the toner container in the loading preparation position Sp is not required, so the removing operation is able to be facilitated. This is specifically effective when a large toner container is used.

In the image-forming apparatus 100, the toner container (33Y, 33M, 33C, 33K) rotates about the central axis line CA while moving the toner container (33Y, 33M, 33C, 33K) along the central axis line CA between the loading preparation position Sp and the loading position Lp. This will enable to solve the toner even if the toner is condensed in the toner container. For this reason, even if the operation which shakes the toner container before loading is not appropriately performed, this operation can be covered. Thus, the loading operation can be further facilitated. This is specifically effective when a large toner container is used.

In the image-forming apparatus, the spiral projection 33*b* is provided on the inner circumferential face of the container main body (33Y, 33M, 33C, 33K). With this configuration, the toner in the container main body is able to be moved on the opening A side (toner outlet B side) of the held portion (34Y, 34M, 34C, 34K) due to the rotation of the container main body about the central axis line CA along the movement on the holder 84 side (front side) along the central axis line CA. For this reason, the toner is moved near the opening A (toner outlet B) in the toner container set in the loading position Lp, and thus, it is possible to smoothly and appropriately start the supply of toner.

In the image-forming apparatus 100, the spiral projection 33*b* is provided in the inner circumferential face of the container main body (33Y, 33M, 33C, 33). With this configuration, the toner is able to be moved on the back end portion (bottom portion (grip 33*d*)) side of the held portion (33Y, 33M, 33C, 33K) in the container main body with the rotation of the container main body about the central axis line CA (the rotation in the direction opposite to the arrow A2 in FIG. 10) along the movement on the mounting opening 85 side (back side) along the central axis line CA. In this way, in the toner container which moves to the loading preparation position Sp, the toner near the opening A (toner outlet B) is able to be reduced or eliminated, so that it becomes possible to control or prevent the toner from adhering to the peripheral portion of the toner outlet B when the toner outlet B is closed by the stopper 34*d*. This makes it possible to simplify the handling of the toner container. This is specifically effective when a large toner container is used because it is difficult to carry a large toner container and to pay attention to the peripheral portion of the toner outlet B in a large toner container.

In the image-forming apparatus 100, upon the movement of the toner container (32Y, 32M, 32C, 32K) to the loading position Lp, the toner outlet B of the held portion (34Y, 34M, 34C, 34K) is connected with the nozzle 68 (nozzle supply port 68*a*) of the holder 84. With this configuration, a user can appropriately load the toner container with a simple operation which places the toner container in the loading preparation position Sp, and thus the loading operation can be further facilitated without performing a conventional operation which loads the toner container in an appropriate loading position. This is specifically effective when a large toner container is used. It also becomes unnecessary to provide a member for obtaining a response (sense of clicking or setting) which confirms an appropriate loaded state; thus, a further simplified and smaller configuration is able to be obtained.

In the image-forming apparatus 100, the toner container is able to be replaced by lifting old toner containers (32Y, 32M, 32C, 32K) from the loading preparation position Sp to place a new toner container (32Y, 32M, 32C, 32K) in the loading preparation position Sp. Accordingly, the operation which replaces a toner container is able to be facilitated. This is specifically effective when a large toner container is used.

In the image-forming apparatus 100, the movement direction of the toner container (32Y, 32M, 32C, 32K) in the housing section 81 is set to the central axis line CA in the toner container housing 31, and the rotation driver 71 is provided such that the rotation axis line TA inclines relative to the extending direction of the central axis line CA. This makes it possible to apply to the container main bodies (33Y, 33M, 33C, 33K) both of the rotation energizing force F1 in the direction orthogonal to the central axis line CA and the straight energizing force F2 in the central axis line CA direction due to the single rotation of the rotation driver 71. Because of this, the toner container is able to be moved in the central axis line CA direction while rotating the container main body about the central axis line CA by a simplified and small configuration.

In the image-forming apparatus 100, the movement direction of the toner containers (32Y, 32M, 32C, 32K) is set to the central axis line CA in the housing section 81, and the rotation driver 71 is provided such that the rotation axis line TA inclines relative to the extending direction of the central axis line CA. This makes it possible to switch the loading operation and the removing operation by reversing the rotation driving direction of the rotation driver 71.

In the image-forming apparatus 100, the energizing force F due to the rotation of the rotation driver 71 is appropriately transmitted to the container main body by the friction between the circumferential wall face 71*a* of the rotation driver 71 and the outer circumferential face 33*a* of the container main body (33Y, 33M, 33C, 33K). In this way, the toner container is able to be moved in the central axis line CA direction while rotating the container main body about the central axis line CA by a simplified and small configuration.

In the image-forming apparatus 100, the rotation driver 71 (circumferential wall face 71*a*) is energized to the container main body (33Y, 33M, 33C, 33K) by the coil spring 72 in the loading drive mechanism 70. With this configuration, the circumferential wall face 71*a* appropriately has contact with the outer circumferential face 33*a*, and the container main body is able to be appropriately operated, so that the toner container is able to be moved in the central axis line CA direction while rotating the container main body about the central axis line CA by a simplified and small configuration. This is because the surplus of the energizing force F is able to be absorbed by compressing with the coil spring 72 when the surplus of the energizing force F due to the rotation of the rotation driver 71 is obtained relative to the appropriate operation. For this reason, in Embodiment 1, the gear member 33*c* (gear 33*c*1) is provided in the toner container (33Y, 33M, 33C, 33K) and a not shown driving gear is provided in the toner container housing 31 (holder 84). However, a configuration (without gear member 33*c*) which rotates the toner container loaded by using the energizing force F due to the rotation of the rotation driver 71 is able to be used instead of the gear member 33*c*. With this configuration, the configuration of the toner container and toner container housing 31 (image-forming apparatus 100) can be further simplified.

In the image-forming apparatus 100, the gear member 33*c* (gear 33*c*1) is provided in the toner container (32Y, 32M, 32C, 32K) and a not shown driving gear is provided in the toner container housing 31 (holder 84). This makes it possible to separate the rotation driver 71 (circumferential wall face 71*a*) from the container main body (outer circumferential face 33*a*) upon the movement of the toner container to the loading position Lp, so that the container main body (33Y, 33M, 33C, 33K) is able to smoothly rotate. In this case, for example, a configuration (using a fitting switch 93 (refer to FIG. 21) in Embodiment 3) which is able to freely move the driver holding case 73 or the coil spring 72 in the direction orthogonal to the central axis line CA, so as to separate the rotation driver 71 (circumferential wall face 71*a*) from the container main body (outer circumferential face 33*a*).

In the image-forming apparatus 100, the rotation driver 71 is provided in the lower side of the housing section 81, namely, below the toner container (32Y, 32M, 32C, 32K) placed on the holding projections 86 of the platform 82. In this way, the appropriate contact between the outer circumferential face 33*a* of the container main body (33Y, 33M, 33C, 33K) and the circumferential wall face 71*a* of the rotation driver 71 is able to be assisted by the own weight of the toner container, so that the energizing force F due to the rotation of the rotation driver 71 is able to be appropriately transmitted to the container main body while smoothly rotating and moving the container main body about and in the central axis line CA direction. This is because the pressure which presses the rotation driver 71 against the container main body such that the rotation driver 71 (circumferential wall face 71*a*) has appropriate contact with the container main body (outer circumferential face 33*a*) acts to increase the friction to the configuration (three holding projections 86 in Embodiment 1) which slidably holds the container main body of the toner container 32Y in the housing section 81 when the rotation driver 71 is provided in the upper side of the housing section 81, for example.

In the image-forming apparatus 100, the position in which the end portion of the outer circumferential face 33*a* on the held portion (34Y, 34M, 34C, 34K) side in the container main body (33Y, 33M, 33C, 33K) of the toner container (32Y, 32M, 32C, 32K) faces the circumferential wall face 71*a* of the rotation driver 71 of the loading drive mechanism 70 as seen in the direction orthogonal to the central axis line CA is set as the loading preparation position Sp. This makes it possible to facilitate the loading operation because the toner container is able to be inserted in the housing section 81 from the mounting opening 85 of the toner container housing 31 by placing the toner container in the loading preparation position without adjusting the insertion amount.

In the image-forming apparatus 100, the transmission mechanism 75 is provided in the loading drive mechanism 70, so that the rotation driver 71 is able to effectively rotate while the rotation driver 71 has appropriate contact with the container main body (33Y, 33M, 33C, 33K) (outer circumferential face 33*a*). This is because a change in the positional relationship between the rotation driver 71 (input gear 74) and the motor 77 (output gear 76) due to the fastening of the motor 77 to the platform 82 (housing section 81) whereas the rotation driver 71 (input gear 74) is provided in the platform 82 (housing section 81) through the coil spring 72 is able to be absorbed by the transmission mechanism 75.

In the image-forming apparatus 100, the operation which replaces a toner container can be facilitated to improve an operation performance.

In Embodiment 1, a toner is only contained in the container main body of the toner container 32Y, 32M, 32C, 32K, but a two-component toner made of a toner and a carrier is able to be contained in the toner main body of the toner container 32Y, 32M, 32C, 32K in an image-forming apparatus which appropriately supplies the two-component developer to a development device. In this case, there is a possibility to obtain an effect similar to that in Embodiment 1.

Figure 13:
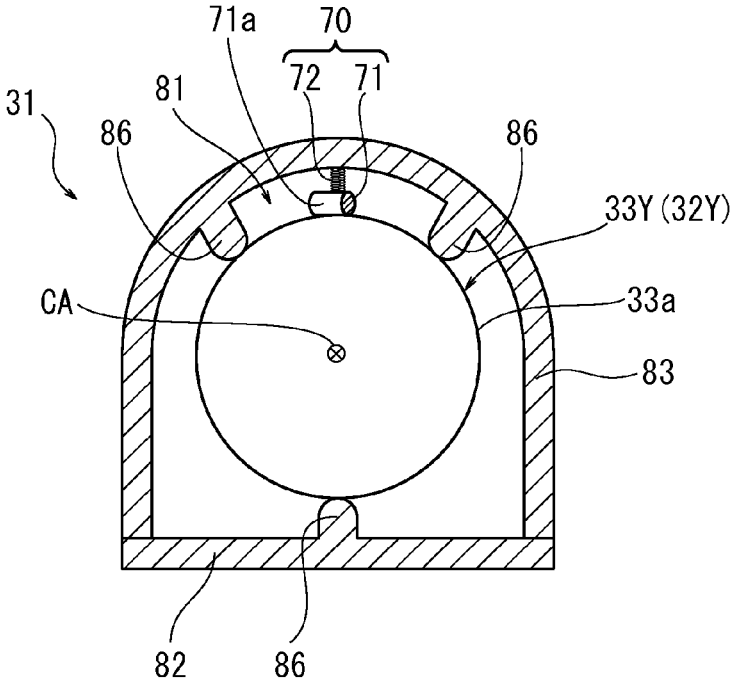
FIG. 13 is a view illustrating the housing section 81 having a configuration different from that in FIG. 9.

In Embodiment 1, the rotation driver 71 is provided in the lower side of the housing section 81, namely, below the toner container (32Y, 32M, 32C, 32K) placed on the holding projections 86 of the platform 82. However, the configuration is not limited to Embodiment 1. The rotation driver 71 is able to be provided on the upper side of the housing section 81 (over the toner container) as illustrated in FIG. 13 as long as the energizing force F due to the rotation of the rotation driver 71 is able to be transmitted to the container main body so as to move the toner container in the central axis line CA direction while rotating the container main body (33Y, 33M, 33C, 33K).

In Embodiment 1, the container main body 33Y of the toner container 32Y is slidably held by the three holding projections 86 in the housing section 81. However, the configuration is not limited to Embodiment 1. The two projections are able to be provided in the circumferential wall portion 83 and one projection is able to be provided in the platform 82 as illustrated in FIG. 13. The toner container is able to be held by a not shown curved surface.

In Embodiment 1, the suction-type screw pump 60 for sending air from the inside of the tube 69 is used in the toner supplier 59. However, the configuration is not limited to Embodiment 1. A discharge-type screw pump for sending air to the inside of the tube 69 may be used, and a diaphragm air pump may be used as a pump connected to the tube 69.

In Embodiment 1, the rotation driver 71 is fastened to the platform 82 through the driver holding case 73 and the coil spring 72. However the direction of the rotation axis line TA is able to be changed as described in the after-described Embodiment 2. In this case, for example, the rotation posture of the entire loading drive mechanism 70 is changeable to the platform 82 (position changer 78 in Embodiment 2 (refer to FIG. 14)).

Embodiment 2

Figure 14:
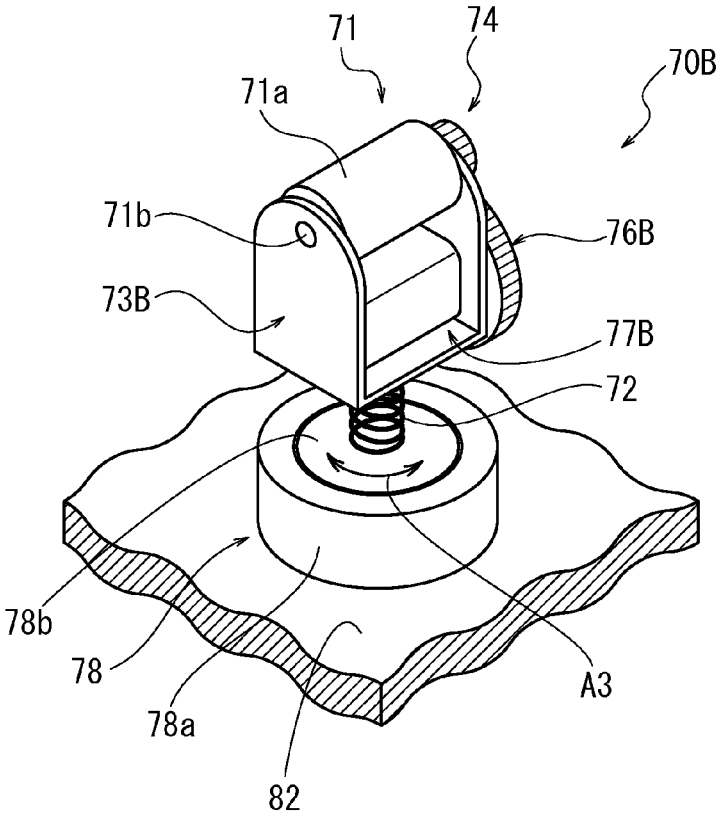
FIG. 14 is a view illustrating a configuration of a drive mechanism for loading 70B in an imaging-forming apparatus 100B according to Embodiment 2.
Figure 15:
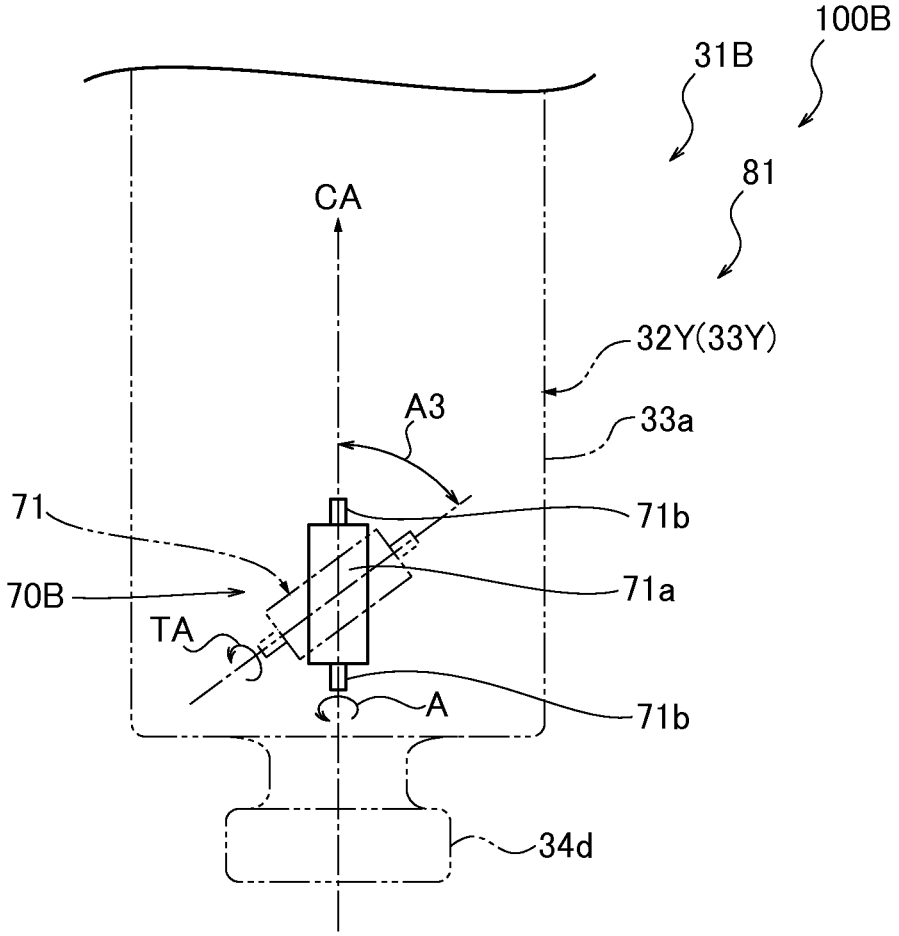
FIG. 15 is a view similar to FIG. 11 illustrating a positional relationship between a rotation driver 71 of the drive mechanism for loading 70B and the toner container 32Y (container main body 33Y).

Next, an imaging-forming apparatus 100B according to Embodiment 2 of the present invention will be described. Embodiment 2 is different from Embodiment 1 in the configuration and the operation of a toner container housing 31B and a loading drive mechanism 70B. The image-forming apparatus 100B of Embodiment 2 is similar to the image-forming apparatus 100 of Embodiment 1 in the basic configuration; thus, the same reference numbers are applied to the same configuration and the detailed description thereof will be omitted. FIG. 14 is a view illustrating the configuration of the loading drive mechanism 70B in the image-forming apparatus 100B according to Embodiment 2. FIG. 15 is a view similar to FIG. 11 illustrating the positional relationship between the rotation driver 71 of the loading drive mechanism 70B and the toner container 32Y (container main body 33Y).

In the image-forming apparatus 100B according to Embodiment 2, the container body (33Y, 33M, 33C, 33K) of the appropriately loaded toner container (32Y, 32M, 32C, 32K) more smoothly rotates about the central axis line CA by the loading driving mechanism 70B while being maintained in the loading position Lp, namely, without moving the toner container in the central axis line CA direction in the loading position Lp. In Embodiment 2, the gear member 33*c* (gear 33*c*1) is not provided in the toner container (32Y, 32M, 32C, 32K). The four housing sections 81 and loading drive mechanisms 70 corresponding to the respective colors (yellow, magenta, cyan and black) are provided in the toner container housing 31B, but these have the same configuration; thus, the yellow configuration will be only described below, and the other configurations will be omitted.

The loading drive mechanism 70B includes a rotation driver 71, coil spring 72, driver holding case 73B, input gear 74, output gear 76B, motor 77B and position changer 78 as illustrated in FIG. 14.

The driver holding case 73B rotatably supports both ends of the rotation shaft 71*b* extended from both ends of the rotation driver 71 while the lower portion thereof supports the motor 77B. The driver holding case 73B allows the output shaft of the motor 77B to extend outside.

The coil spring 72 is provided between the driving holding case 73B and the position changer 78 (rotation position 78*b*). The position changer 78 is provided on the platform 82, and includes a main body portion 78*a* fastened on the platform 82 and a rotation portion 78*b* which is rotatable to the main body portion 78*a*. This position changer 78 appropriately drives under the control of the controller 38 (refer to FIG. 10) provided in the image-forming apparatus 100B, namely, the rotation position of the rotation portion 78*b* to the main body portion 78*a* (platform 82) is appropriately controlled. Because of this, the driver holding case 73B, namely, the rotation driver 71 supported thereto rotates about the axis line orthogonal to the platform 82 relative to the platform 82 (housing section 81) under the control of a not shown controller. More specifically, the position of the rotation driver 71 is changed.

The input gear 74 is fastened to one rotation shaft 71*b* of the rotation driver 71. The input gear 74 meshes with the output gear 76B in the outside of the driver holder 73B. The output gear 76B is fastened to a not shown output shaft of the motor 77B. The motor 77B appropriately drives under the control of the controller 38 (refer to FIG. 10) provided in the image-forming apparatus 100B.

In the image-forming apparatus 100B, it is possible to perform the mounting and removing operation of the toner container 32Y similar to the toner container housing 31 because the basic configuration of the toner container housing 31B is similar to that in Embodiment 1. Additionally, in the toner container housing 31B, the position of the rotation driver 71 is changed (refer to arrow A3) by driving the position changer 78 after the toner container 32Y is loaded in the loading position Lp. In the toner container housing 31B, the position of the rotation driver 71 is set such that the rotation axis line TA inclines to the central axis line CA direction of the movement direction of the toner container 32Y in the housing section 81 as illustrated by the two-dot chain line in FIG. 15 when performing the mounting and removing operation of the toner container 32Y. In the toner container housing 31B, the position of the rotation driver 71 is changed from the position illustrated by the two-dot chain line to the position in which the rotation axis line TA conforms to the central axis line CA direction (refer to the rotation driver 71 by a solid line) by driving the position changer 78 upon the movement of the toner container 32Y to the loading position Lp. This makes it possible to more smoothly rotate the container main body 33Y in the toner container housing 31B about the central axis line CA without moving the toner container 32Y in the central axis line CA direction in the loading position Lp.

In the image-forming apparatus 100B of Embodiment 2, the effect similar to that in Embodiment 1 is able to be obtained because the basic configuration of the image-forming apparatus 100B is the same as that of the image-forming apparatus 100.

Additionally, in the image-forming apparatus 100B of Embodiment 2, the driving force loss is able to be reduced while the container main body is able to more smoothly rotate because it is not necessary to act the energizing force F due to the rotation of the rotation driver 71 as the energizing force in the central axis line CA direction with respect to the container main body (33Y, 33M, 33C, 33K) in the loading position Lp (loaded condition).

Moreover, in the image-forming apparatus 100B of Embodiment 2, the loaded toner container (32Y, 32M, 32C, 32K) rotates by using the energizing force F due to the rotation of the rotation driver 71. With this configuration, the configuration of the toner container and toner container housing 31B (image-forming apparatus 100B) is able to be simplified because a gear and driving gear for rotating the toner container in a usage state is not required.

Furthermore, in the image-forming apparatus 100B of Embodiment 2, the position of the rotation driver 71 is able to be changed by the position changer 78. With this configuration, the rotation axis line TA slightly inclines to the central axis line CA in a state in which the toner container (32Y, 32M, 32C, 32K) is loaded in the loading position Lp. Therefore, the toner container 32Y can be prevented from moving on the mounting opening 85 side in the central axis line CA direction when rotating the toner container (33Y, 33M, 33C, 33K) about the central axis line CA. In this way, it is not necessary to use a fastening mechanism (locking mechanism) so as to maintain the toner container in the appropriately loaded condition in the housing section 81.

In the image-forming apparatus 100B, the toner container is able to be easily replaced, so that the operation performance is able to be improved.

Embodiment 3

Figure 16:
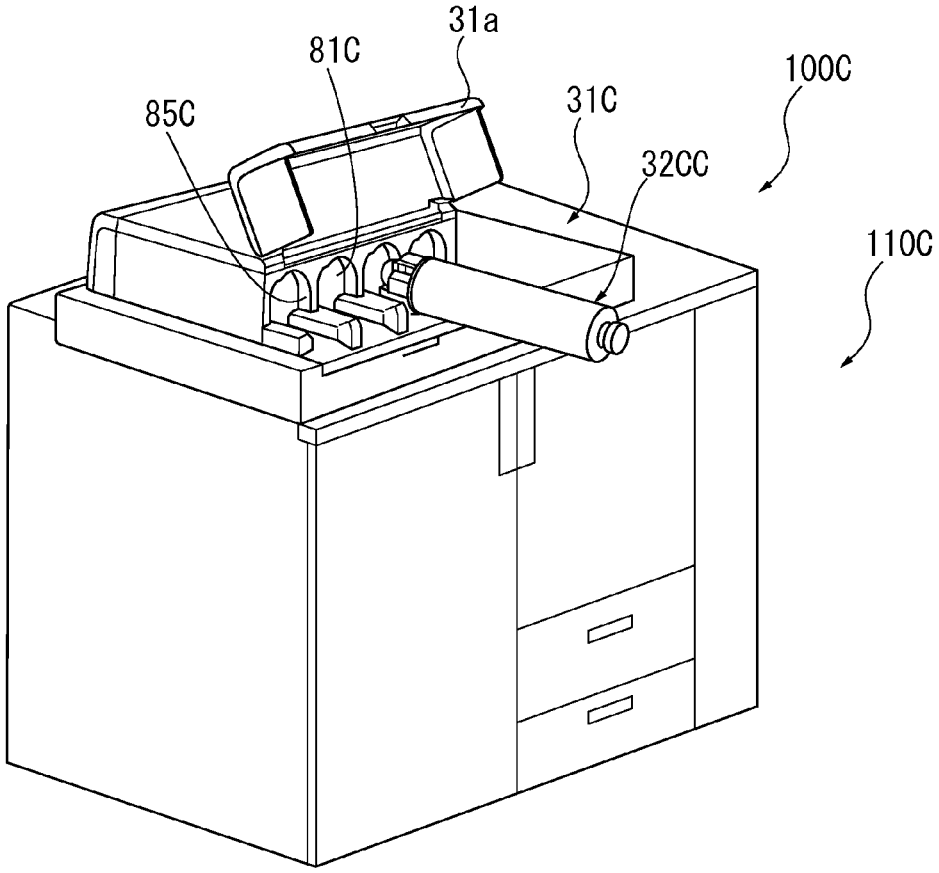
FIG. 16 is a view illustrating an external appearance of an image-forming apparatus 100C according to Embodiment 3.
Figure 17:
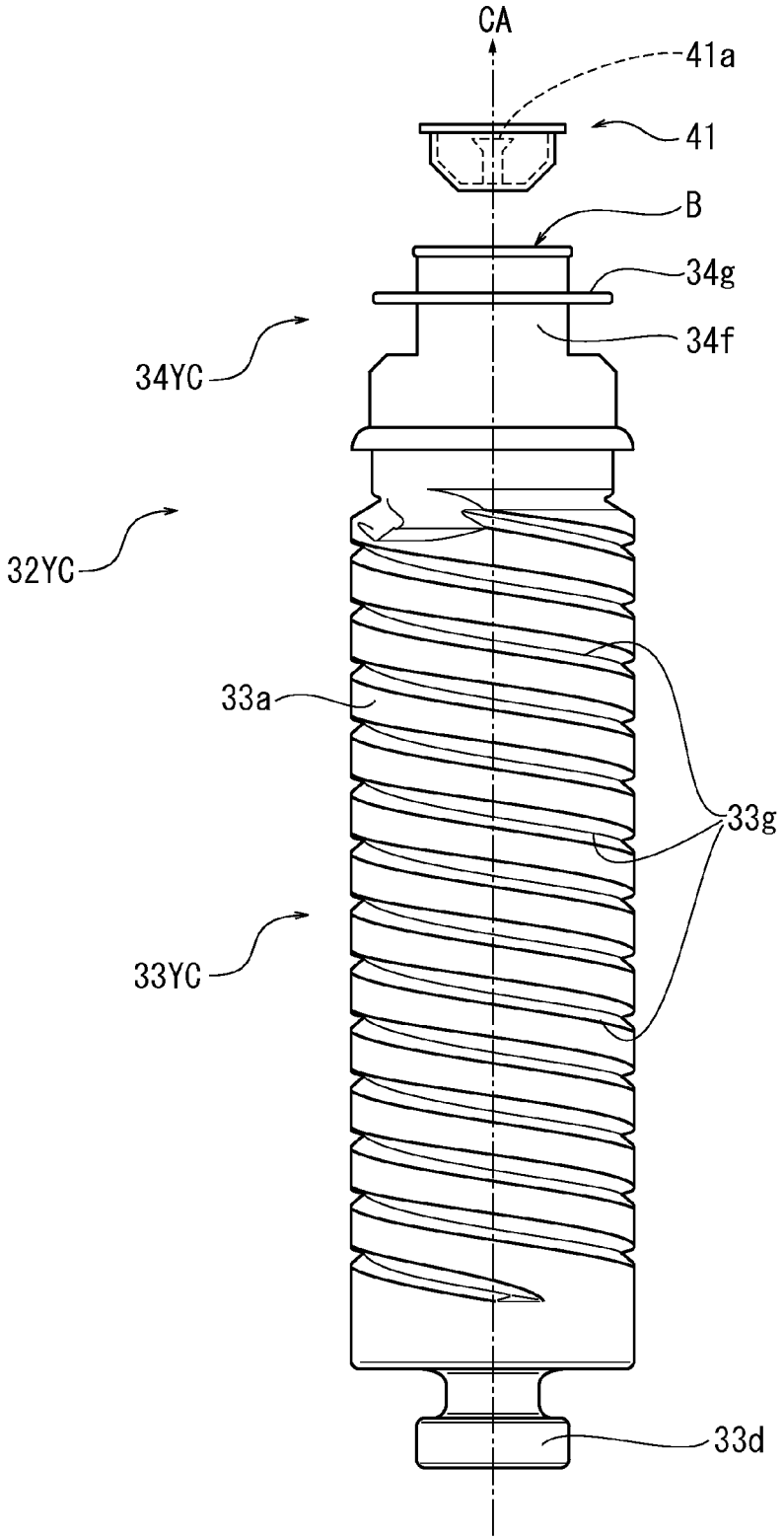
FIG. 17 is a view illustrating a configuration of a toner container 32YC.
Figure 18:
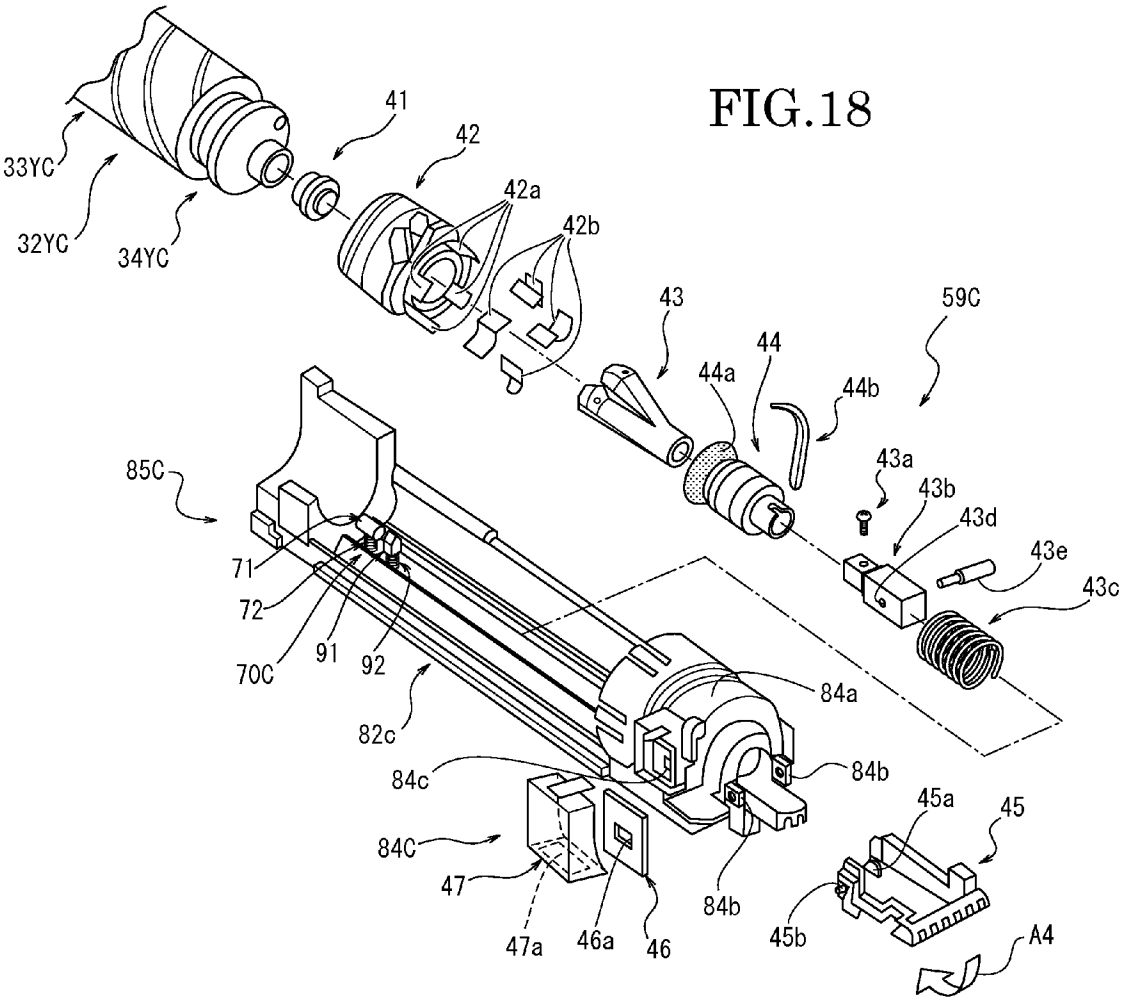
FIG. 18 is a view illustrating a disassembled toner supplier 59C.
Figure 19:
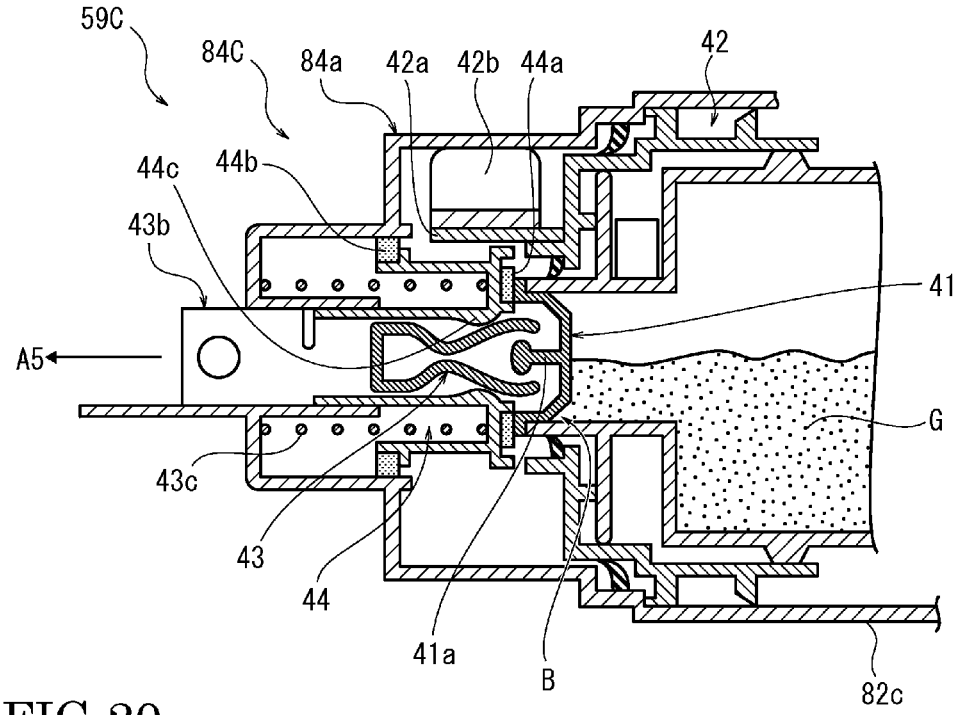
FIG. 19 is a view illustrating the configuration of the toner supplier 59C.
Figure 20:
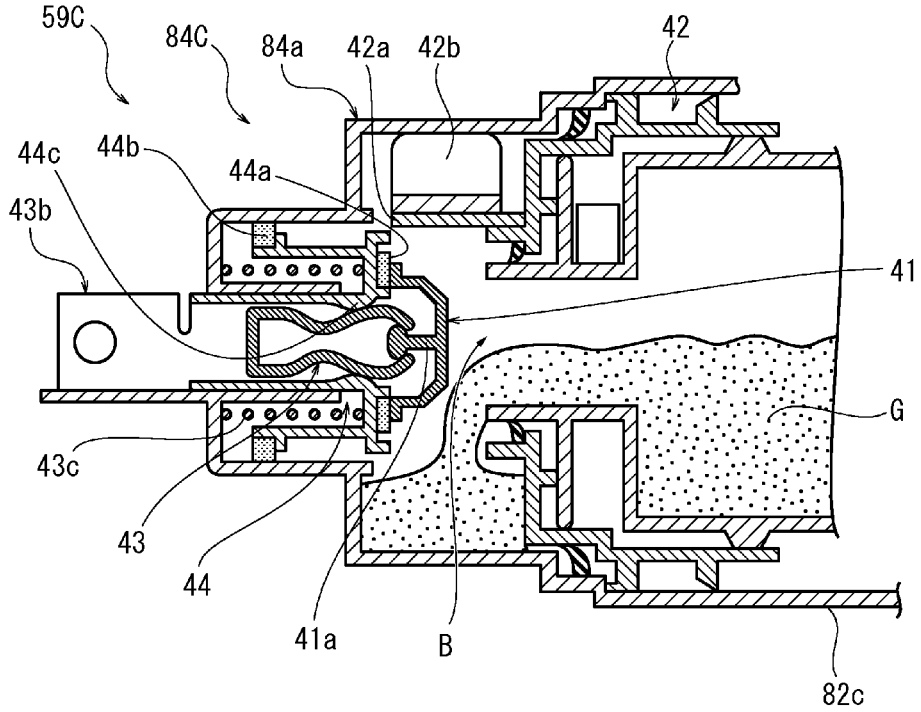
FIG. 20 is a view similar to FIG. 19 illustrating a condition in which a toner (yellow) is discharged from a toner outlet B in a case 84*a*.
Figure 21:
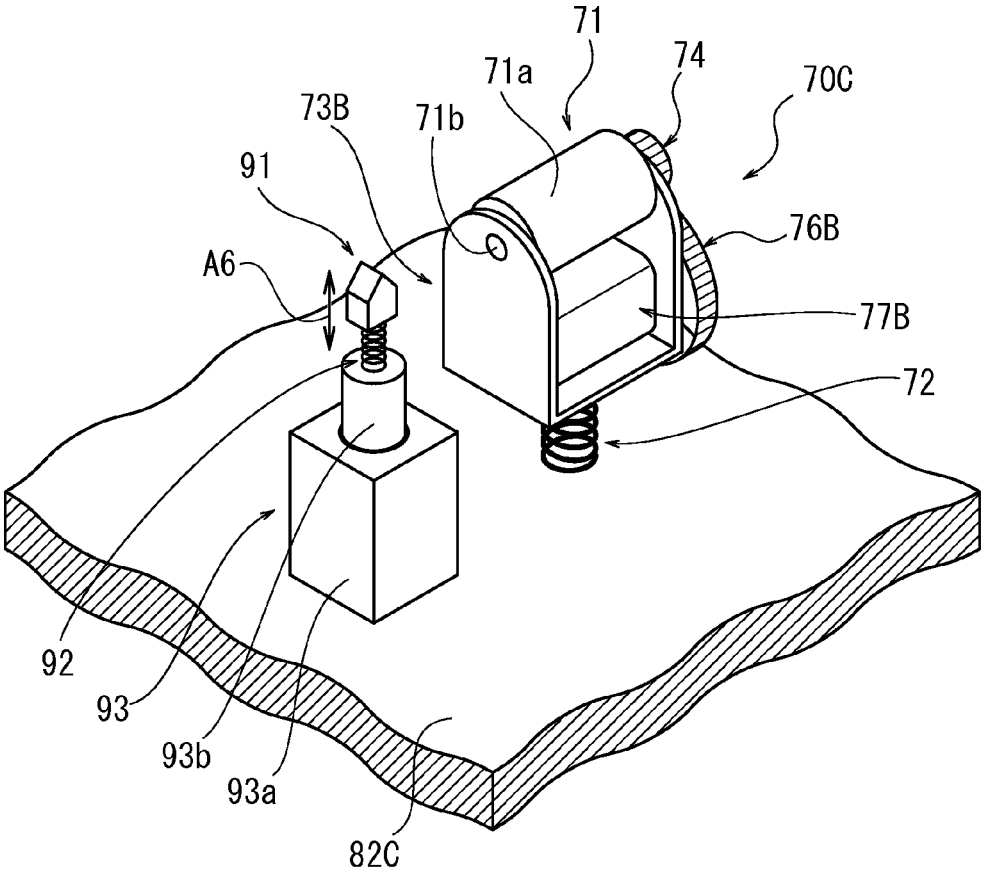
FIG. 21 is a view illustrating a configuration of a drive mechanism for loading 70C in the image-forming apparatus 100C according to Embodiment 3.
Figure 22:
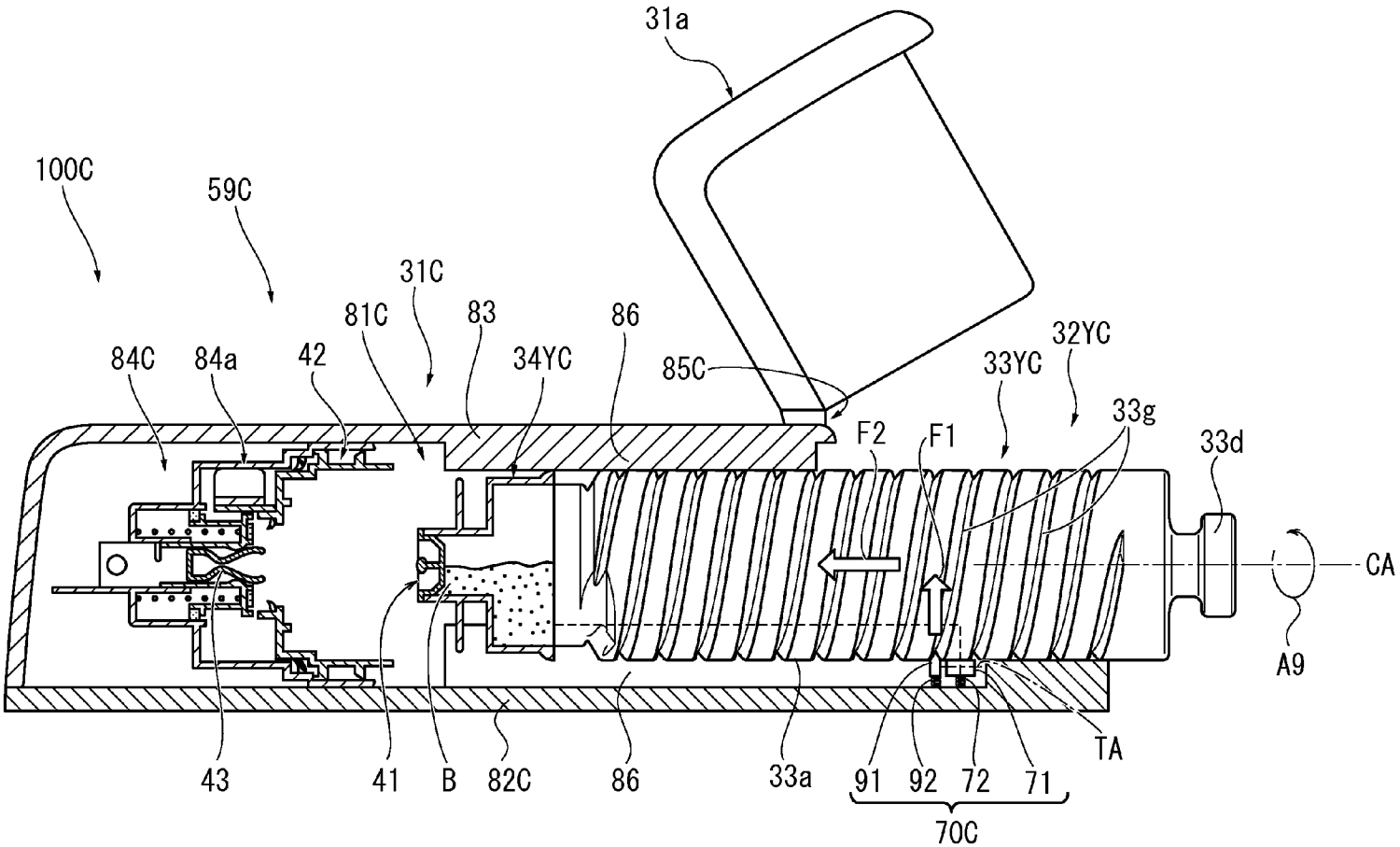
FIG. 22 is a view illustrating a positional relationship between a rotation driver 71 of the drive mechanism for loading 70C in a toner container housing 31C and a toner container 32YC (container main body 32YC).
Figure 23A:
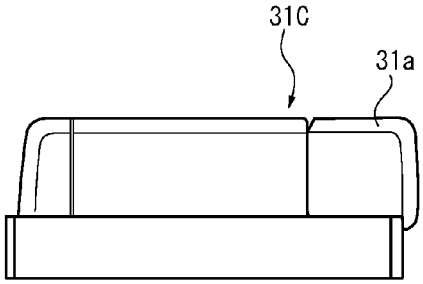
FIGS. 23A-23D are views each illustrating the toner container 32YC being loaded in the toner container housing 31C.
Figure 23B:
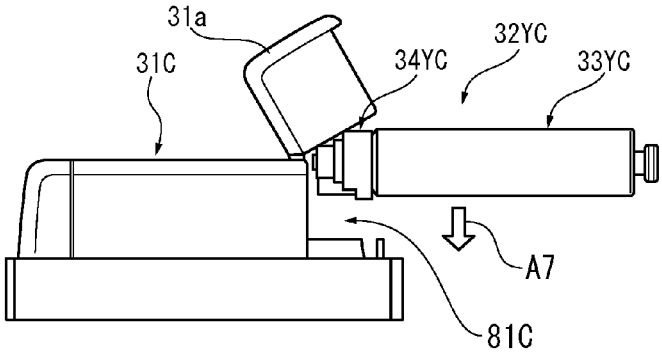
Figure 23C:
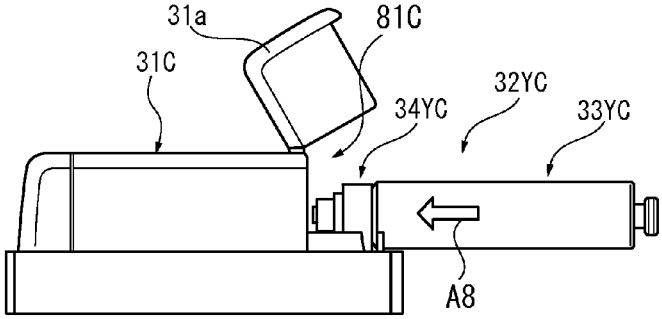
Figure 23D:
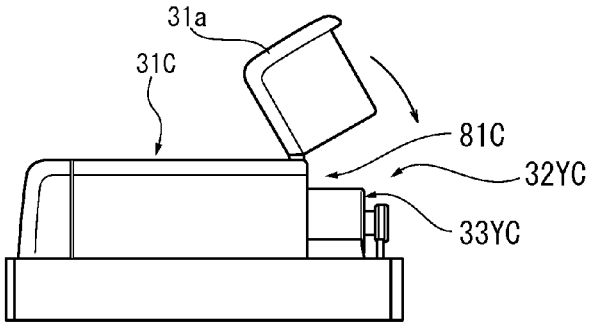

Next, an image-forming apparatus 100C according to Embodiment 3 will be described. Embodiment 3 is different from Embodiment 1 in the configuration and operation of the loading drive mechanism 70. The basic configuration of the image-forming apparatus 100C is similar to that of the image-forming apparatus 100 of Embodiment 1, but they are different in the external appearance configuration, positional relationship and mechanism for opening the toner container housing 31B. In the image-forming apparatus 100C, the configuration of the toner container (32YC, 32MC, 32CC, 32KC) is different from that in Embodiment 1, and the configuration of the toner supplier 59C is also different from that in Embodiment 1 according to the configuration of the toner container. The basic configuration of the image-forming apparatus 100C of Embodiment 3 is similar to that of the image-forming apparatus of Embodiment 1; thus, the same reference numbers are applied to the same configurations, and the detailed description thereof will be omitted. FIG. 16 is a view illustrating the external appearance of the image-forming apparatus 100C according to Embodiment 3. FIG. 17 is a view illustrating the configuration of the toner container 32YC. FIG. 18 is a view illustrating the disassembled toner supplier 59C. FIG. 19 is a view illustrating the configuration of the toner supplier 59C. FIG. 20 is a view illustrating a condition in which a toner (yellow) is discharged from a toner outlet B in a case 84*a*. FIG. 21 is a view illustrating the configuration of the loading drive mechanism 70C in the image-forming apparatus 100C according to Embodiment 3. FIG. 22 is a view illustrating the positional relationship between the rotation driver 71 of the loading drive mechanism 70C in the toner container housing 31C and the toner container 32YC (container main body 32YC). FIGS. 23A-23D are views each illustrating the toner container 32YC being loaded in the toner container housing 31C; FIG. 23A illustrates a closed housing cover 31*a*; FIG. 23B illustrates an opened housing cover 31*a*; FIG. 23C illustrates the placed toner container 32Y; FIG. 23D illustrates the toner container 32YC being pushed toward the loading preparation position Sp. In addition, in FIGS. 18, 22, the rotation driver 71, coil spring 72, guide projection 91 and spring for a projection 92 are only described as the loading drive mechanism 70 for simplifying the description.

In the image-forming apparatus 100C according to Embodiment 3, the toner container housing 31C is provided on the top of the image-forming apparatus main body as illustrated in FIG. 16. The mounting and removing operation of the toner container (32YC, 32MC, 32CC, 32KC) is performed by opening and closing the toner container housing 31C. In the image-forming apparatus 100C, the platform 82C (housing section 81C) of the toner container housing 31C is able to be exposed by opening the housing cover 31*a* provided in the front portion of the toner container housing 31C (refer to FIG. 22).

Next, the configuration of the toner container (32YC, 32MC, 32CC, 32KC) loaded in the image-forming apparatus 100C according to Embodiment 3 will be described with reference to FIG. 17. Hereinbelow, the yellow toner container 32YC will be described.

The toner container 32YC has a cylindrical shape and includes the integrally formed container main body 33Y and held portion 34YC. The held portion 34YC includes an opening 34*f* having on the leading end side thereof a small diameter. The toner outlet B is formed in the leading end of the held portion 34YC and a flange 34*g* is also formed in the held portion 34Y. The flange 34*g* is formed to wind the opening 34*f*. The toner outlet B is sealed by a stopper 41. The stopper 41*a* includes in the center thereof a knob 41*a*.

A spiral guide groove 33*g* is formed on the outer circumferential face of the container main body 33YC. The guide groove 33*g* is formed to concave the outer circumferential wall portion in the container main body 33Y, so that it can be seen as a spiral projection (corresponding to projection 33*b*) as seen on the inner circumferential face side. This toner container 32YC is manufactured by blow-molding the container main body 33YC and held portion 34YC (opening 34*f*, flange 34*g*, toner discharge outlet B).

Next, the toner supplier 59 corresponding to the configuration of the toner container 32Y will be described. In this toner supplier 59C (toner container housing 31C), a container-holding member 42 is provided in the holder 84C. The container-holding member 42 holds the head portion of the toner container 32YC, and includes an integrally formed rib 42*a* as an agitator. The rib 42*a* includes a toner supply blade 42*b*. The toner supply blade 42*b* is attached to the rib 42*a* by a double-coated tape or the like. The toner supply blade 42*b* is a thin member made of an elastic member such as mylar or plastic. In Embodiment 3, four ribs 42*a* and toner supply blades 42*b* are provided. A not shown rib for driving provided in the inner circumferential face of the container-holding member 42 engages with a projection for transmitting driving provided in the head portion of the held portion 34YC of the toner container 32YC, so that the container-holding member 42 rotates together with the toner container 32YC in the normal rotation direction.

In the holder 84C, a cylindrical case 44 having inside thereof a collet chuck 43 is inserted into a cylindrical seal member 44. The collet chuck is divided into a plurality of legs on the leading end side (toner container side), and the knob 41*a* of the stopper 41 is able to be held by the legs (refer to FIG. 20). The cylindrical case 44 is a cylindrical member for guiding the opening and closing operation of the legs of the collet chuck 43. A seal member 44*b* is attached to the cylindrical case 44 to seal a space between the cylindrical case 44 and the case 84*a* provided in the holder 84C. The collet chuck 43 is fixed to a shaft member 43*b* by a screw 43*a*. The collet chuck 43, cylindrical case 44 and shaft member 43*b* are always energized on the toner container 32YC side by a coil spring 43*c*. These components are held in the case 84*a*.

The case 84*a* forms the outer appearance of the holder 84C as described above, and is formed integrally with the platform 82C of the toner supplier 59C. A handle 45 in which a shaft 45*b* is supported by a bearing 84*b* is rotatbly provided in the case 84*a*. This handle 45 is provided for opening and closing the stopper 41. The handle 45 rotates by a not shown driving mechanism appropriately driven under the control of the controller 38 (refer to FIG. 10) provided in the image-forming apparatus 100C. This driving mechanism is constituted by using a solenoid, for example.

The shaft member 43*b* includes a hole 43*d*. A slide shaft 43*e* is inserted into the hole 43*d*. The slide shaft 43*e* engages with a cam portion 45*a* provided in the handle 45. Upon the rotation of the handle 45 about the shaft 45*b* (refer to arrow A4), the slide shaft 43*e* slides the shaft member 43*b* in the direction away from the toner container 32YC. The makes it possible to slide the collet chuck 43 fixed to the shaft member 43*b* in the direction away from the toner container 32YC due to the rotation of the handle 45 (arrow A5 direction (refer to FIG. 19)). The cylindrical case 44 includes a projection 44*c* (refer to FIG. 20) which is engageable with the collet chuck 43 (leg) by which the knob 41*a* of the stopper 41 is held, so that the cylindrical case 44 slides in the direction away from the toner container 32YC together with the collet chuck 43 by the rotation of the handle 45.

The case 84*a* includes an opening 84*c* connected with the toner outlet B of the toner container 32YC supported on the platform 82C as illustrated in FIG. 18. An elastic member 46 is attached to the opening 84*c* by a double-coated tape or the like. The elastic member 46 is made of an elastic material such as mylar or rubber, and includes a slit 46*a* as an elongated square hole extending in the direction (horizontal direction) orthogonal to the movement direction of the toner supply blade 42*b*.

The case 84*a* includes a cover 47 of the slit 46*a*. This cover 47 includes in the lower side thereof an opening 47*a*, and guides the toner discharged from the slit 46*a* from the opening 47*a* to the toner carrying pipe 67Y (refer to FIG. 3).

In the toner supplier 59C, once the toner container 32YC is loaded in the loading position Lp, the held portion 34YC (head portion of toner container 32YC) engages with the container holding member 42 in the holder 84C (refer to FIG. 19). In this state, upon the rotation of the handle 45 in the arrow A4 direction (lower direction (refer to FIG. 18)) by a not shown driving mechanism, the shaft member 43*b* is pulled in the arrow A5 direction (refer to FIG. 19) through the slide shaft 43*e* engaged with the cam portion 45. The collet chuck 34 thereby moves in the arrow A5 direction in the cylindrical case 44, and the legs hit the projection 44*c* so as to hold the knob 41 of the stopper 41 by the closed legs (refer to FIG. 20). In this state, the collet chuck 43 moves in the arrow A5 direction, and the legs holding the knob 41*a* have contact with the projection 44*c*, so that the collet chuck 43 and the cylinder case 44 integrally move in the arrow A5 direction, and the stopper 41 is removed from the toner outlet B of the held portion 34YC of the toner container 32YC (refer to FIG. 20). In this way, the toner outlet B of the toner container 32YC is connected with the case 84*a* (inner space) in the holder 84C. In this state, upon the rotation of the toner container 32YC, the toner (yellow) is discharged from the toner outlet B by the guiding operation of the spiral projection 33*b* formed by the guide groove 33*g*, and accumulated in the case 84*a*. Herein, the toner supply blades 42*b* attached to the rib 42*a* of the container holding member 42 slide the inner wall face of the case 84*a* because the container holding member 42 rotates in the normal rotation direction integrally with the toner container 32YC. Then, the toner supply blades 42*b* scrape the toner accumulated in the case 84*a*, so that a part of the toner is pushed out from the slit 46*a* (refer to FIG. 18) of the elastic member 46. The pushed toner falls in the cover 47, and is supplied in the development device (5Y) from the above described toner carrying pipe 67Y through the opening 47*a* (refer to FIG. 18) of the lower side of the cover 47 (refer to FIG. 3).

The shaft member 43*b* is pushed in the direction opposite to the arrow A5 (refer to FIG. 19) through the slide shaft 43*e* engaged with the cam portion 45*a* when the handle 45 rotates in the direction (upper direction) opposite to the arrow A4 (refer to FIG. 18) by a not shown driving mechanism. Then, the collet chuck 43 is pushed, and the stopper 41 is fitted to the toner outlet B of the held portion 34Y of the toner container 32YC while releasing the held knob 41*a*. This makes it possible to attach the stopper 41 to the toner outlet B of the toner container 32Y to seal the toner outlet B by the stopper 41.

Next, the loading drive mechanism 70 in the toner supplier 59 of the image-forming apparatus 100C according to Embodiment 3 will be described. The loading drive mechanism 70C enables the toner container 32YC to move in the central axis line CA direction by using the guide groove 33*g* (refer to FIG. 17) provided in the toner container 32YC (change the movement into the straight energizing force F2). The loading drive mechanism 70C includes the rotation driver 71, coil spring 72, driver holding case 73B, input gear 74, output gear 76B, motor 77B, guide projection 91, spring 92 for a projection and fitting switch 93.

In the loading drive mechanism 70, the coil spring 72 is directly provided on the platform 82C for rotatably supporting the rotation driver 71. This is the same as that in Embodiment 2 except that the coil spring 72 is provided between the driver holding case 73B and the platform 82C. For this reason, the position changer 78 (refer to FIG. 14) is not provided in the loading drive mechanism 70C. The rotation driver 71 is provided parallel to the central axis line CA of the toner container 32YC (container main body 33YC) in which the rotation axis line TA is held in the housing section 81C as illustrated in FIG. 22.

The loading drive mechanism 70C includes the guide projection 91 arranged in parallel to the rotation driver 71 in the central axis line CA direction. This guide projection 91 is able to be fitted to the guide groove 33*g* (refer to FIG. 17) provided in the container main body 33YC of the toner container 32YC, and is slidable in the fitted state (refer to FIG. 22). The guide projection 91 is mounted on the fitting switch 93 (lifting portion 93*b*) through the spring for a projection 92. This fitting switch 93 is provided on the platform 82C, and includes a main body portion 93*a* fixed on the platform 82C and the lifting portion 93*b* (refer to arrow A6) which is extendable and retractable from and to the main body portion 93*a*. This fitting switch 93 appropriately drives under the control of the controller 38 (refer to FIG. 10) provided in the image-forming apparatus 100C, namely, the extended and retracted conditions of the lifting portion 93*b* from and to the main body portion 93*a* (platform 82C) are appropriately controlled. The extending and retracting direction of the fitting switch 93 is set in the direction from the platform 82C toward the central axis line CA of the toner container 32YC (container main body 33YC) held in the housing section 81. With this configuration, the guide projection 91 is able to come close to the central axis line CA by separating from the platform 82C, and also come close to the platform 82 by separating from the central axis line CA under the control of the controller 38. Namely, the position of the guide groove 91 in that direction is changeable.

Next, the mounting and removing operation of the toner container 32YC in the toner container housing 31C will be described with reference to FIGS. 22, 23. At first, a housing cover 31*a* (refer to FIG. 23A) provided in the front portion of the toner container housing 31C is opened to expose the platform 82C (housing section 81C) of the toner container housing 31C (refer to FIGS. 16, 23B) when mounting the toner container 32YC on the toner container housing 31C.

Thereafter, the toner container 32YC (held portion 34YC) is placed on the exposed platform 82C (refer to arrow A7 in FIG. 23B). With the housing cover 31*a* being opened, a part of the platform 82C is completely exposed, so that the toner container 32YC (held portion 34YC) is easily set on the platform 82C.

After that, the toner container 32YC is inserted into the mounting opening 85C of the toner container housing 31C from the held portion 34YC side, and the toner container 32YC is pushed to the loading preparation portion Sp in the housing section 81 (refer to arrow A8 in FIG. 23C). Then, the circumferential wall face 71*a* of the rotation driver 71 is pushed to the outer circumferential face 33*a* of the container main body 33Y because the rotation driver 71 is provided on the platform 82 (housing section 81C) through the coil spring 72 in the housing section 81C. In this case, the fitting switch 93 is in the extended state (the guide projection 91 is extended on the central axis line CA side). For this reason, the guide projection 91 fits to the guide groove 33*g* provided in the container main body 33YC or pushed to the outer circumferential face 33*a* of the container main body 33YC because the guide projection 91 is provided in the platform 82C (housing section 81C) through the spring for a projection 92 and the fitting switch 93. Herein, the guide projection 91 is able to follow the outer circumferential face 33*a* when the guide projection 91 does not fit into the guide groove 33*g* because the guide projection 91 is supported through the spring for a projection 92. However, even in this condition, the guide projection 91 is able to be effectively fitted into the guide groove 33*g* due to the rotation of the container main body 33YC (toner container 32YC) as described below (refer to arrow A9 in FIG. 22) because the guide groove 91 includes a spiral shape (refer to FIG. 22).

Then, the rotation driver 71 of the loading drive mechanism 70 rotates by the rotation of the motor 77B (refer to FIG. 21) in the toner container housing 31C. The rotation direction of the rotation driver 71 is set in a direction (refer to arrow A9) rotating the container main body 33YC in the direction in which the guide groove 33*g* displaces on the held portion 34YC side as seen from the outer circumferential face 33*a* of the container main body 33YC about the central axis line CA. The rotation driver 71 in the loading drive mechanism 70C may rotate by a signal from a positional sensor provided in the housing section 81 or based on the operation with the operation portion provided in the housing 110.

With this configuration, the energizing force (refer to arrow A9) due to the rotation of the rotation driver 71 is applied to the container main body 33YC of the toner container 32YC pushed in the housing section 81C as illustrated in FIG. 22 because the circumferential wall face 71*a* of the rotation driver 71 has contact with the outer circumferential face 33*a*. This energizing force applies the rotation energizing force F1 operating in the direction orthogonal to the central axis line CA relative to the outer circumferential face 33*a* of the container main body 33YC. Then, the container main body 33YC moves on the holder 84C side in the central axis line CA direction by the guiding operation between the guide groove 33*g* and the guide projection 91 because the guide projection 91 fixed on the platform 82C (housing section 81C) is fitted to the guide groove 33*g* provided in the outer circumferential face 33*a*. That is, the guide groove 33*g* and the guide projection 91 change a part of the energizing force (refer to arrow A9) due to the rotation of the rotation driver 71 into a straight energizing force F2 operating in the direction toward the held portion 84C in the central axis line CA direction. For this reason, in the loading drive mechanism 70C of Embodiment 3, the guide groove 33*g* operates as a guide path, the guide projection 91 operates as a follow-up engagement portion and the guide projection 91 operates as a changer which changes a part of the rotation energizing force F of the rotation driver 71 into the straight energizing force F2 along the central axis line CA with the cooperation with the guide groove 33*g*.

After that, the container main body 33YC rotates about the central axis line CA while the toner container 32YC moves in the central axis line CA direction, so that the held portion 34YC of the toner container 32YC reaches the holder 84C, and the held portion 34YC (head portion of toner container 32YC) engages with the container-holding member 42 (refer to FIG. 19). The condition in which the held portion 34Y engages with the container-holding member 42 is a condition in which the toner container 32YC is appropriately set in the toner container housing and also the toner container 32YC is loaded in the loading position Lp in the housing section 81C. Then, in the holder 84C, as described above, the collet chuck 43 holds the knob 41*a* of the stopper 41 in response to the rotation of the handle 45 (refer to FIG. 18) to remove the stopper 41 from the toner outlet B of the held portion 34YC of the toner container 32YC (refer to FIG. 20). In this way, the toner outlet B of the toner container 32YC in the holder 84C is connected with the case 84*a* (inner space), and the toner (yellow) contained in the toner container 32YC is able to be supplied to the development device 5Y. The mounting operation of the toner container 32YC is thereby completed (refer to FIG. 23D). After the completion of the mounting operation, the guide projection 91 is retracted by the fitting switch 93, and is separated from the guide groove 33*g*.

In the toner container housing 31C, the rotation driver 71 of the loading drive mechanism 70 appropriately rotates in a usage state, so that the toner accumulated in the case 84*a* is supplied in the development device 5Y from the above-described toner-carrying pipe 67Y.

The toner container 32YC is removed in the toner container housing 31C by the reverse operation to mounting the toner container 32YC. Namely, the guide projection 91 is extended by the fitting switch 93, and is fitted into the guide groove 33*g*. After that, upon the rotation of the handle 45 (refer to FIG. 18), the stopper 41 is fitted into the toner outlet B of the held portion 34YC of the toner container 32YC. Thereafter, the rotation driver 71 rotates in the direction opposite to that in mounting by the driving of the motor 77B after the container cover 31*a* is opened. Then, the toner container 32YC (container main body 33YC) in the housing section 81C rotates about the central axis line CA while the toner container 32YC moves on the mounting opening 85 side (back side) in the central axis line CA direction. After that, the toner container 32YC (container main body 33YC) rotates about the central axis line CA while moving on the mounting opening 85 side (back side) to reach the loading preparation position Sp. Because of this, a user is able to remove the toner container 32YC by lifting the toner container 32YC in which a part of the container main body 33YC projects from the mounting opening 85 in the loading preparation position Sp.

The configuration of the image-forming apparatus 100C of Embodiment 3 is basically similar to that of the image-forming apparatus 100 of Embodiment 1, so the effects thereof are basically the same.

Additionally, in the image-forming apparatus 100C of Embodiment 3, a part of the energizing force (refer to arrow A9) due to the rotation of the rotation driver 71 is changed into the straight energizing force F2 operating in the direction toward the holder 84C in the central axis line CA direction by fitting the guide projection 91 into the guide groove 33*g*. This makes it possible to move the toner container in the central axis line CA direction while rotating the container main body about the central axis line CA with a simple and small configuration.

In the image-forming apparatus of Embodiment 3, the energizing force F due to the rotation of the rotation driver 71 does not act as an energizing force in the central axis line CA direction to the container main body (33YC, 33MC, 33C, 33KC) in the loading position Lp (loaded condition). In this way, it is possible to reduce the driving power loss while more smoothly rotating the container main body about the central axis line CA.

In the image-forming apparatus 100C of Embodiment 3, the loaded toner container (32YC, 32MC, 32CC, 32KC) rotates by using the energizing force F due to the rotation of the rotation driver 71. This makes possible to simplify the configuration of the toner container and toner container housing 31C (image-forming apparatus 100C) because a gear for driving and driving gear in the usage state are not required.

In the image-forming apparatus 100C of Embodiment 3, the fitted and released conditions of the guide projection 91 to the guide groove 33*g* are able to be switched by the fitting switch 93. With this configuration, it is possible to switch to change a part of the energizing force (refer to arrow A9) due to the rotation of the rotation driver 71 into the straight energizing force F2 acting in the central axis line CA direction and to act only the rotation energizing force F1 without being changed by a simple configuration.

Consequently, the toner container is able to be more easily replaced in the image-forming apparatus 100C; thus, the operation performance is able to be improved.

Embodiment 4

Figure 24:
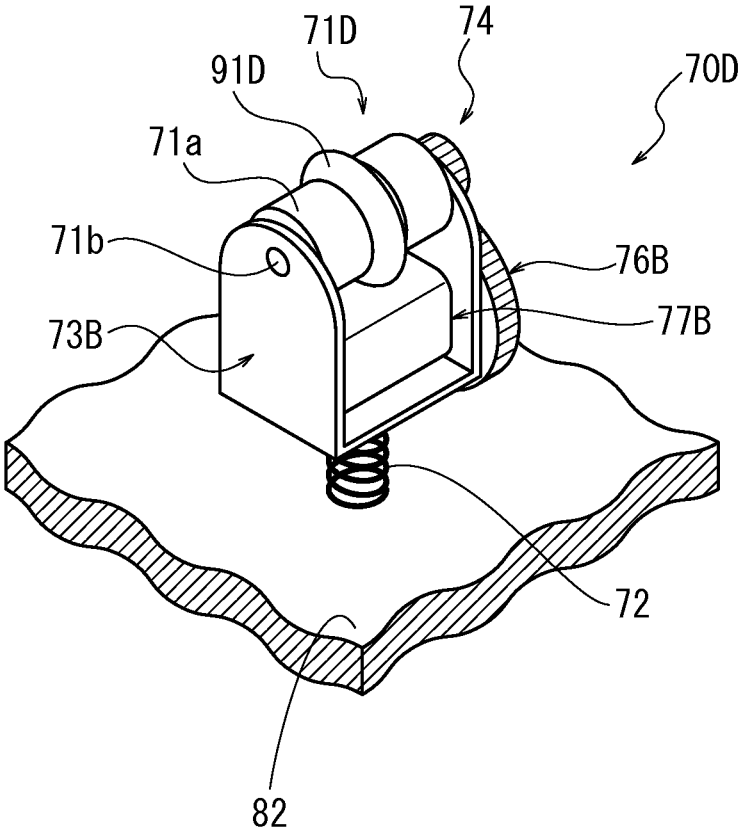
FIG. 24 is a view illustrating a configuration of a drive mechanism for loading 70D in an image-forming apparatus 100D according to Embodiment 4.
Figure 25:
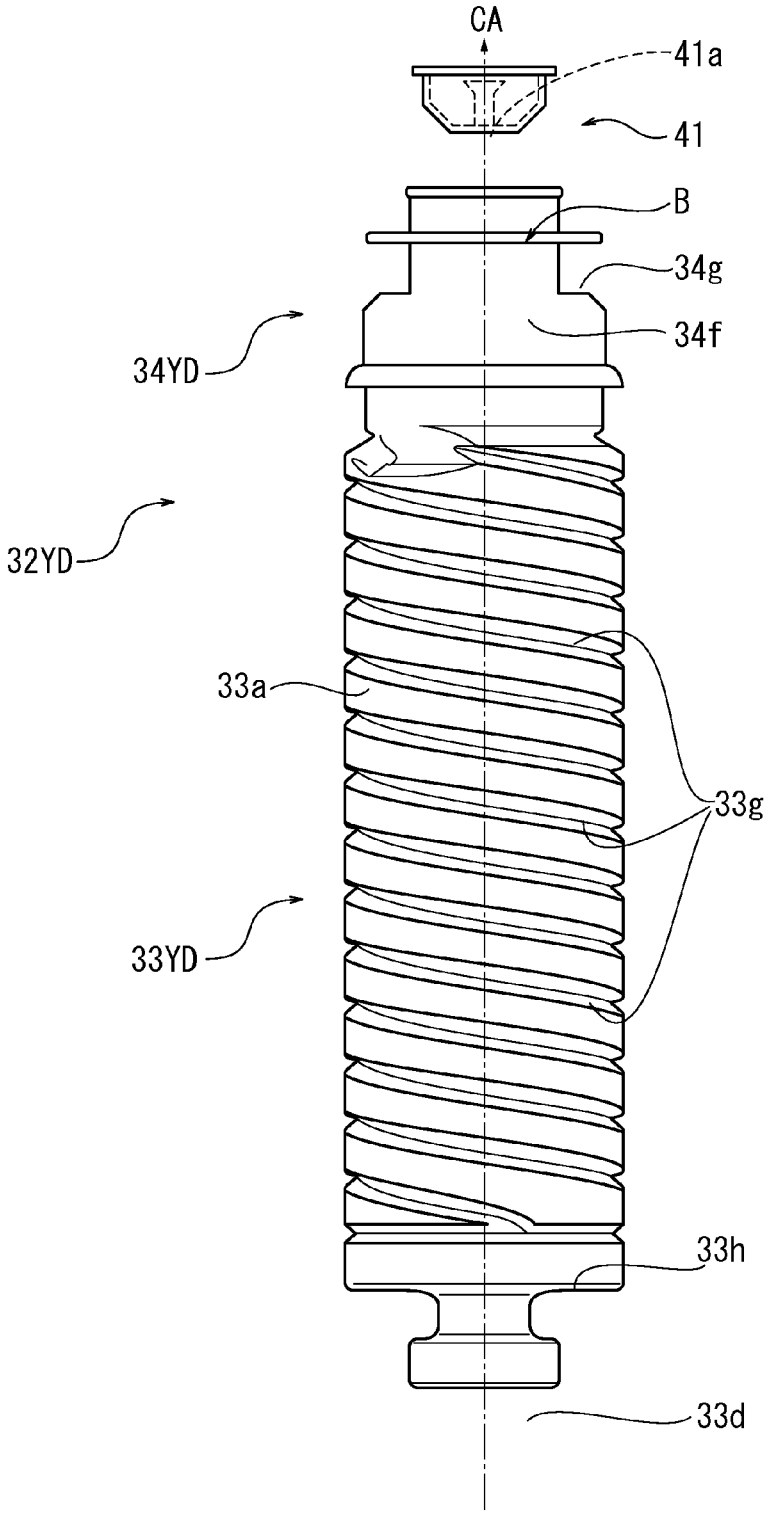
FIG. 25 is a view illustrating a toner container 32YD corresponding to the image-forming apparatus 100D.
Figure 26:
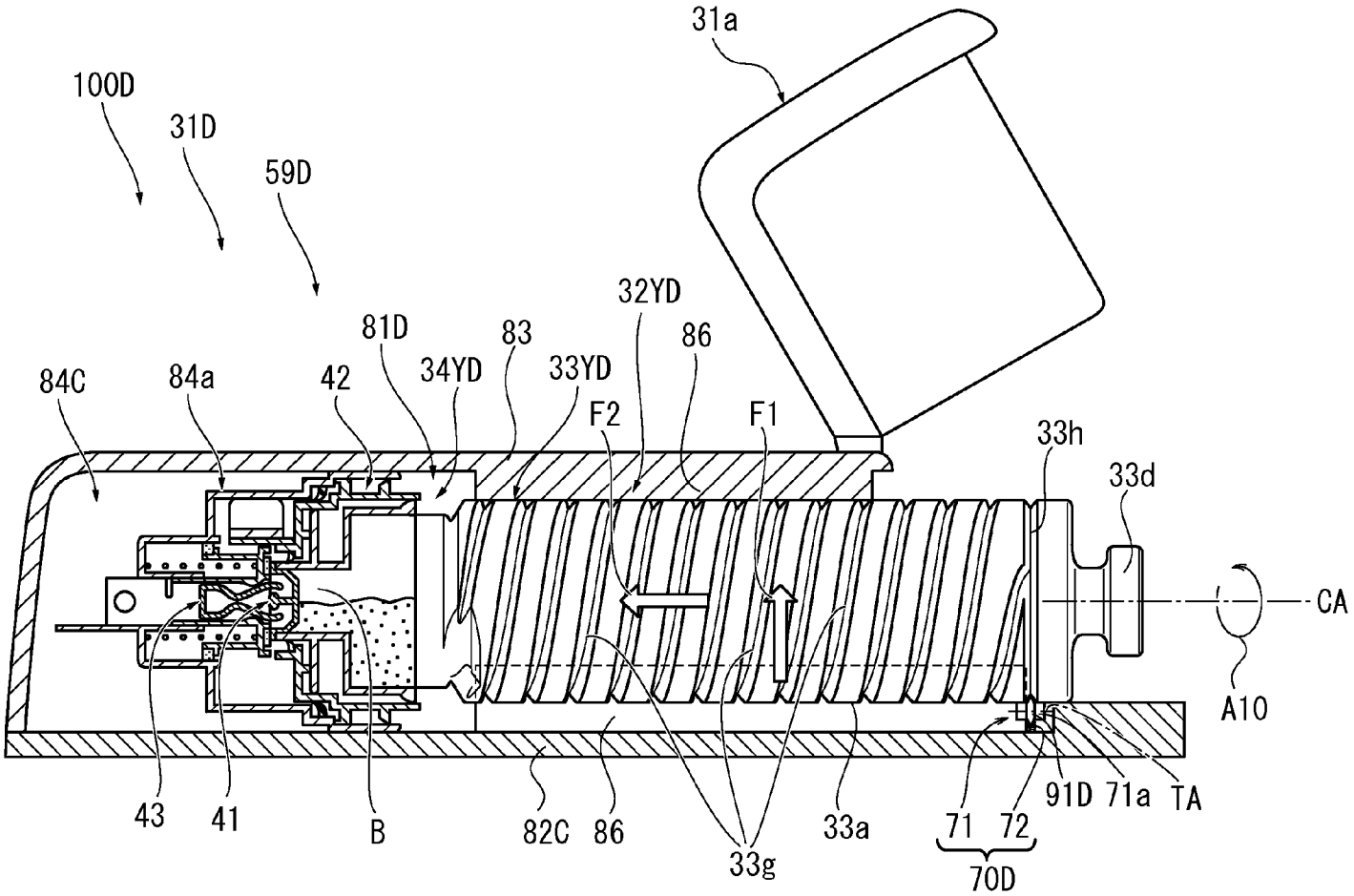
FIG. 26 is a view similar to FIG. 22 illustrating a positional relationship between the rotation driver 71D of the drive mechanism for loading 70D and the toner container 32YD (container main body 33YD).

Next, an image-forming apparatus 100D according to Embodiment 4 will be described. Embodiment 4 is different from Embodiment 3 in the configuration and operation of a loading drive mechanism 70D. The image-forming apparatus 100D of Embodiment 4 is basically similar to the image-forming apparatus 100C of Embodiment 3 in the configuration, so the same reference numbers are applied to the same configurations, and the detailed description thereof will be omitted. A toner container 32YD is also basically similar to the toner container 32Y of Embodiment 3 in the configuration, so the same reference numbers are applied to the same configurations, and the description thereof will be omitted. FIG. 24 is a view illustrating the configuration of the loading drive mechanism 70D in the image-forming apparatus 100D according to Embodiment 4. FIG. 25 is a view illustrating the toner container 32YD corresponding to the image-forming apparatus 100D. FIG. 26 is a view similar to FIG. 22 illustrating a positional relationship between a rotation driver 71D of the loading drive mechanism 70D and the toner container 32YD (container main body 33YD). In FIG. 26, the after-described rotation driver 71D and coil spring 72 are only described as the loading drive mechanism 70D for simplifying the description.

The loading drive mechanism 70D of the image-forming apparatus 100D according to Embodiment 4 is able to move the toner container 32YD in the central axis line CA direction by using the guide groove 33*g* provided in the toner container 32YD (change in the straight energizing force F2) similar to the loading drive mechanism 70C of Embodiment 3. The loading drive mechanism 70D includes a rotation driver 71D, coil spring 72, driver holding case 73B, input gear 74, output gear 76B, and motor 77B as illustrated in FIG. 24. More specifically, the loading drive mechanism 70D is different from the loading mechanism 70C of Embodiment 3 in the configuration of the rotation driver 71D, and does not have the guide projection 91, spring for a projection 92 and fitting switch 93 (refer to FIG. 21) different from the loading drive mechanism 70C of Embodiment 3.

The rotation driver 71D of the loading drive mechanism 70D includes a guide projection 91D. Specifically, the guide projection 91D is provided in the intermediate position of the rotation driver 71D as seen in the rotation axis line TA to project in the diameter direction relative to the rotation axis line TA from the circumferential wall face 71*a*. The guide projection 91D includes a circular shape winding the circumferential wall face 71*a*, and is able to fit into the guide groove 33*g* of the toner container 32YD to be slidable in the fitted condition.

Next, the toner container 32YD used in Embodiment 4 will be described. The configuration of toner container 32YD is basically similar to that of the toner container 32YC used in Embodiment 3. In the toner container 32YD, as illustrated in FIG. 25, a retention groove 33*h* is connected with the guide groove 33*g*, which is formed to concave the outer circumferential wall portion in the container body 33YD. The retention groove 33*h* is a circular groove winding the outer circumferential face 33*a* of the container main body 33YD along the face orthogonal to the central axis line CA, and is connected with the end portion of the guide groove 33*g* on the back end side (grip 33*d* side). In addition, the retention groove 33*h* does not project on the inner circumferential face side of the container main body 33YD, and form a projection on the inner circumferential face.

In the toner container housing 31D, upon the insertion of the toner container 32YD in the housing section 81D, the guide projection 91D of the rotation driver 71D engages with the guide groove 33*g* while the circumferential wall face 71*a* of the rotation driver 71D has contact with the outer circumferential face 33*a* of the container main body 33YD, so that the container main body is loaded in the loading preparation position Sp.

Thereafter, the rotation driver 71D of the loading drive mechanism 70D rotates under the control of the motor 77B in the toner container housing 31D. The energizing force (refer to arrow A10) due to the rotation of the rotation driver 71D is applied to the container main body 33YD of the toner container 32YD inserted in the housing section 81D because the circumferential wall face 71*a* of the rotation driver 71D has contact with the outer circumferential face 33*a* of the container main body 33YD. The energizing force applies the rotation energizing force F1 acting in the direction orthogonal to the central axis line CA relative to the outer circumferential face 33*a* of the container main body 33YD. Then, the container main body 33YD moves on the holder 84C side in the central axis line CA direction by the guiding operation of the guide groove 33*g* and the guide projection 91D because the guide projection 91D provided in the rotation driver 71D is fitted to the guide groove 33*g* provided in the outer circumferential face 33*a*. Namely, the guide groove 33*g* and the guide projection 91D changes a part of the energizing force (refer to arrow A10) due to the rotation of the rotation driver 71D into the straight energizing force F2 acting in the direction toward the holder 84C in the central axis line CA direction. For this reason, in the loading drive mechanism 70D of Embodiment 4, the guide groove 33*g* operates as a guide path, the guide projection 91D operates as a follow-up engagement portion and the guide projection 91D operates as an energizing direction changer which changes a part of the rotation energizing force F of the rotation driver 71D into the straight energizing force F in the central axis line CA with the cooperation with the guide groove 33*g*. With this configuration, the container main body 33YD rotates about the central axis line CA by the rotation energizing force F1 while the toner container 32YD (container main body 33YD and held portion 34YD) moves on the holder 84C side in the central axis line CA direction by the straight energizing force F2 in the housing section 81D.

After that, the toner container 32YD reaches the loading position Lp in the housing section 81D, and the held portion 34YD (head portion of toner container 32YD) in the holder 84C engages with the container-holding member 42, so that the toner container 32YD is appropriately loaded in the toner container housing 31D. Then, the stopper 41 is removed from the toner outlet B of the held portion 34YD of the toner container 32YD to enable the toner (yellow) contained in the toner container 32YD to be supplied to the development device 5Y. Then, the mounting operation of the toner container 32YD is completed. Herein, the guide projection 91D provided in the rotation driver 71D enters into the retention groove 33*h* of the guide groove 33*g*.

The container main body 33YD rotates about the central axis line CA by the guiding operation of the retention groove 33*h* and the guide projection 91D without changing the position in the central axis line CA direction upon the appropriate driving of the rotation driver 71D of the loading drive mechanism 70D in a usage state in the toner container housing 31D. In this way, the toner accumulated in the case 84*a* is able to be supplied in the development device 5Y from the above-described toner-carrying pipe 67Y. Therefore, the retention groove 33*h* operates as a retention path in the toner container housing 31D of Embodiment 4.

The toner container 32YD is removed in the toner container housing 31D by the reverse operation to mounting the toner container 32YD. At the start of the removing, the guide projection 91D provided in the rotation driver 71D effectively enters in the guide groove 33*g* by applying the pressure on the mounting opening 85 side (back side) of the central axis line CA relative to the toner container 32YD. The pressure on the mounting opening 85 side (back side) is obtained by the handle 45 (refer to FIG. 18) which has contact with the mounting opening 85 or another pressure mechanism, for example.

The image-forming apparatus 100D of Embodiment 4 is able to obtain the effect basically similar to that of Embodiment 1 because the image-forming apparatus 100D of Embodiment 4 is similar to the image-forming apparatus 100 of Embodiment 1 in the configuration.

In addition, in the image-forming apparatus 100D of Embodiment 4, the guide projection 91D is fitted to the guide groove 33*g*. In this way, a part of the energizing force (refer to arrow A10) due to the rotation of the rotation driver 71D is able to be changed in the straight energizing force F2 acting in the direction toward the holder 84C in the central axis line CA direction. This makes it possible to move the toner container in the central axis line CA direction while rotating the container main body about the central axis line CA with a simple and small configuration.

In the image-forming apparatus of Embodiment 4, it is possible to reduce the driving force loss while rotating the container main body more smoothly because the energizing force F due to the rotation of the rotation driver 71D operates in the energizing force in the central axis line CA direction relative to the container main body (33YD, 33MD, 33DD, 33KD) with the guiding operation of the retention groove 33*h* and the guide projection 91D.

In the image-forming apparatus 100D of Embodiment 4, the configuration of the toner container and toner container housing 31D (image-forming apparatus 100D) is able to be further simplified because the loaded toner container (32YD, 32MD, 32DD, 32KD) rotates by using the energizing force F due to the rotation of the rotation driver 71D.

The image-forming apparatus 100D of Embodiment 4 includes the retention groove 33*h* connected with the guide groove 33*g*, and is configured such that the rotation driver 71D of the loading drive mechanism 70D enters in the retention groove 33*h* when the toner container (32YD, 32MD, 32DD, 32KD) is loaded in the loading position Lp. With this configuration, it is possible to switch to change a part of the energizing force (refer to arrow A10) due to the rotation of the rotation driver 71D into the straight energizing force F2 acting in the central axis line CA direction and to act only the rotation energizing force F1 without being changed by a simple configuration.

Consequently, in the image-forming apparatus 100D of the present invention, the operation for replacing the toner container can be simplified; thus, the operation performance can be further improved.

Figure 27:
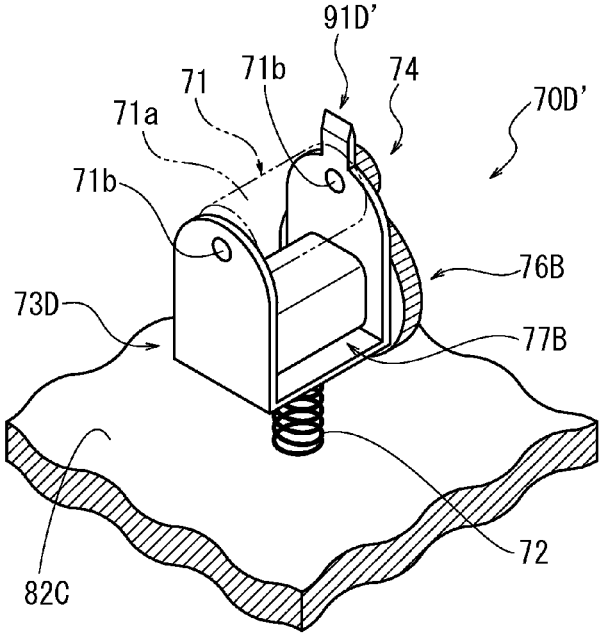
FIG. 27 is a view illustrating an example of a drive mechanism for loading 70D' different from that in FIG. 24.

In Embodiment 4, the guide projection 91D is provided in the rotation driver 71D in the loading drive mechanism 70D. However it is not limited to Embodiment 4 as long as the guide projection 91D is integrally provided with the rotation driver 71D. For example, as illustrated in FIG. 27, a guide projection 91D' is provided in the driver holding case 73D to obtain a loading drive mechanism 70D' having the cylindrical rotation driver 71 similar to that in Embodiment 3. In this case, the effect similar to that of the above described loading drive mechanism 70D can be obtained.

Embodiment 5

Figure 28:
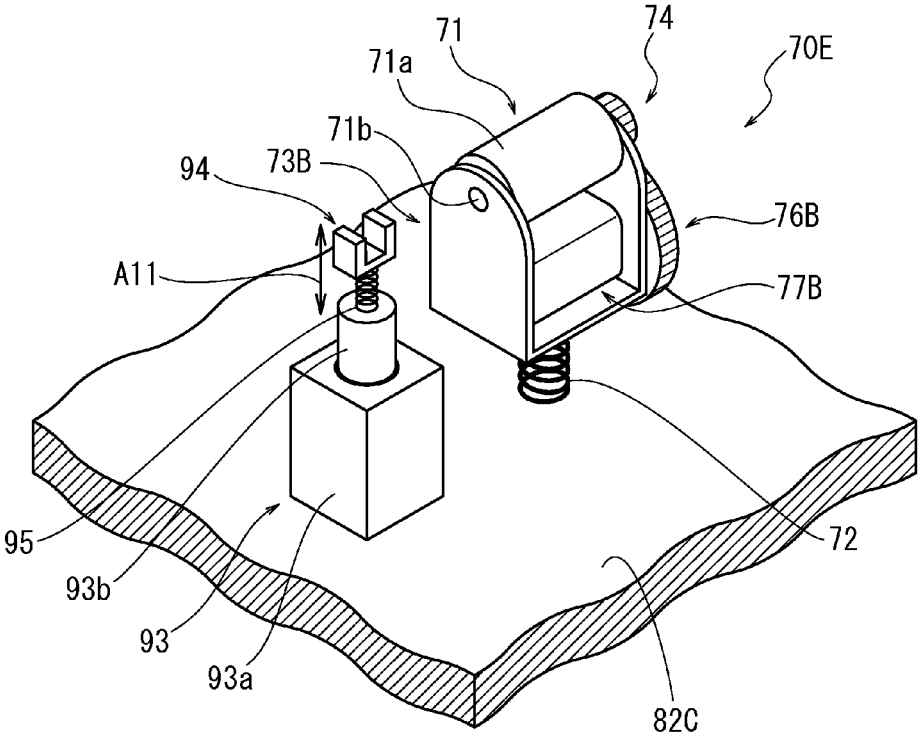
FIG. 28 is a view illustrating a configuration of a drive mechanism for loading 70E in an image-forming apparatus 100E according to Embodiment 5.
Figure 29:
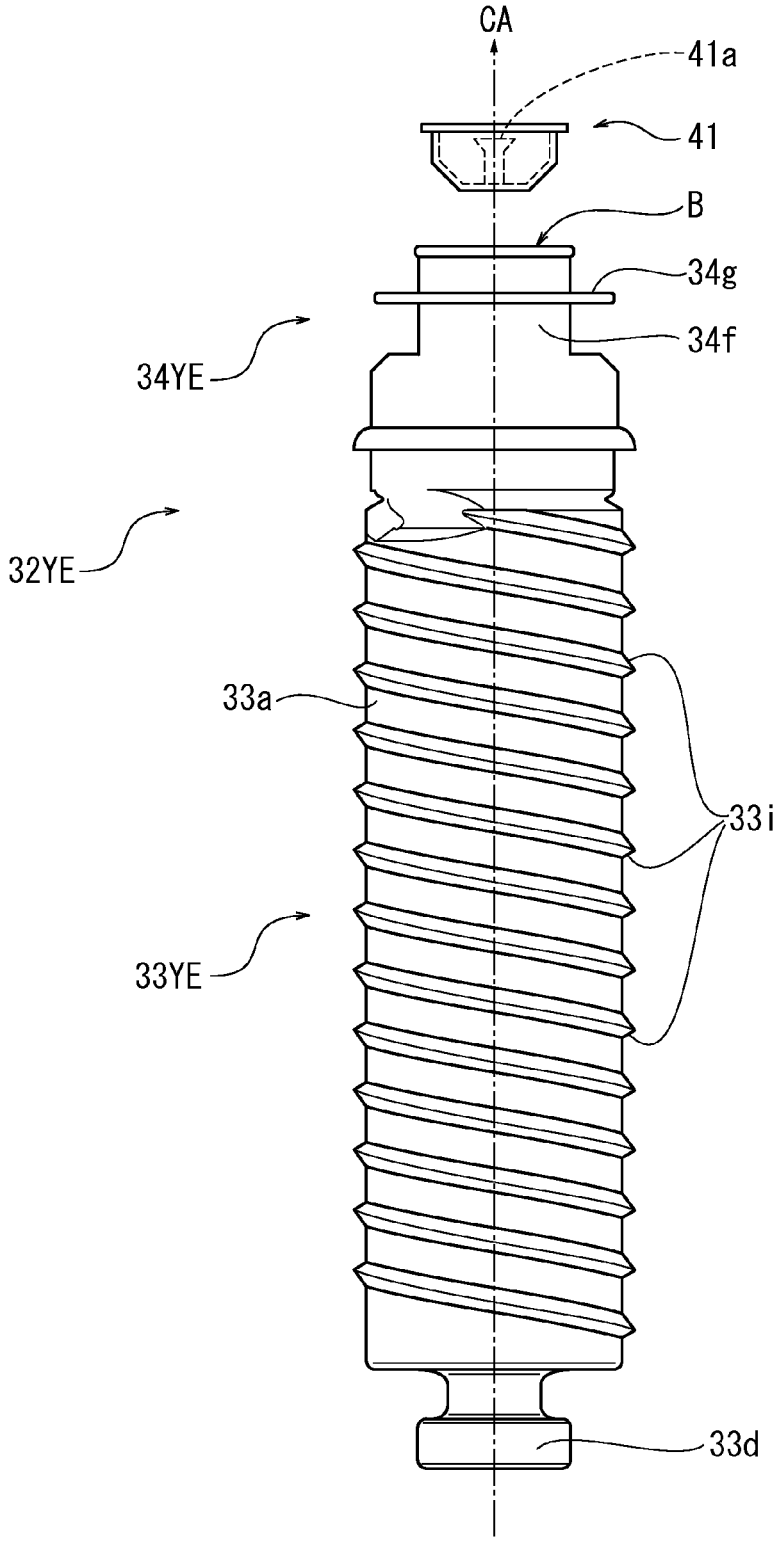
FIG. 29 is a view illustrating a toner container 32YE corresponding to the image-forming apparatus 100E.
Figure 30:
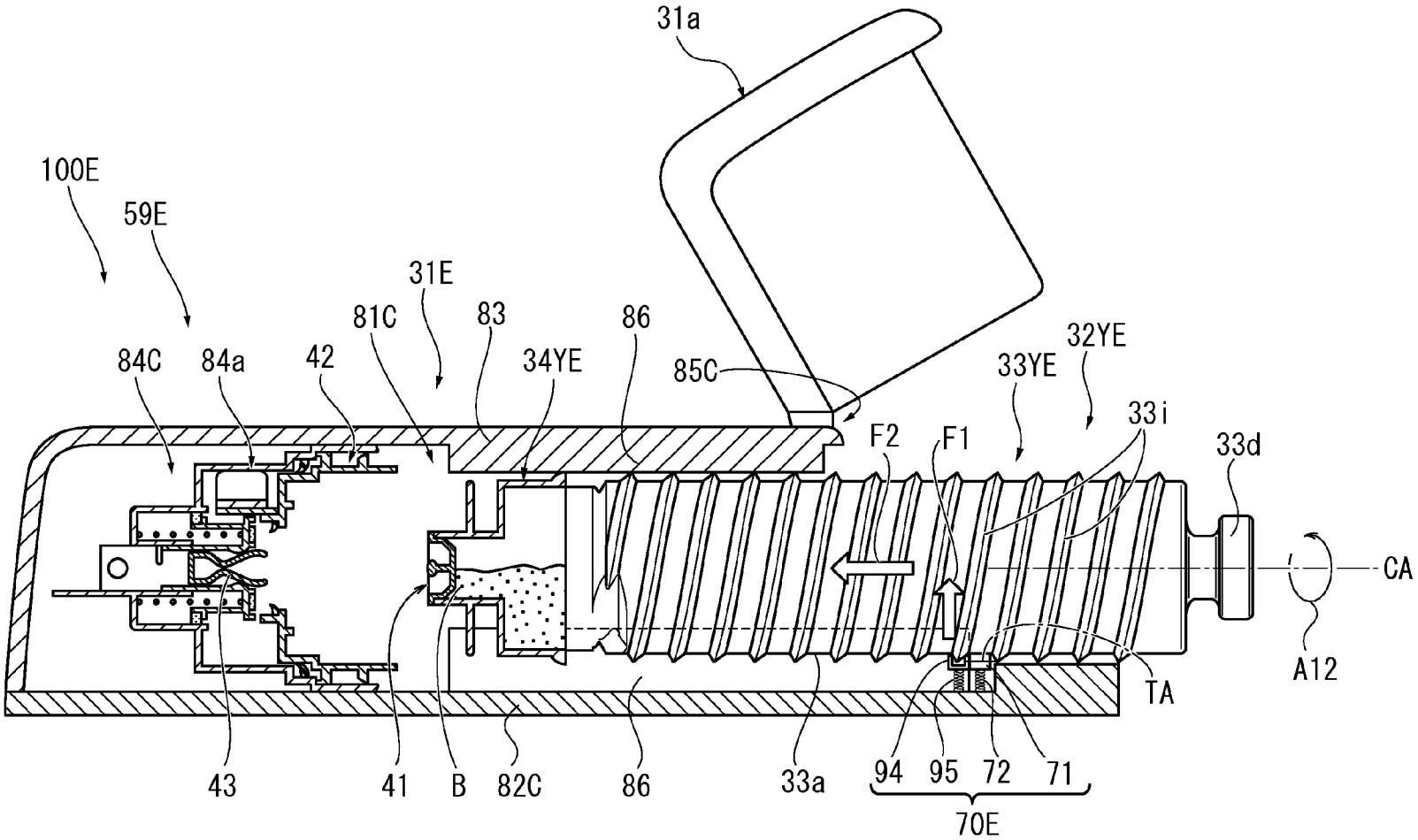
FIG. 30 is a view similar to FIGS. 22, 26 illustrating a positional relationship between the rotation driver 71 of the drive mechanism for loading 70E and the toner container 32YE (container main body 32YE).

Next, an image-forming apparatus 100E according to Embodiment 5 will be described. Embodiment 5 is different from Embodiment 3 in the configuration of the loading driving mechanism 70E and toner container 32YE. The image-forming apparatus 100E of Embodiment 5 is similar to that of image-forming apparatus 100C of Embodiment 3 in the basic configuration, so the same reference numbers are applied to the same configurations, and the detailed description thereof will be omitted. FIG. 28 is a view illustrating the configuration of the loading drive mechanism 70E in the image-forming apparatus 100E according to Embodiment 5. FIG. 29 is a view illustrating the toner container 32YE corresponding to the image-forming apparatus 100E. FIG. 30 is a view similar to FIGS. 22, 26 illustrating a positional relationship between the rotation driver 71 of the loading drive mechanism 70E and the toner container 32YE (container main body 32YE). In addition, in FIG. 30, as the loading drive mechanism 70E, the after-described rotation driver 71, coil spring 72, guide concave 94, and spring for a concave 95 are only described for simplifying the description.

The loading drive mechanism 70E of the image-forming apparatus 100E according to Embodiment 5 moves the toner container 32YE in the central axis line CA direction by using a guide projection 33*i* (refer to FIG. 29) provided in the toner container 32YE (changes into the straight energizing force F2). The loading drive mechanism 70E includes the rotation driver 71, coil spring 72, driver holding case 73B, input gear 74, output gear 76B, motor 77B, guide concave 94, spring for a concave 95 and fitting switch 93 as illustrated in FIG. 28.

The configuration which rotatably holds the rotation driver 71 in the loading drive mechanism 70E is similar to that in the loading drive mechanism 70C of Embodiment 3. The guide concave 94 is provided in the loading drive mechanism 70E parallel to the rotation driver 71 in the central axis line CA direction. The guide groove 94 is able to receive the guide projection 33*i* (refer to FIG. 29) provided in the container main body 33YE of the toner container 32YE to be slidable in a state in which the guide projection 33*i* is fitted in the guide concave 94. The guide concave 94 is attached to the fitting switch 93 (lifting portion 93*b*) through the spring for a concave 95. The fitting switch 93 is provided on the platform 82C, and includes the main body portion 93*a* fixed on the platform 82C and the lifting portion 93*b* (refer to arrow A11) capable of extending and retracting from and to the main body portion 93*a*. The extending and retracting direction of the fitting switch 93 is set in the direction toward the central axis line CA of the toner container 32YE (container main body 33YE) held in the housing section 81C from the platform 82C. With this configuration, the guide concave 94 comes close to the central axis line CA by separating from the platform 82C under the control of the controller 38 (refer to FIG. 10) and also comes close to the platform 82C by separating from the central axis line CA. Namely, the position of the guide concave 94 is able to be changed in that direction.

The toner container 32YE corresponding to the loading drive mechanism 70E includes a cylindrical shape as illustrated in FIG. 29, and includes the integrally formed container main body 33YE and held portion 34YE. The configuration of the toner container 32YE is basically similar to the configuration of the toner container 32YC in Embodiment 3, but the toner container 32YE has a guide projection 33*i* provided instead of the guide groove 33*g* (refer to FIG. 17). The guide projection 33*i* is a spiral shape projection formed on the outer circumferential face 33*a* of the container main body 33YE.

Next, the operation for mounting and removing the toner container 32YE in the toner container housing 31E will be described. As illustrated in FIG. 30, in the toner container housing 31E, upon the insertion of the toner container 32YE in the housing section 81C, the guide projection 33*i* is fitted into the guide concave 94 of the loading drive mechanism 70E while the circumferential wall face 71*a* of the rotation driver 71 has contact with the outer circumferential face 33*a* of the container main body 33E, so that the container main body is loaded in the loading preparation position Sp.

After that, the rotation driver 71 of the loading drive mechanism 70E rotates under the control of the motor 77B in the toner container housing 31E. In this way, the energizing force (refer to arrow A12) due to the rotation of the rotation driver 71 is applied to the container main body 33YE because the circumferential wall face 71*a* of the rotation driver 71 has contact with the outer circumferential face 33*a* in the container body 33YE of the toner container 32YE pushed in the housing section 81C. The energizing force applies the rotation energizing force F1 acting in the direction orthogonal to the central axis line CA relative to the outer circumferential face 33*a* of the container main body 33YE. Then, the container main body 33YE moves on the holder 84C side in the central axis line CA by the guide operation of the guide projection 33*i* and guide concave 94 because the guide projection 33*i* provided in the outer circumferential face 33*a* is fitted in the guide concave 94 fixed on the platform 82C (housing section 81C). Namely, the guide projection 33*i* and the guide concave 94 changes a part of the energizing force (refer to arrow A12) due to the rotation of the rotation driver 71 into the straight energizing force F2 acting in the direction toward the holder 84C in the central axis line CA direction. For this reason, in the loading drive mechanism 70E of Embodiment 5, the guide projection 33*i* operates as the guide path, the guide concave 94 operates as the follow-up engagement portion and the guide concave 94 operates as the energizing direction changer which changes a part of the rotation energizing force F of the rotation driver 71 into the straight energizing force F2 in the central axis line CA with the guide projection 33*i*. With this configuration, the container main body 33YE rotates about the central axis line CA by the rotation energizing force F1 while the toner container 32YE (container main body 33YE and held portion 32YE) moves on the container portion 84C side in the central axis line CA direction by the straight energizing force F2.

After that, the toner container 32YE reaches the loading position Lp in the housing section 81C, and the held portion 32YE (head portion of toner container 32YE) engages with the container-holding member 42 in the holder 84C, so that the toner container 32YE is appropriately loaded in the toner container housing 31E. Thereafter, the stopper 41 is removed from the toner outlet B of the held portion 32YE of the toner container 32YE, enabling the toner (yellow) contained in the toner container 32YE to be supplied to the development device 5Y. Then, the operation for mounting the toner container 32YE is completed. The guide concave 94 is retracted by the fitting switch 93 to be separated from the guide projection 33*j* after the mounting operation is completed.

In the toner container housing 31E, the toner accumulated in the case 84*a* is able to be supplied into the development device 5Y from the toner-carrying pipe 67Y by appropriately rotating the toner driver 71 of the loading drive mechanism 70E.

The toner container 32Y is removed in the toner container housing 31E by the reverse operation to mounting the toner container 32YE. At the start of the removing, at first, the guide concave 94 extended by the fitting switch 93 receives the guide projection 33*i*, and the rotation driver 71 rotates in the direction opposite to that in mounting under the control of the motor 77B. Therefore, a user is able to remove the toner container 32YE by lifting the toner container 32YE in which a part of the container main body 33YE projects from the mounting opening 85 in the loading preparation position Sp.

The configuration of the image-forming apparatus 100E of Embodiment 5 is basically similar to that of the image-forming apparatus 100 of Embodiment 1; thus, the effect similar to Embodiment 1 is able to be obtained.

In addition to that, a part of the energizing force (refer to arrow A12) due to the rotation of the rotation driver 71 is able to be changed into the straight energizing force F2 acting in the direction toward the holder 84C in the central axis line CA direction due to the insertion of the guide projection 33*i* into the guide groove 94. In this way, the toner container is able to be moved in the central axis line CA direction while rotating the rotation main body about the central axis line CA with a simple and small configuration.

In the image-forming apparatus 100E of Embodiment 5, the driving force loss is able to be reduced and the container main body is able to smoothly rotate about the central axis line CA because the energizing force F due to the rotation of the rotation driver 71 does not act as the energizing force in the central axis line CA direction relative to the container main body (33YE, 33ME, 33EE, 33KE).

In the image-forming apparatus 100E of Embodiment 5, it is not necessary to provide a gear and a driving gear for rotation in a usage state because the loaded toner container (32YE, 32ME, 32EE, 32KE) rotates by the energizing force F due to the rotation of the rotation driver 71. Therefore, the toner container and the toner container housing 31E (image-forming apparatus 100E) are able to be simplified.

In the image-forming apparatus 100E of Embodiment 5, the fitted and released conditions of the guide concave 94 to the guide projection 33*i* are able to be switched by the fitting switch 93. With this configuration, it is possible to switch to change a part of the energizing force (refer to arrow A12) due to the rotation of the rotation driver 71 into the straight energizing force F2 acting in the central axis line CA direction and to act only the rotation energizing force F1 without being changed by a simple configuration.

Therefore, the operation for replacing the toner container can be simplified in the image-forming apparatus 100E to improve the operation performance.

Embodiment 6

Figure 31:
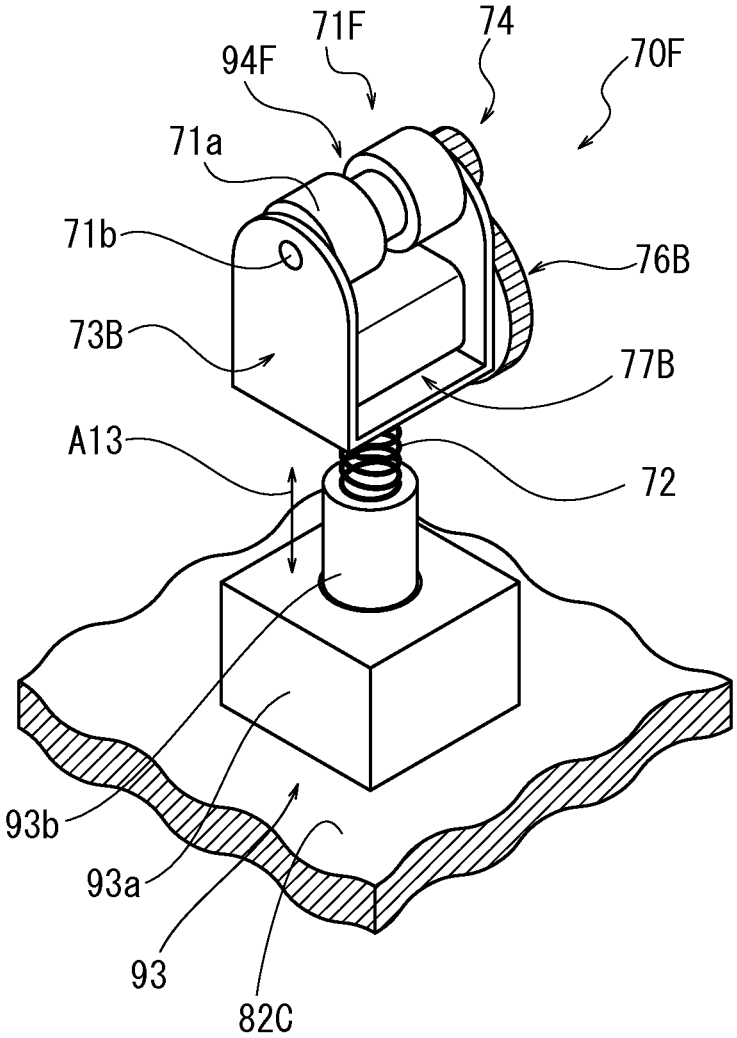
FIG. 31 is a view illustrating a configuration of a drive mechanism for loading 70F in an image-forming apparatus 100F according to Embodiment 6.
Figure 32:
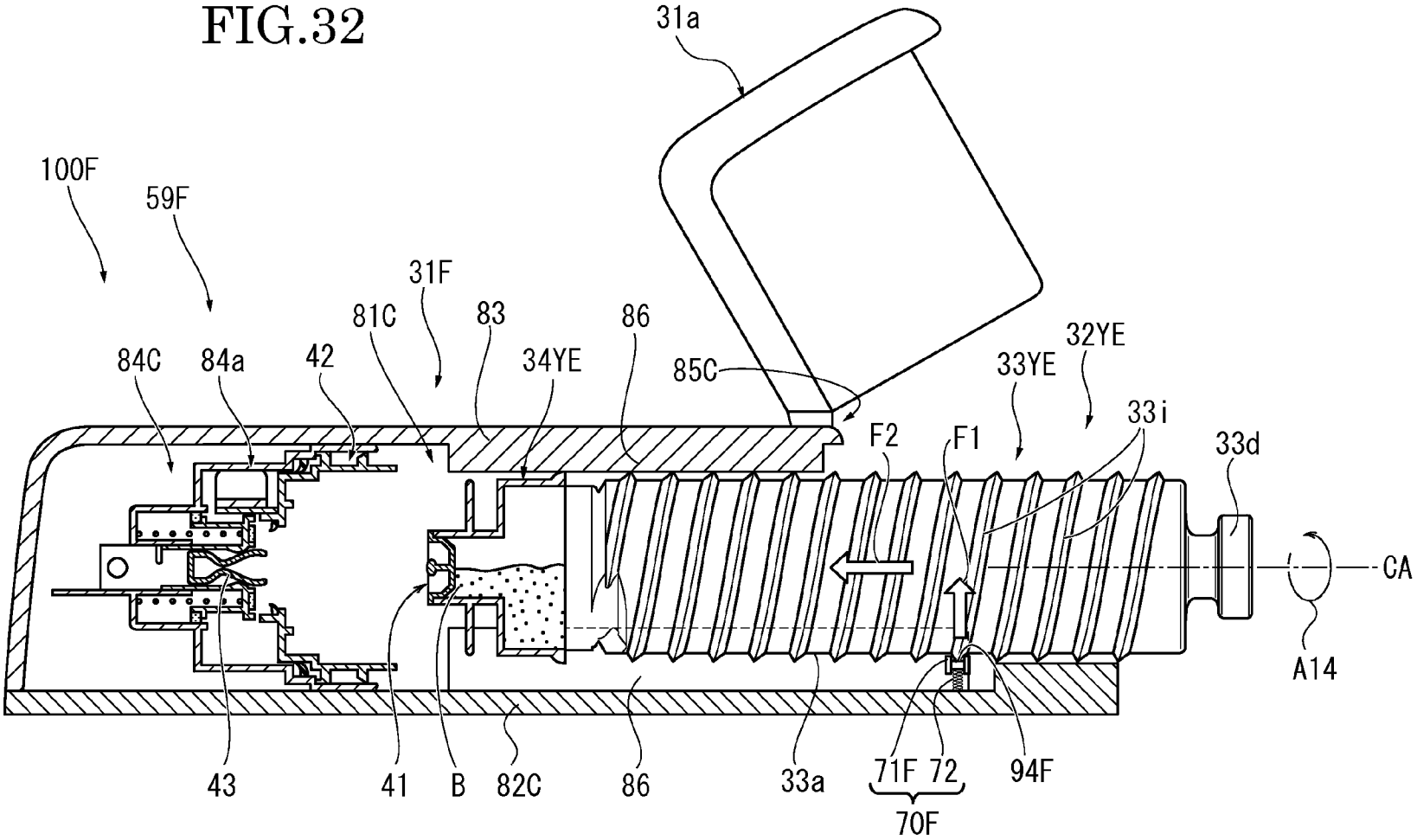
FIG. 32 is a view similar to FIGS. 22, 26, 30 illustrating a positional relationship between a rotation driver 71F of the drive mechanism for loading 70F and the toner container 32YE (container main body 33YE).

Next, an image-forming apparatus 100F according to Embodiment 6 will be described. Embodiment 6 is different from Embodiment 3 in the configuration of the loading drive mechanism 70F. The same reference numbers are applied to the same configurations and the description thereof will be omitted because the basic configuration of the image-forming apparatus 100F of Embodiment 6 is similar to that of Embodiment 3. FIG. 31 is a view illustrating a configuration of a loading drive mechanism 70F in the image-forming apparatus 100F according to Embodiment 6. FIG. 32 is a view similar to FIGS. 26, 30 illustrating a positional relationship between the rotation driver 71F of the loading drive mechanism 70F and the toner container 32YE (container main body 33YE). In addition, FIG. 32 illustrates only the after-described rotation driver 71 and coil spring 72 as the loading drive mechanism 70F for simplifying the description.

The loading drive mechanism 70F of the toner container housing 31F of the image-forming apparatus 100F in Embodiment 6 enables the toner container 32YE to move in the central axis line CA direction by using the guide projection 33*i* provided in the toner container 32YE (refer to FIG. 32) similar to the loading drive mechanism 70E of Embodiment 5. The loading drive mechanism 70F includes a rotation driver 71F, coil spring 72, driver holding case 73B, input gear 74, output gear 76B, motor 77B and fitting switch 93 as illustrated in FIG. 31. Namely, the loading drive mechanism 70F does not have the guide concave 94 and the spring for a concave 95 (refer to FIG. 28) provided in the loading drive mechanism 70E of Embodiment 5. Embodiment 6 differs from Embodiment 5 in the configuration of the rotation driver 71F, and the driving holding case 73B is attached to the fitting switch 93 (lifting portion 93*b*) through the coil spring 72 in Embodiment 6.

In the loading drive mechanism 70F, a guide groove 94F is provided in the rotation driver 71F. Specifically, the guide groove 94F is provided in the intermediate position of the rotation driver 71F as seen in the rotation axis line TA direction such that the circumference wall face 71*a* concaves in the diameter direction relative to the rotation axis line TA. The guide concave 94F includes a circular shape winding the circumferential wall face 71*a*. The guide projection 33*i* of the toner container 32YE is fitted into the guide concave 94F. The guide concave 94F is slidable in a state in which the guide projection 33*i* is fitted into the guide concave 94F. The fitting switch 93 holding the driver holding case 73B which rotatably holds the rotation driver 71F is provided on the platform 82C, and includes the main body portion 93*a* fixed on the platform 82C and the lifting portion 93*b* (refer to arrow A13) capable of extending and retracting from and to the main body portion 93*a*. In addition, the toner container-holding 31F is provided with a rotation mechanism which rotates the toner container 32YE about the central axis line CA without moving the toner container in the central axis line CA direction. This rotation mechanism may be a driving gear of a driver provided in the housing 84C with the gear 33*c*1 (refer to FIG. 6) provided in the toner container 32 (32YE) as Embodiment 1 or may be a rotation energizing force directly applied to the toner container 32YE.

In the toner container housing 31F of Embodiment 6, the toner housing 32YE is inserted in the housing section 81C, and the circumferential wall face 71*a* of the rotation driver 71F has contact with the outer circumferential face 33*a* of the container main body 33YE, so that the guide projection 33*i* is fitted into the guide concave 94F of the rotation driver 71F. Then, the toner container is set in the loading preparation position Sp.

Thereafter, the rotation driver 71F of the loading drive mechanism 70F rotates under the control of the motor 77B in the toner container housing 31F. In this way, the energizing force (refer to arrow A14) due to the rotation of the rotation driver 71F is applied to the toner container 32YE because the circumferential wall face 71*a* of the rotation driver 71F has contact with the outer circumferential face 33*a* of the toner container 32YE (container main body 33YE) pushed in the housing section 81. The energizing force applies the rotation energizing force F1 acting in the direction orthogonal to the central axis line CA relative to the outer circumferential face 33*a* of the container main body 33YE. Then, the container main body 33YE moves on the holder 84 side in the central axis line CA direction by the guide operation of the guide projection 33*i* and the guide concave 94F because the guide projection 33*i* provided in the outer circumferential face 33*a* is inserted in the guide concave 94F provided in the rotation driver 71F. Namely, the guide projection 33*i* and the guide concave 94F changes a part of the energizing force (refer to arrow A14) due to the rotation of the rotation driver 71F into the straight energizing force F2 acting in the direction toward the holder 84C in the central axis line CA direction. Because of this, in the loading drive mechanism 70F of Embodiment 6, the guide projection 33*i* operates as a guide path, the guide concave 94F operates as a follow-up engagement portion and the guide concave 94F operates as an energizing direction changer which changes a part of the rotation energizing force F of the rotation driver 71F into the straight energizing force F2 in the central axis line CA together with the guide projection 33*i*. With this configuration, the container main body 33YE rotates about the central axis line CA by the rotation energizing force F1 in the housing section 81C while the toner container 32YE (container main body 33YE and held portion 34YE) moves on the holder 84C side in the central axis line CA direction by the straight energizing force F2.

Thereafter, the toner container 32YE reaches the loading position Lp in the housing section 81C, the held portion 34YE (head portion of toner container 32YE) engages with the container-holding member 42 in the holder 84C, so that the toner container 32YE is appropriately loaded (set) in the toner container housing 31F. Then, the stopper 41 is removed from the toner outlet B of the held portion 34YE of the toner container 32YE, and the toner (yellow) contained in the toner container 32YE is able to be supplied to the development device 5Y, and the mounting operation of the toner container 32YE is completed. The rotation driver 71F is retracted by the fitting switch 93, and separated from the outer circumferential face 33*a* of the container main body 33YE while the concave groove 94F is also separated from the guide projection 33*i*.

The toner container 32YE appropriately rotates by a not shown rotation mechanism in the toner container housing 31F in a usage condition; thus, the toner accumulated in the case 84*a* is able to be supplied in the development device 5Y from the toner carrying pipe 67Y.

The toner container 32YE is removed in the toner container housing 31F by the reverse operation to mounting the toner container 32YE. At the start of removing, at first, the rotation driver 71F extends by the fitting switch 93 and the circumferential wall face 71*a* has contact with the outer circumferential face 33*a* of the container main body 33YE, so that the guide projection 33*i* is fitted into the guide concave 94F. Then, the rotation driver 71F rotates under the control of the motor 77B in the direction opposite to that in mounting in the loading drive mechanism 70F. This makes it possible for a user to remove the toner container 32YE by lifting the toner container 32YE having a part projecting from the mounting opening 85 in the loading preparation position Sp.

The image-forming apparatus 100F of Embodiment 6 is able to obtain the effect similar to that of Embodiment 1 because the image-forming apparatus 100F of Embodiment 6 is similar to the image-forming apparatus in the basic configuration.

In addition to this, the toner container is able to be moved in the central axis line CA direction while rotating the toner container main body about the central axis line CA with a simple and small configuration because a part of the energizing force (refer to arrow A14) due to the rotation of the rotation driver 71F is able to be changed into the straight energizing force F2 acting in the direction toward the holding portion 84C in the central axis line CA direction by fitting the concave projection 33*i* into the guide concave 94F.

Therefore, the operation for replacing the toner container is simplified in the image-forming apparatus 100F to improve the operation performance.

Figure 33:
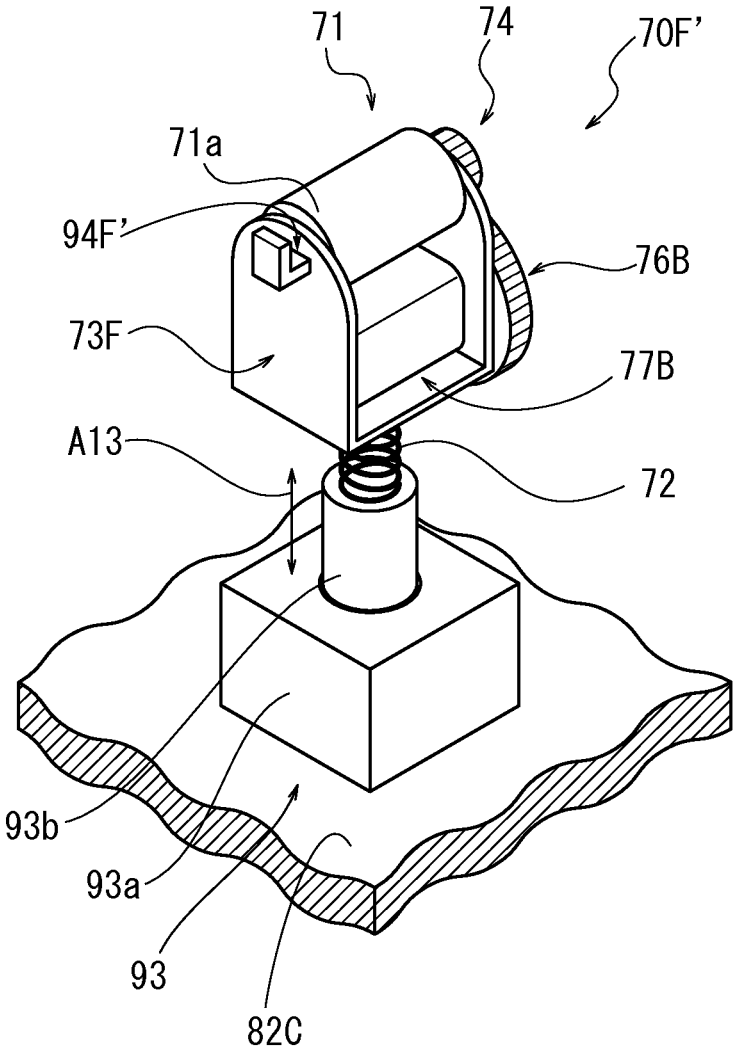
FIG. 33 is a view illustrating an example of a drive mechanism for loading 70F' different from that in FIG. 31.

In the above-described Embodiment 6, the guide concave 94F is provided in the rotation driver 71F in the loading drive mechanism 70F. However, the configuration is not limited thereto as long as the guide concave 94F is integrally provided in the rotation driver 71F. For example, as illustrated in FIG. 33, a guide concave 94F' is able to be provided in the driver holding case 73F to obtain a loading drive mechanism 70F' having the cylindrical rotation driver 71 similar to Embodiment 3. Even in this case, it is possible to obtain the effect similar to that of the loading drive mechanism 70F.

In addition, the image-forming apparatus of the present invention is not limited to the above-described embodiments as long as it includes a development device configured to form a visualized image with a developer, a powder supplier configured to supply the developer from a powder container to the development device and a housing in which the powder supplier and the development device are housed, wherein a loading preparation position which allows the powder container to be placed from an outside of the housing and a loading position which enables the developer to be supplied to the development device from the powder container are set in the powder supplier, and the powder supplier includes a loading drive mechanism configured to move the powder container in a central axis line direction between the loading preparation position and the loading position while rotating the powder container about the central axis line of the powder container.

In each embodiment, the image-forming apparatus 100 illustrates an example applied to an image-forming apparatus, for example, a color printer as illustrated in FIGS. 1, 2. However, it is not limited to each embodiment, and it can be applied to an image-forming apparatus forming a single color image.

In each embodiment, an example using the two-component developer G made of a carrier and a toner is described. However, it is not limited to each embodiment, and it is possible to use a one-component developer made of a toner.

Each of Embodiments 1, 2 illustrates an example applied to the image-forming apparatus (100, 100B) having the configuration illustrated in FIGS. 1-4. However, it is not limited Embodiments 1, 2, and it is possible to apply the image-forming apparatus with the configuration illustrated in FIG. 16.

Each of Embodiments 1, 2 illustrates an example corresponding to a toner container (toner container 32Y illustrated in FIGS. 5-7 for example) with a cap. However, it is not limited to Embodiments 1, 2, and it is possible to use a toner container without a cap (with a stopper (toner container 32YC illustrated in FIGS. 17-20 for example)).

Each of Embodiments 3-6 illustrates an example applied to the image-forming apparatus (100C, 100D, 100E, 100F) with the configuration illustrated in FIG. 16. However, it is not limited Embodiments 3-6, and it is possible to apply the image-forming apparatus with the configuration illustrated in FIGS. 1-4.

Each of Embodiment 6 illustrates an example corresponding to a toner container without a cap (with a stopper (toner container 32YC illustrated in FIGS. 17-20 for example)). However, it is not limited to Embodiments 3-6, and it is possible to use the toner container with a cap (toner container 32Y illustrated in FIGS. 5-7 for example).

In the embodiments, the retention path (retention groove 33*h*) is provided only in Embodiment 4, but it is not limited to this embodiment, and the toner container having the retention path is able to be applied to the configuration in Embodiments 2-5.

In each Embodiment, the toner is moved in the container main body 33Y due to the spiral projection 33*b* provided in the inner circumferential face of the container main body 33Y rotating about the central axis line. However, it is not limited thereto, and an agitator may be provided instead of the projection 33*b* or together with the projection 33*b*. In this case, an agitator which is fixed on the platform 82 (housing section 81) as seen in the rotation direction about the central axis line CA, an agitator which rotates together with the container main body 33Y or an agitator which rotates relative to the container main body 33Y may be used as long as an agitator for moving a toner in the central axis line CA in the container main body 33Y is used.

The image-forming units 6Y, 6M, 6C, 6K are provided in each embodiment, but are not limited to each embodiment, and a part or all of the image-forming units may be used as a process cartridge.

In the above-described image-forming apparatus, the powder container placed in the loading preparation position is moved in the loading position by the loading drive mechanism. With this configuration, a user is able to appropriately locate the powder container in the loading position by placing the powder container in the loading preparation position.

Moreover, the powder container in the loading position is moved in the loading preparation position by the loading drive mechanism. With this configuration, a user is able to remove the powder container by lifting the powder container from the loading preparation position without using an operation which extracts the powder container in the loading preparation position, so that the removing operation is able to be further simplified.

Furthermore, the powder container rotates about the central axis line when moving between the loading preparation position and the loading position, so that the developer is solved even if the developer is condensed in the powder container. In this way, the loading operation is able to be further simplified and appropriately conducted because an operation for shaking the powder container is covered even if such an operation is not conducted.

In the above-described image-forming apparatus, the powder container is able to be replaced by lifting an old powder container from the loading preparation position, and placing a new powder container in the loading preparation position. Therefore, the operation for replacing a powder container is further simplified.

In addition to the above configuration, the loading drive mechanism includes the rotation driver which applies the rotation energizing force to the powder container and the energizing direction changer which changes a part of the rotation energizing force from the rotation driver into the straight energizing force in the central axis line direction. With this configuration, the rotation driving force acting in the direction orthogonal to the central axis line and the straight energizing force acting in the central axis line are both applied to the powder container by rotating a single rotation driver. It becomes possible to move the powder container in the central axis line direction while rotating about the central axis line by a simple and small configuration.

It is also possible to switch the loading operation and the removing operation by reversing the rotation driving direction of the rotation driver.

In addition to the above configuration, the energizing direction changer is the driver-holding section which rotatably holds the rotation driver in a state in which the rotation axis line of the rotation driver inclines to the central axis line. With this configuration, the powder container is able to be moved in the central axis line direction while rotating about the central axis line by a simple and small configuration.

In addition to the above configuration, the energizing direction changer includes the spiral guide path provided on the outer circumferential face of the powder container and the follow-up engagement portion fixed on the powder supplier to be slidably engaged with the guide path. With this configuration, the powder container is able to be moved in the central axis line direction while rotating about the central axis line by a simple and small configuration.

In addition to the above configuration, the follow-up engagement portion is provided on the circumferential wall face of the rotation driver. With this configuration, the powder container is able to be moved in the central axis line direction while rotating about the central axis line by a simple and small configuration.

In addition to the above configuration, the guide path is the guide groove in which the outer circumferential face concaves in the diameter direction of the central axis line, and the follow-up engagement portion is the guide projection which is inserted into the guide groove. With this configuration, the powder container is able to be moved in the central axis line direction while rotating about the central axis line by a simple and small configuration.

In addition to the above configuration, the guide path is the guide projection projecting from the outer circumferential face in the diameter direction of the central axis line, and the follow-up engagement portion is the guide concave in which the guide projection is inserted. With this configuration, the powder container is able to be moved in the central axis line direction while rotating about the central axis line by a simple and small configuration.

In addition to the above configuration, the circular retention path which is connected with the end portion of the guide path on the loading preparation position side, and extends in the face orthogonal to the central axis line direction is provided on the outer circumferential face of the powder container. With this configuration, the powder container is able to rotate about the central axis line due to the rotation energizing force from the rotation driver without changing the position in the central axis line direction by a simple and small configuration.

The circular retention path which is connected with the end portion of the guide path on the loading preparation position side, and extends in the face orthogonal to the central axis line direction is provided on the outer circumferential face of the powder container for use in the image-forming apparatus described above. With this configuration, the powder container is able to rotate about the central axis line due to the rotation energizing force from the rotation driver without changing the position in the central axis line direction by a simple configuration.

Although the embodiments of the present invention have been described above, the present invention is not limited thereto. It should be appreciated that variations may be made in the embodiments described by persons skilled in the art without departing from the scope of the present invention.

What is claimed is:

1. An image-forming apparatus, comprising:

a development device to form a visualized image with a developer;

a powder supplier to supply the developer from a powder container to the development device;

a housing in which the powder supplier and the development device are housed, the housing includes a toner container housing to house the power container;

the toner container housing including, a housing section to house the powder container therein, a loading preparation position which is an outer side of the housing section, and a loading position which is an inner side of the housing section and at which the powder container is set in the powder supplier; and a loading drive mechanism to move the powder container from the loading preparation position to the loading position along a longitudinal direction of the housing section when attaching the powder container to the image-forming apparatus, wherein the loading drive mechanism includes, a rotation driver to apply a rotation energizing force to the powder container by contacting with an outer circumferential face of the powder container; and an energizing direction changer to change the rotation energizing force from the rotation driver into at least a straight energizing force along the longitudinal direction of the housing section.

2. The image-forming apparatus according to claim 1, wherein the energizing direction changer is includes a driving holding portion to rotatably hold the rotation driver in a state in which a rotation axis line of the rotation driver is inclined to the longitudinal direction of the housing section line.

3. The image-forming apparatus according to claim 1, wherein the energizing direction changer includes a follow-up engagement portion disposed in the housing section, and wherein the follow-up engagement portion slidably engages with a spiral guide path provided in the outer circumferential face of the powder container.

4. The image-forming apparatus according to claim 1, wherein the energizing direction changer includes a follow-up engagement portion which is provided in a circumferential wall face of the rotation driver.

5. The image-forming apparatus according to claim 3, wherein the spiral guide path includes a guide groove in which the outer circumferential face concaves in a diameter direction perpendicular to a central axis line of the powder container, and the follow-up engagement portion includes a guide projection capable of being inserted into the guide groove.

6. The image-forming apparatus according to claim 3, wherein the spiral guide path includes a guide projection projecting from the outer circumferential face in a diameter direction perpendicular to a central axis line of the powder container, and the follow-up engagement portion includes a guide concave into which the guide projection is inserted.

7. The image-forming apparatus according to claim 3, further comprising, a circular retention path which is connected with an end portion of the spiral guide path on the loading preparation position side, wherein the circular retention path extends in a circumferential direction of the powder container.

8. A powder container for use in the image-forming apparatus according to claim 3, wherein the powder container includes a circular retention path which is connected with an end portion of the guide path on the loading preparation side and extends in a circumferential direction of the powder container.

9. The image-forming apparatus according to claim 1, wherein the loading drive mechanism to move the powder container from the loading position to the loading preparation position along a longitudinal direction of the housing section when detaching the power container from the image-forming apparatus.

10. An image-forming apparatus, comprising:

a development means configured to form a visualized image with a developing means;

a powder supplying means configured to supply the developer from a powder container means to the developing means; and a housing means in which the powder supplying means and the development means are housed, the housing means includes a toner container housing means to house the power container means;

the toner container housing means including, a housing section means to house the powder container means therein, a loading preparation position which is an outer side of the housing section means, and a loading position which is an inner side of the housing section means and at which the powder container means is set in the powder supplying means; and a loading drive means configured to move the powder container means from the loading preparation position and to the loading position along a longitudinal direction of the housing section means when attaching the powder container means to the image-forming apparatus, wherein the loading drive means includes, a rotation driver means configured to apply a rotation energizing force to the powder container means by contacting with an outer circumferential face of the powder container means; and an energizing direction changer means configured to change the rotation energizing force from the rotation driver means into at least a straight energizing force along the longitudinal direction of the housing section.

11. The image-forming apparatus according to claim 10, wherein the energizing direction changer means includes a driving holding portion configured to rotatably hold the rotation driver means in a state in which a rotation axis line of the rotation driver means is inclined to the longitudinal direction of the housing section means.

12. The image-forming apparatus according to claim 10, wherein the energizing direction changer means includes a follow-up engagement portion disposed in the housing section means, and wherein the follow-up engagement portion slidably engages with a spiral guide path provided in the outer circumferential face of the powder container means.

13. The image-forming apparatus according to claim 10, wherein the energizing direction changer means includes, a follow-up engagement portion which is provided in a circumferential wall face of the rotation driver means.

14. The image-forming apparatus according to claim 12, wherein the spiral guide path includes a guide groove in which the outer circumferential face concaves in a diameter direction perpendicular to a central axis line of the powder container means, and the follow-up engagement portion includes a guide projection means capable of being inserted into the guide groove.

15. The image-forming apparatus according to claim 12, wherein the spiral guide path includes a guide projection means projecting from the outer circumferential face in a diameter direction perpendicular to a central axis line of the powder container means, and the follow-up engagement portion includes a guide concave into which the guide projection means is inserted.

16. The image-forming apparatus according to claim 12, further comprising, a circular retention path which is connected with an end portion of the spiral guide path on the loading preparation position side, wherein the circular retention path extends in a circumferential direction of the powder container means.

17. A powder container for use in the image-forming apparatus according to claim 12, wherein the powder container means includes a circular retention path which is connected with an end portion of the guide path on the loading preparation side and extends in a circumferential direction of the powder container means.

18. The image-forming apparatus according to claim 10, wherein the loading drive means to move the powder container means from the loading position to the loading preparation position along a longitudinal direction of the housing section means when detaching the power container means from the image-forming apparatus.

* * * * *